US006069605A

United States Patent [19]

Ozawa

[11] Patent Number: 6,069,605

[45] Date of Patent: May 30, 2000

[54] LIQUID CRYSTAL DRIVING DEVICE, LIQUID CRYSTAL DISPLAY DEVICE, ANALOG BUFFER, AND LIQUID CRYSTAL DRIVING METHOD

[75] Inventor: Tokuroh Ozawa, Nagano-ken, Japan

[73] Assignee: Seiko Epson Corporation, Tokyo, Japan

[21] Appl. No.: 08/676,398

[22] PCT Filed: Nov. 21, 1995

[86] PCT No.: PCT/JP95/02369

§ 371 Date: Oct. 28, 1996

§ 102(e) Date: Oct. 28, 1996

[87] PCT Pub. No.: WO96/16347

PCT Pub. Date: May 30, 1996

[30] Foreign Application Priority Data

| | | | |
|---|---|---|---|
| Nov. 21, 1994 | [JP] | Japan | 6-311146 |
| Jun. 15, 1995 | [JP] | Japan | 7-174031 |

[51] Int. Cl.[7] ..... G09G 3/36

[52] U.S. Cl. ..... 345/98; 345/100

[58] Field of Search ..... 345/92, 98, 100

[56] References Cited

U.S. PATENT DOCUMENTS

| | | | |
|---|---|---|---|
| 5,017,914 | 5/1991 | Uchida et al. . | |
| 5,396,123 | 3/1995 | Minamizaki . | |
| 5,680,149 | 10/1997 | Koyama et al. . | |
| 5,682,175 | 10/1997 | Kitamura | 345/98 |

FOREIGN PATENT DOCUMENTS

| | | |
|---|---|---|
| 0-483-972 | 9/1991 | European Pat. Off. . |
| 0 601 713 WO A1 | 6/1994 | European Pat. Off. . |
| 9503629 | 2/1995 | European Pat. Off. . |
| 2-698-202 | 11/1992 | France . |
| 2-226975 | 9/1990 | Japan . |
| 6-75543 | 3/1994 | Japan . |
| 6-222741 | 8/1994 | Japan . |
| 7-191303 | 7/1995 | Japan . |
| A2 7191303 | 7/1995 | Japan . |

OTHER PUBLICATIONS

Nikkei Business Publications, Inc., "Driver LSI Problems Solved by Low Voltage Single Power Supply", *Flat Panel Display 1991,* Nov. 26, 1990, pp. 168–172.

Nikkei Business Publications, Inc., "A 13–inch EWS High–Definition TFT Liquid Crystal Panel With Improved Picture Quality by Means of Dot Inversion Driving", *Flat Panel Display 1993,* Dec. 10, 1992, pp. 120–123.

Electronics and Communications in Japan, Part II: Electronics, "Poly–Si TFT and Driver Integration Technology," H. Ohshima et al.; vol. 77, No. 7, Jul. 1994, New York, pp. 46–54.

Review of the Electrical Communication Laboratories, "A 10–In. Diagonal Active Matrix Monochrome Liquid–Crystal Display," S. Sakai et al.; vol. 36, No. 4, Jul. 1988, Tokyo, pp. 395–401.

*Primary Examiner*—Matthew Luu

*Attorney, Agent, or Firm*—Oliff & Berridge, PLC

[57] ABSTRACT

A video signal is sampled by sequential switches (104), etc. and the voltage held in capacitors (150) after passing through switches (110). Next, switches (120), (130) turn on, the hold for capacitor (152) is carried out, and that voltage buffered by analog buffer (170), then output. The switch on-off control is performed by means of lines L1 and L2. The control of the supply voltage is performed by $V1^+$ to $V4^+$, and the polarity of analog buffers (170), (172), etc. is controlled. By means of the switch on-off control and the supply voltage control, four driving methods for alternating liquid crystal driving can be realized. Further, the analog buffers are composed of TFTs; and positive and negative polarity inversion can be performed through supply voltage shift.

40 Claims, 40 Drawing Sheets

Specific Configuration for a Combined IV/IH/IS/IH + IS Driver

Specific Configuration for a Combined IV/IH/IS/IH + IS Driver

IV INVERSION DRIVING METHOD USING A COMBINED IV/IH/IS/IH+IS DRIVER

FIG.6 IH INVERSION DRIVING METHOD USING A COMBINED IV/IH/IS/IH+IS DRIVER

FIG.9 IS INVERSION DRIVING METHOD USING A COMBINED IV/IH/IS/IH+IS DRIVER

IH+IS INVERSION DRIVING METHOD USING A COMBINED IV/IH/IS/IH+IS DRIVER

DEDICATED IV DRIVER

IV INVERSION DRIVING METHOD BY MEANS OF A DEDICATED IV DRIVER

DEDICATED IH DRIVER

IH INVERSION DRIVING METHOD BY MEANS OF A DEDICATED IH DRIVER

DEDICATED IS DRIVER

FIG.19 IS INVERSION DRIVING METHOD USING A DEDICATED IS DRIVER

DEDICATED IH+IS DRIVER

IH+IS INVERSION DRIVING METHOD BY MEANS OF A DEDICATED IH+IS DRIVER

COMBINED IH/IH+IS DRIVER

IH INVERSION DRIVING METHOD USING A COMBINED IH/IH+IS DRIVER

IH + IS INVERSION DRIVING METHOD USING A COMBINED IH/IH+IS DRIVER

| | IV | IH | IS | IH+IS | |
|---|---|---|---|---|---|
| # 1 | ○ | | | | FIGURE 14 |
| # 2 | | ○ | | | FIGURE 16 |
| # 3 | | | ○ | | FIGURE 18 |
| # 4 | | | | ○ | FIGURE 20 |
| # 5 | ○ | ○ | | | SAME AS #2 |
| # 6 | ○ | | ○ | | SAME AS #3 |
| # 7 | ○ | | | ○ | SAME AS #4 |
| # 8 | | ○ | ○ | | SAME AS #15 |
| # 9 | | ○ | | ○ | FIGURE 24 |
| # 10 | | | ○ | ○ | SAME AS #15 |
| # 11 | ○ | ○ | ○ | | SAME AS #15 |
| # 12 | ○ | ○ | | ○ | SAME AS #9 |
| # 13 | ○ | | ○ | ○ | SAME AS #15 |
| # 14 | | ○ | ○ | ○ | SAME AS #15 |
| # 15 | ○ | ○ | ○ | ○ | FIGURE 1 |

FIG.27

IV INVERSION DRIVING METHOD USING A COMBINED IV/IS DRIVER

IV INVERSION DRIVING METHOD USING A COMBINED IV/IH/IH+IS DRIVER

ANALOG BUFFER INPUT/OUTOUT CHARACTERISTICS

FRAME INVERSION DRIVING (IV INVERSION DRIVING)

SCAN LINE INVERSION DRIVING (IH INVERSION DRIVING)

SIGNAL LINE INVERSION DRIVING (IS INVERSION DRIVING)

DOT INVERSION DRIVING (IH +IS INVERSION DRIVING)

LIQUID CRYSTAL DRIVING DEVICE, LIQUID CRYSTAL DISPLAY DEVICE, ANALOG BUFFER, AND LIQUID CRYSTAL DRIVING METHOD

FIELD OF TECHNOLOGY

This invention pertains to a driving method for a liquid crystal panel and, in particular, a driving method for a TFT liquid crystal panel.

BACKGROUND TECHNOLOGY

A number of different driving methods for TFT liquid crystal panels are already known. For example, as stated in "Driver LSI Problems Solved by low Voltage Single Power Supply", *Flat Panel Display* 1991 (Nov. 26, 1990, Nikkei Business Publications, Inc., p. 168 to p. 172), TFT liquid crystal panel drivers (liquid crystal driving devices) can be broadly divided into two types: digital and analog. The typical structure of a conventional analog line sequential driver is shown in FIG. 38. This conventional driver contains shift register 2000, level shifter 2002, switches (analog switches) 2004 to 2018, sampling capacitors 2020 to 2026, hold capacitors 2028 to 2034, and analog buffers 2036 to 2042. Shift register 2000 shifts in synchronization with the shift clock, the output is input into level shifter 2002, and the voltage is shifted. Switches 2004 to 2010 are sequentially turned off (opened) based on the output of level shifter 2002, resulting in the sequential sampling of video signals by capacitors 2020 to 2026. When video signal sampling is finished, the output enable signal becomes valid and switches 2012 to 2018 simultaneously turn on (close). When this happens, the sampled voltages are held by capacitors 2028 to 2034 through capacitive coupling between capacitors. The voltage that is held is then buffered by analog buffers 2036 to 2042 and is output to the signal lines of the liquid crystal panel as display signals. Analog buffers 2036 to 2042 are constructed, for example, by connecting operational amplifiers to voltage followers.

The configuration of the pixel region of the liquid crystal panel is shown in FIG. 39. Signal line 2050 is connected to the source region of TFT (Thin Film Transistor) 2054, scan line 2052 is connected to the gate electrode of TFT 2054, and pixel electrode 2054 is connected to the drain region of TFT 2054. When TFT 2054 is selected by scan line 2052, the voltage difference between the voltage applied to pixel electrode 2056 and the counter voltage (common voltage) applied to the counter electrode is supplied to liquid crystal element 2058, thereby driving liquid crystal element 2058.

Liquid crystal elements degrade when direct current voltage is applied to them for extended periods. This property makes necessary a driving means in which the polarity of the voltage applied to the liquid crystal elements is inverted after a specified period of time. As shown in FIG. 40A to FIG. 40D, such known driving methods include frame inversion driving (hereafter referred to as "1V inversion driving" for the sake of convenience), scan line inversion driving (hereafter referred to as "1H inversion driving" for the sake of convenience), signal line inversion driving (hereafter referred to as "1S inversion driving" for the sake of convenience), and dot inversion driving (hereafter referred to as "1H+1S inversion driving" for the sake of convenience).

In 1V inversion driving, as shown in FIG. 40A, the polarity of the applied voltage in all pixels is the same within a single vertical scanning period (1 field, 1 frame); and the polarity of all pixels is inverted after each vertical scanning period. While 1V inversion driving has the advantage of having driver circuits that are simple and easy to control and, moreover, does not suffer from line nonuniformity, this driving means does suffer from extremely conspicuous screen flicker.

In 1H inversion driving, as shown in FIG. 40B, the polarity of the applied voltage differs for each scan line; and, under these conditions, polarity is inverted after each vertical scanning period. The advantage of 1H inversion driving is that flicker is not conspicuous and cross-talk in the vertical direction is inhibited. Conversely, however, it suffers from the drawbacks of susceptibility to horizontal cross-talk and visible horizontal stripes in video displays. This driving method is particularly effective when employing non-linear active elements (such as polycrystalline TFTs and MIMs, for example) with large off leakage currents. Large liquid crystal panels, however, suffer from a brightness gradient problem caused by parasitic resistance of the interconnect electrodes. The brightness gradient problem cannot be solved by means of 1H inversion driving.

In 1S inversion driving, as shown in FIG. 40C, the polarity of the applied voltage differs for each signal line; and, under these conditions, polarity is inverted after each vertical scanning period. The advantage of 1S inversion driving is that flicker is not conspicuous and cross-talk in the horizontal direction is inhibited. Conversely, however, it suffers from the drawbacks of susceptibility to vertical cross-talk and visible vertical stripes in video displays. Although it is possible solve the brightness gradient problem mentioned above, using elements which have large off leakage currents leads to undesirable effects.

In 1H+1S inversion driving, the polarity of the applied voltage differs for each pixel; and, under these conditions, polarity is inverted after each vertical scanning period. 1H+1S inversion driving is disclosed in, for example, "A 13-inch EWS High-Definition TFT Liquid Crystal Panel With Improved Picture Quality by Means of Dot Inversion Driving", *Flat Panel Display* 1993 (Dec. 10, 1992, Nikkei Business Publications, Inc., pages 120 to 123). This method has the advantages of both 1H inversion driving and 1S inversion driving; it also has the drawbacks of both. Further, the realization of this method means that the configuration and control of the driver circuits become extremely complex, thus creating the disadvantages of longer design times and higher device costs.

As described above, each of the said four driving methods has both advantages and disadvantages. Hence, the question of which of these four driving methods to use is determined by considering such things as the type and performance of non-linear active elements, the size of the liquid crystal panel, the targeted display quality, the cost of the device, and a variety of other design conditions. However, these design conditions are sometimes changed in the development process; and a change in any of the said design conditions after one of the said four methods has already been adopted will also necessitate a change in the driving method, a matter that requires tremendous labor for circuit changes and such. Therefore, a liquid crystal driver that can easily accommodate these types of design changes is desirable.

If a liquid crystal driver is to be supplied as a standard device, it should have a high degree of general versatility so that it may accommodate all users. Users of liquid crystal drivers, however, employ a variety of driving methods, such as those above. In addition to the variety of driving methods, moreover, is a wide variety of performance (operating speed, number of signal lines, etc.) requirements for liquid crystal drivers. Consequently, it has been difficult to supply a highly versatile, standard liquid crystal driver capable of answering the demands of all users. Yet this problem could also be solved if one were able to offer a liquid crystal driver that realizes all four of the said driving methods on one device without unduly enlarging the circuit.

In addition, analog buffers 2036 to 2042 (see FIG. 38), which are used in the liquid crystal driver, need to have a wide output voltage range (operating range). This is because a wide output voltage range facilitates the making of a liquid crystal panel capable of displaying multiple gray-scale levels. To obtain a wide output voltage range, it is necessary to widen the range of the supply voltage that is supplied to the analog buffers. However, to achieve this, a manufacturing process whose breakdown voltage is high must be used, which leads to the problems of increased circuit size and higher costs. For example, Japanese Unexamined Patent Application Heisei 6-222741 discloses technology of the prior art which generates a high quality display in multiple gray-scales levels using low voltage drivers. In the technology of the prior art, however, liquid crystal drivers and other peripheral circuits are not integrated on the liquid crystal panel, and analog buffers are comprised not of TFTs but of single crystal CMOS transistors. In addition, the characteristics of analog buffers comprised of TFTs, and those of analog buffers comprised of single crystal CMOS transistors differ in various respects, including such things as the width of the linear region in input-output characteristics, allowable supply voltage ranges, and offset values. Therefore, even if the said technology of the prior art were applied to an analog buffer comprised of TFTs, a high quality display having multiple gray-scales could not be obtained. In addition, there has been absolutely no disclosure in the said technology of the prior art regarding the idea for a liquid crystal driver capable of using the four driving methods together; and, moreover, the said technology of the prior art is related to digital liquid crystal drivers, not to analog line sequential drivers.

In addition, analog buffers contained in liquid crystal drivers are provided for each individual signal line of the liquid crystal panel, making the number of buffers extremely large. For example, a 480×640 dot full-color liquid crystal panel requires a minimum of 640×3 analog buffers. Also, since analog buffers pass electric current from integrated constant current supplies, there is the additional problem of finding a way to hold the current consumption of the analog buffers at a low level in order to reduce the power consumption of the overall device.

The present invention was designed to resolve the problems described above, and it is aimed at the realization of multiple driving methods which can invert the polarity of voltage applied to liquid crystal elements without unduly increasing the size of circuits in the liquid crystal driving device.

Another of the aims for the present invention is the realization of an analog buffer which is comprised of TFTs and which can switch between positive polarity and negative polarity by means of a shift in the supply voltage.

Yet another of the aims for the present invention is to hold the current consumption of the analog buffers to a low level and achieve low power consumption.

DESCRIPTION OF THE INVENTION

In order to resolve the problems mentioned above, the liquid crystal driving device of this invention drives liquid crystal elements arrayed in a matrix by supplying a voltage to a liquid crystal element, to the other side of which is supplied a counter voltage;

and is characterized by the inclusion of 1 to N (N is an integer) signal driving means, which include a means for sequentially sampling and holding video signals; multiple analog buffers, to which are applied high and low supply voltages, for buffering the sample and hold voltages; and selection means for selecting any output from the said multiple buffers;

a supply voltage control means both for controlling the values of the said high potential supply voltage and the said low potential supply voltage which are supplied to the said analog buffers, as well as for shifting the range of the output voltage of the said analog buffers to either high potential or low potential, using the said counter voltage as a reference;

and a selection control means for controlling the selection by the said selection means of any output of the said analog buffers in which the output voltage range was shifted by said supply voltage control means.

According to this invention, the range of output voltage of the multiple analog buffers is shifted to either high potential or low potential, using the counter voltage as a reference. Then, any of the outputs of these multiple analog buffers is selected; and liquid crystal elements are driven. Therefore, depending on the combination of the polarity of the output voltage range of the analog buffers and the method of selection, it becomes possible to change the polarity of voltage applied to the liquid crystal with each scan line, each signal line, each horizontal scanning period, or each vertical scanning period, thus enabling the realization of multiple driving methods in a single liquid crystal driving device; and thereby realizing, without unduly increasing the size of the circuits, the optimum liquid crystal driving device in the form of a highly versatile, standard device which is capable of easily accommodating such things as design changes.

This invention is a liquid crystal driving device that drives liquid crystal elements arrayed in a matrix by supplying a voltage to a liquid crystal element, to the other side of which is supplied a counter voltage;

and is characterized by the inclusion of 1 to N (N is an integer) signal driving means which include a means for sequentially sampling and holding video signals, a first and second switching means, a first analog buffer which buffers and outputs voltage which is transmitted via the said first switching means, a second analog buffer which buffers and outputs voltage which is transmitted via the said second switching means, a third switching means which is connected to output of the said first analog buffer and which turns on and off in conjunction with the said second switching method, and a fourth switching means which is connected to the output of the said second analog buffer and which turns on and off in conjunction with the said first switching method;

a supply voltage control means which controls the values of the high potential supply voltage and the low potential supply voltage which are supplied to the said first and second analog buffers and which shifts the range of the output voltage of the said first and second analog buffers to either high potential or low potential, using the said counter voltage as a reference;

and a switch control means which controls the on-off operations of the said first through fourth switching means.

According to this invention, the sampled video signals are input and held in the first and second analog buffers via the first and second switching means. Then, the range of output voltage of the first and second analog buffers is shifted to either high potential or low potential, using the counter voltage as a reference. Next, either of the outputs of the first and second analog buffers is selected and driving is performed with respect to the liquid crystal elements. Therefore, depending on the combination of the polarity of the output voltage range of the first and second analog buffers, it becomes possible to change the polarity of voltage applied to the liquid crystal with each scan line, each signal line, each horizontal scanning period, or each vertical scanning period, thus enabling the realization of multiple driving methods in a single liquid crystal driving device. Also according to this invention, it is possible to perform sample-and-hold operations using the entire horizontal scanning period, thus making it possible to raise the accuracy and speed of sample-and-hold operations.

This invention is also characterized by the fact that frame inversion driving is performed by switching the shift directions of the said output voltage range of the said first and second analog buffers every vertical scanning period by controlling the said supply voltage control means.

According to this invention, the polarity of the voltage applied to all the liquid crystal elements is inverted each vertical scanning period (1 field, 1 frame), thereby making frame inversion driving possible and enabling suppression of line nonuniformity.

This invention is also characterized by the fact that scan line inversion driving is performed by making the shift directions of the output voltage range of the said first and second analog buffers, which are included in a single said signal driving means, differ from one another via control of the said supply voltage control means and by switching the on-off sequence of the said first through fourth switching means each vertical scanning period via control of the said switch control means.

This invention is also characterized by the fact that scan line inversion driving is performed by making the shift directions of the output voltage range of the said first and second analog buffers, which are included in a single said signal driving means, differ from one another via control of the said supply voltage control means and by switching the shift directions of the output voltage range of the said first and second analog buffers each vertical scanning period.

According to these inventions, the polarity of applied voltage differs with each scan line and polarity inversion takes place under these conditions each vertical scanning period, thereby realizing scan line inversion driving. This is capable of preventing liquid crystal panel flicker and vertical cross-talk and, moreover, can prevent vertical stripes from occurring in video display. This invention is particularly effective when employing nonlinear active elements (such as polycrystalline TFTs and MIMs, for example) with large off leakage currents. In addition, flicker can also be suppressed to a lower level than is possible in signal line inversion driving.

This invention is also characterized by the fact that signal line inversion driving is performed by making the shift directions of the output voltage range of the said first and second analog buffers, which are included in a single said signal driving means, the same while making the shift directions of the output voltage range of the said first and second analog buffers, which are included in the adjacent said signal driving means, different, and by switching the shift directions of the output voltage range of the said first and second analog buffers each vertical scanning period.

According to this invention, the polarity of applied voltage differs for each signal line and polarity is inverted under these conditions each vertical scanning period, thereby realizing signal line inversion driving. This enables the prevention of liquid crystal panel flicker and horizontal cross-talk and, moreover, can prevent horizontal stripes from occurring in video display. In particular, this invention solves the brightness gradient problem caused by parasitic resistance of the interconnect electrodes, and, thus, achieves a liquid crystal driving device that is optimally suited to large liquid crystal panels.

This invention is also characterized by the fact that dot inversion driving is performed by making the shift directions of the output voltage range of the said first and second analog buffers, which are included in a single said signal driving means, differ from one another via control of the said supply voltage control means; while also making the shift directions of the output voltage range of the said first and second analog buffers, which are included in the adjacent said signal driving means, differ from one another; and by switching the on-off sequence of the said first through fourth switching means each vertical scanning period via control of the said switch control means.

This invention is also characterized by the fact that dot inversion driving is performed by making the shift directions of the output voltage range of the said first and second analog buffers, which are included in a single said signal driving means, differ from one another via control of the said supply voltage control means; while also making the shift directions of the output voltage range of the said first and second analog buffers, which are included in the adjacent said signal driving means, differ from one another; and switching the shift directions of the output voltage range of the said first and second analog buffers each vertical scanning period.

This invention is also characterized by the fact that dot inversion driving is performed by making the shift directions of the output voltage range of the said first and second analog buffers, which are included in a single said signal driving means, differ from one another via control of the said supply voltage control means; making the on-off sequence of the said first through fourth switching means, which are included in the adjacent said signal driving means, differ via control of the said switch control means; and switching the on-off sequence of the said first through fourth switching means each vertical scanning period.

This invention is also characterized by the fact that dot inversion driving is performed by making the shift directions of the output voltage range of the said first and second analog buffers, which are included in a single said signal driving means, differ from one another via control of the said supply voltage control means; switching the shift directions of the output voltage range of the said first and second analog buffers each vertical scanning period; and making the on-off sequences of the said first through fourth switching means, which are included in the adjacent said signal driving means, different from one another via control of the said switch control means.

According to these inventions, the polarity of applied voltage differs for each pixel and polarity is inverted each vertical scanning period under these conditions, thereby realizing dot inversion driving, which can prevent liquid crystal panel flicker as well as horizontal and vertical cross-talk. This invention also solves the brightness gradient problem caused by parasitic resistance of interconnect electrodes, and, moreover, can decrease power consumption of the circuit which generates the counter voltage since there is little exchange of current with external circuits.

This invention is characterized by the fact that the said supply voltage control means includes a means for controlling a first supply line, which supplies high potential supply voltage and low potential supply voltage to the said first analog buffer, which is included in the (2K−1) (K is an integer) signal driving means;

a second supply line, which supplies high potential supply voltage and low potential supply voltage to the said second analog buffer, which is included in the (2K−1) signal driving means;

a third supply line, which supplies high potential supply voltage and low potential supply voltage to the said first analog buffer, which is included in the 2K signal driving means;

a fourth supply line, which supplies high potential supply voltage and low potential supply voltage to the said second analog buffer, which is included in the 2K signal driving means;

and the values of the high potential supply voltage and low potential supply voltage which are supplied to the said first through fourth supply lines;

and by the fact that the said switch control means includes a means for controlling switch control line 1, which controls the switching of said first and third switching means;

switch control line 2, which controls the switching of the said second and fourth switching means;

and the switch signals, which are supplied to the said switch control lines 1 and 2.

According to this invention, power is supplied to the first and second analog buffers, which are included in the odd-numbered signal driving means, by the first and second supply lines, respectively; and is supplied to the first and second analog buffers, which are included in the even-numbered signal driving means, by the third and fourth supply lines, respectively. Switching control of the first and third switching means is achieved by switch control line 1, and switching control of the second and fourth switching means is achieved by switch control line 2. This enables the realization of a liquid crystal driving device for combined frame inversion, scan line inversion, signal line inversion, and dot inversion driving.

This invention is also characterized by the fact that the said supply voltage control means includes a means for controlling a supply line which supplies high potential supply voltage and low potential supply voltage to the first and second analog buffers and the values of the high potential supply voltage and low potential supply voltage which are supplied to the said supply line;

and that said switch control means includes a means for controlling switch control line 1, which controls the switching of the said first and third switching means;

switch control line 2, which controls the switching of the said second and fourth switching means;

and the switch signals which are supplied to the said switch control lines 1 and 2.

According to this invention, a single channel voltage is supplied to the first and second analog buffers using a supply line, while switching control of the first and third switching means is achieved by switching control line 1 and switching control of the second and fourth switching means is achieved by switch control line 2. This enables the realization of a liquid crystal driving device dedicated to frame inversion driving.

This invention is also characterized by the fact that the said supply voltage control means includes a means for controlling a first supply line, which supplies high potential supply voltage and low potential supply voltage to the said first analog buffer;

a second supply line, which supplies high potential supply voltage and low potential supply voltage to the said second analog buffer;

and the values of the high potential supply voltage and low potential supply voltage which are supplied to the said first and second supply lines;

and by the fact that said switch control means includes a means for controlling switch control line 1, which controls the switching of the said first and third switching means;

switch control line 2, which controls the switching of the said second and fourth switching means;

and the switch signals which are supplied to the said first and second switch control lines.

According to this invention, power is supplied to the first analog buffer by the first supply line and to the second analog buffer by the second supply line, while switching control of the first and third switching means is achieved by switch control line 1 and switching control of the second and fourth switching means is achieved by switch control line 2. This enables the realization of a liquid crystal driving device dedicated to scan line inversion driving.

This invention is also characterized by the fact that the said supply voltage control means includes a means for controlling a first supply line, which supplies high potential supply voltage and low potential supply voltage to the said first and second analog buffers, which are included in the (2K−1) (K is an integer) signal driving means;

a second supply line, which supplies high potential supply voltage and low potential supply voltage to the said first and second analog buffers, which are included in the 2K signal driving means;

and the values of the high potential supply voltage and low potential supply voltage which are supplied to the said first and second supply lines;

and by the fact that said switch control means includes a means for controlling switch control line 1, which controls the switching of the said first and third switching means;

switch control line 2, which controls the switching of the said second and fourth switching means;

and the switch signals which are supplied to the said switch control lines 1 and 2.

According to this invention, power is supplied to the first and second analog buffers, which are included in the odd-numbered signal driving means, by the first supply line, and to the first and second analog buffers, which are included in the even-numbered signal driving means, by the second supply line. In addition, switching control of the first and third switching means is achieved by switch control line 1; and switching control of the second and fourth switching means is achieved by switch control line 2. This enables the realization of a liquid crystal driving device dedicated to signal line inversion driving.

This invention is also characterized by the fact that the said supply voltage control means includes a means for controlling a first supply line, which supplies high potential supply voltage and low potential supply voltage to the said first analog buffer;

a second supply line, which supplies high potential supply voltage and low potential supply voltage to the said second analog buffer;

and the values of the high potential supply voltage and low potential supply voltage which are supplied to the said first and second supply lines;

and by the fact that the said switch control means includes a means for controlling switch control line 1, which controls the switching of the first and third switching means, which are included in the (2K−1) (K is an integer) signal driving means, and the switching of the second and fourth switching means, which are included in the 2K signal driving means;

switch control line 1, which controls the switching of the first and third switching means, which are included in the 2K signal driving means, and the switching of the second and fourth switching means, which are included in the (2K−1) signal driving means;

and the switch signals which are supplied to the said first and second switch control lines.

According to this invention, power is supplied to the first analog buffer by the first supply line and to the second analog buffer by the second supply line. In addition, switching control of the first and third switching means, which are included in the odd-numbered signal driving means, and switching control of the second and fourth switching means, which are included in the even-numbered signal driving means, are achieved by switch control line 1; switching control of the first and third switching means, which are included in the even-numbered signal driving means, and switching control of the second and fourth switching means, which are included in the odd-numbered signal driving means, are achieved by switch control line 2. This enables the realization of a liquid crystal driving device dedicated to dot inversion driving.

This invention is also characterized by the fact that the said supply voltage control means includes a means for controlling a first supply line, which supplies high potential supply voltage and low potential supply voltage to the said first analog buffer;

a second supply line, which supplies high potential supply voltage and low potential supply voltage to the said second analog buffer;

and the values of the high potential supply voltage and low potential supply voltage which are supplied to the said first and second supply lines;

and by the fact that the said switch control means includes a means for controlling switch control line 1, which controls the switching of the first and third switching means, which are included in the (2K−1) (K is an integer) signal driving means;

switch control line 2, which controls the switching of the second and fourth switching means, which are included in the (2K−1) signal driving means;

switch control line 3, which controls the switching of the first and third switching means, which are included in the 2K signal driving means;

switch control line 4, which controls the switching of the second and fourth switching means, which are included in the 2K signal driving means;

the switch signals which are supplied to the said switch control lines 1 through 4.

According to this invention, power is supplied to the first analog buffer by the first supply line and to the second analog buffer by the second supply line. In addition, switching control of the first and third switching means, which are included in the odd-numbered signal driving means, is achieved by switch control line 1; switching control of the second and fourth switching means, which are included in the odd-numbered signal driving means, is achieved by switch control line 2; switching control of the first and third switching means, which are included in the even-numbered signal driving means, is achieved by switch control line 3; and switching control of the second and fourth switching means, which are included in the even-numbered signal driving means, is achieved by switch control line 4. This enables the realization of a liquid crystal driving device that can be used for both scan line inversion and dot inversion driving.

This invention is also characterized by the inclusion of a scan driving means which outputs select voltage to the scan lines in order to select whether or not to apply said applied voltage to said liquid crystal elements;

and by the fact that the said scan driving means enables the said selection voltage by sequentially delaying the select voltage by exactly one horizontal scanning period so that the said selection voltage becomes effective when the said third switching means or said fourth switching means becomes conductive after completion of the sample-and-hold in the first horizontal scanning period of the vertical scanning period.

According to this invention, an incorrect voltage is prevented from being applied to the liquid crystal element via the signal line at the start of the vertical scanning period and, thus, an erroneous display is prevented.

This invention is also characterized by the fact that the said supply voltage control means includes a means for fixing at a prescribed value the said high potential supply voltage and low potential supply voltage at the time of the vertical blanking period.

According to this invention, the voltage of the analog buffer's high potential side and low potential side is fixed at a prescribed value during the vertical blanking period, thereby halting the flow of current via the constant current supply in the analog buffer and achieving reduced power consumption. Because this processing takes place during the vertical blanking period, power consumption is reduced without affecting the screen display in the liquid crystal panel.

This invention is also characterized by the fact that it is an analog buffer comprised of thin film transistors which is supplied both a high potential supply voltage and a low potential supply voltage and which buffers input voltage and outputs output voltage;

that it has a linear region in which the relationship of the said output voltage to the said input voltage is approximately linear;

and that it includes a supply voltage control means which controls the value of the said high potential supply voltage and said low potential supply voltage so that the amplitude of the said input voltage is included in the said linear region when the amplitude of the said input voltage shifts.

According to this invention, the value of the supply voltage on the high potential side and low potential side is controlled in accordance with the amplitude of the input voltage, thereby enabling the buffering of input voltage in the linear region and making such things as precise gray-scale display possible.

This invention is also characterized by the fact that it includes a differential stage in which the said input voltage and said output voltage are input and in which the voltage difference between the input voltage in question and the output voltage in question is amplified and output;

and a driving means which has, at a minimum: an n-channel driving transistor in which the output of the said differential stage is input to the gate electrode, and which outputs said output voltage from the drain region;

and that the said supply voltage control means performs control which shifts to the low potential side the value of the said high potential supply voltage and said low potential supply voltage so that when the amplitude of the said input voltage shifts to the low potential side the said amplitude is included in the said linear region which is located on the high potential side.

According to this invention, the linear region is located on the high potential side. So, by performing control so that the supply voltage is shifted to the low potential side and the amplitude of the input voltage is included in this linear region, it is possible to perform buffering of the input voltage in the linear region.

This invention is also characterized by the fact that it includes a differential stage in which the said input voltage and said output voltage are input and in which the voltage difference between the input voltage in question and output voltage in question is amplified and output;

and a driving means which has, at a minimum, a p-channel driving transistor in which the output of the said differential stage is input by the gate electrode and which outputs said output voltage to the drain region;

and that the said supply voltage control means performs control which shifts to the high potential side the value of the said high potential supply voltage and said low potential supply voltage so that when the amplitude of the said input voltage shifts to the high potential side, the said amplitude is included in the said linear region which is located on the low potential side.

According to this invention, the linear region is located on the low potential side. So, by performing control so that the supply voltage is shifted to the high potential side and the amplitude of the input voltage is included in this linear region, it is possible to perform buffering of the input voltage in the linear region.

This invention is also characterized by the inclusion of a means for canceling the said analog buffer's offset value by adjusting the value of the said counter voltage.

In this invention, the polarity of the analog buffer is switched merely by controlling the supply voltage using an analog buffer of the same type. Therefore, the offset value can be made the same value when the analog buffer has positive polarity and when it has negative polarity. In this way the offset value can be canceled by adjusting the counter voltage, without distorting the video signal.

In addition, the liquid crystal display device associated with this invention is characterized by the inclusion of at least one of the said liquid crystal driving devices as well as multiple signal lines which are connected to a signal driving means of the said liquid crystal driving device, multiple scan lines which intersect the said signal lines, liquid crystal elements which are arrayed in a matrix, and multiple thin film transistors for transmitting applied voltages to the said liquid crystal elements in question.

In this instance, one may include two liquid crystal driving devices in the liquid crystal display device, connect the (2L−1) (L is an integer) signal lines to the signal driving means of one of the said liquid crystal driving devices while connecting the 2L signal lines to the signal driving means of the other said liquid crystal device, and make it so that the output voltage range of the analog buffers selected in the signal driving means connected to the (2L−1) signal lines is shifted in the opposite direction, with reference to the counter voltage, with respect to the output voltage range of the analog buffers selected in the signal driving means connected to the 2L signal line. This implementation makes it possible, for example, to achieve signal line inversion driving using a liquid crystal driving device that is capable of frame inversion driving, or achieving dot inversion driving using a liquid crystal driving device that is capable of scan line inversion driving.

Further, in a liquid crystal display device associated with this invention it is desirable that the said liquid crystal driving device be integrated on the liquid crystal panel which is comprised by the said thin film transistors, thereby enabling the display device to be made more compact and at lower cost.

BRIEF EXPLANATION OF THE FIGURES

FIG. 27 is used to explain the configuration of other liquid crystal drivers.

THE BEST SYSTEMS FOR IMPLEMENTING THE INVENTION

Using the accompanying figures, specific examples of the present invention will be described in detail below.

First Embodiment

Figure 1:
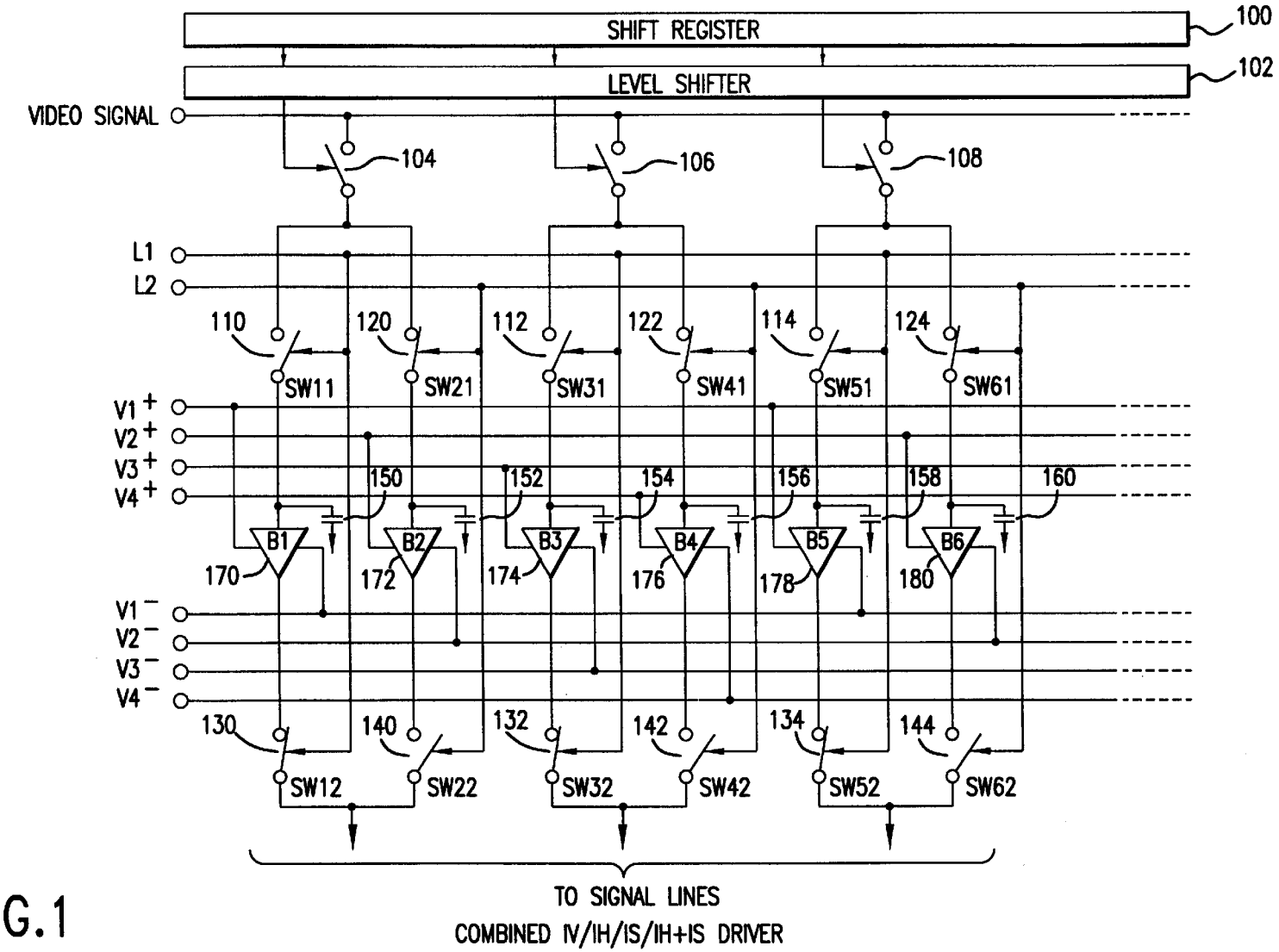
FIG. 1 is an example of the configuration of a liquid crystal driver associated with Example 1 of this invention.

FIG. 1 shows an example of the configuration of a liquid crystal driver (liquid crystal driving device) according to the first embodiment of this invention. The first embodiment concerns a combined 1V/1H/1S/1H+1S liquid crystal driver. This liquid crystal driver is known as a source driver which drives the signal lines and includes multiple (1 to N) signal driving means. For example, the first signal driving means includes switches (analog switches) 104, 110, 120, 130, 140; capacitors 150 and 152; and analog buffers 170 and 172. The second signal driving means includes switches 106, 112, 122, 132, 142; capacitors 154 and 156; and analog buffers 174 and 176. Additionally, the number of signal lines in FIG. 1 driven by the liquid crystal driver is, for the display of color on a 640×480 dot liquid crystal panel, for example, 640×3. In this case, it is acceptable to provide multiple liquid crystal driver devices to drive these signal lines, or it is also acceptable to locate liquid crystal driver devices on the top and bottom edges of the liquid crystal panel and alternately connect the signal line columns to the top and bottom drivers. Also, when displaying color, it is acceptable either to provide three video signal lines for RGB use and connect these three video signal lines individually to sampling switches, or to use time-division of the RGB video signals on one video line.

Shift register 100 shifts in synchronization with the shift clock, and the output is fed into level shifter 102 for level shifting. Switches 104 to 108 are turned off sequentially (opened) based on the output of level shifter 102, and sampling of the video signal is accomplished. The sampled voltage is held in capacitors 150 to 160 after passing through the switches that are on among switches 110 to 114 and 120 to 124. In this way, switches 104 to 108 and capacitors 150 to 160 in the present example provide means to sequentially sample and hold the video signal.

Analog buffers 170 to 180, in the form of an operational amplifier connected to a voltage follower for example, have the function of buffering and outputting the sampled and held voltages from capacitors 150 to 160. For example, analog buffers 170, 174, and 178 (the first analog buffer) buffer and output the voltages transmitted by switches 110 to 114 (the first switching means) while analog buffers 172, 176, and 180 (the second analog buffer) buffer and output the voltages transmitted by switches 120 to 124 (the second switching means).

In order to select the outputs of analog buffers 170 to 180, switches 130 to 134 (the third switching means) and switches 140 to 144 (the fourth switching means) which compose the selection means are connected to the outputs of analog buffers 170 to 180. Then, the outputs of analog buffers 170 to 180 are transmitted to the signal lines through the switches that are on among switches 130 to 134 and 140 to 144.

Now, in this embodiment, the high potential and low potential supply voltage to analog buffers 170 to 180 is controlled; and, using the counter voltage as a reference, shift control is achieved by shifting the range of the output voltage of analog buffers 170 to 180 to either high potential or low potential. This shift control is achieved by controlling, by means of supply voltage controller 202 (see FIG. 30), the high and low voltages applied to supply lines $V1^+$ to $V4^+$ and $V1^-$ to $V4^-$, respectively, which are connected to analog buffers 170 to 180.

Further, in this embodiment, selection control of the output of the analog buffers, the output voltage range of which has been shifted, is carried out through selection by switches 130 to 134 and 140 to 144 (selection means). This selection control is achieved by controlling, by means of switch controller 206 (see FIG. 30), the voltages supplied to switch control lines L1 and L2.

Next, control of switches 110 to 144 will be explained in detail. In this embodiment, the on-off operation of the first switch 110 (SW11) and the fourth switch 140 (SW22) are coupled as are the on-off operation of the second switch 120 (SW21) and the third switch 130 (SW12). The control of the on-off operation of these switches is achieved through the switch controller 206 (see FIG. 30) connected to the first and second switch control lines L1 and L2. For example, in FIG. 1, when the second switch 120 is on (closed), the third switch 130 is also on. Consequently, at this time, the video signal voltage sampled by switch 104 is held by capacitor 152 after passing through switch 120. Also, the voltage held in capacitor 150 during the previous period is buffered by analog buffer 170 and then output to the signal line by way of the third switch 130. On the other hand, in the reverse case of that described above, when the second switch 120 is off, the third switch 130 is also off; and, at this time, the first and fourth switches 110 and 140, respectively, are on.

Figure 38:
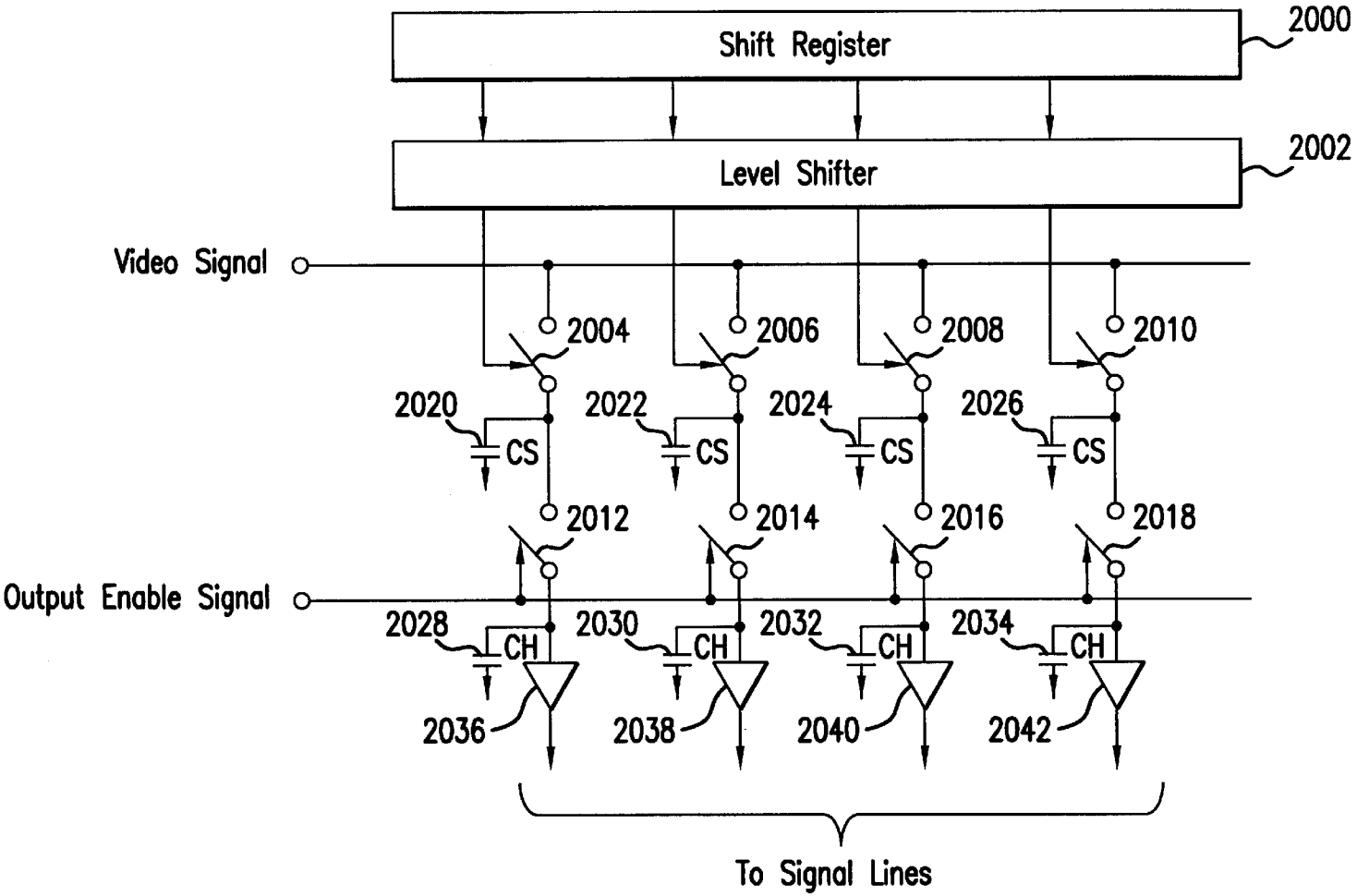
FIG.38 PRIOR ART
FIG. 38 is an example of the configuration of an analog line sequential driver of the prior art.
Figure 39:
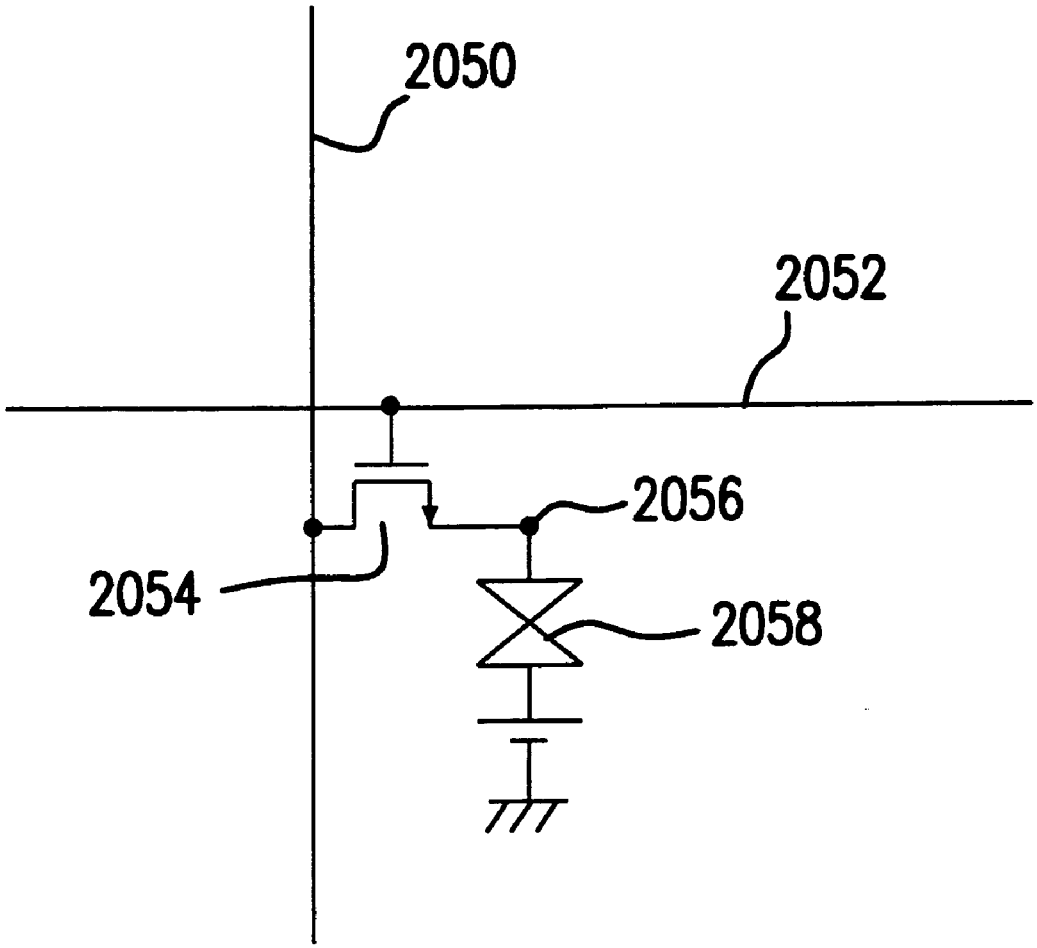
FIG. 39 shows the configuration of the pixel region of a liquid crystal panel.

In the example of the prior art shown in FIG. 38, capacitors 2028 to 2034 could be charged with sampling voltages only during the period when the output enable signal was in effect and switches 2012 to 2018 were on. Additionally, it was necessary to have separate capacitors for sampling, 2020 to 2026, and holding, 2028 to 2034. In contrast, in the present embodiment, as explained above, by turning the switches on and off alternately, the capacitors can charge using an entire horizontal scanning period thereby allowing the output of a precise display signal voltage. Additionally, it is possible to use the same capacitors for both sampling and holding.

Figure 2:
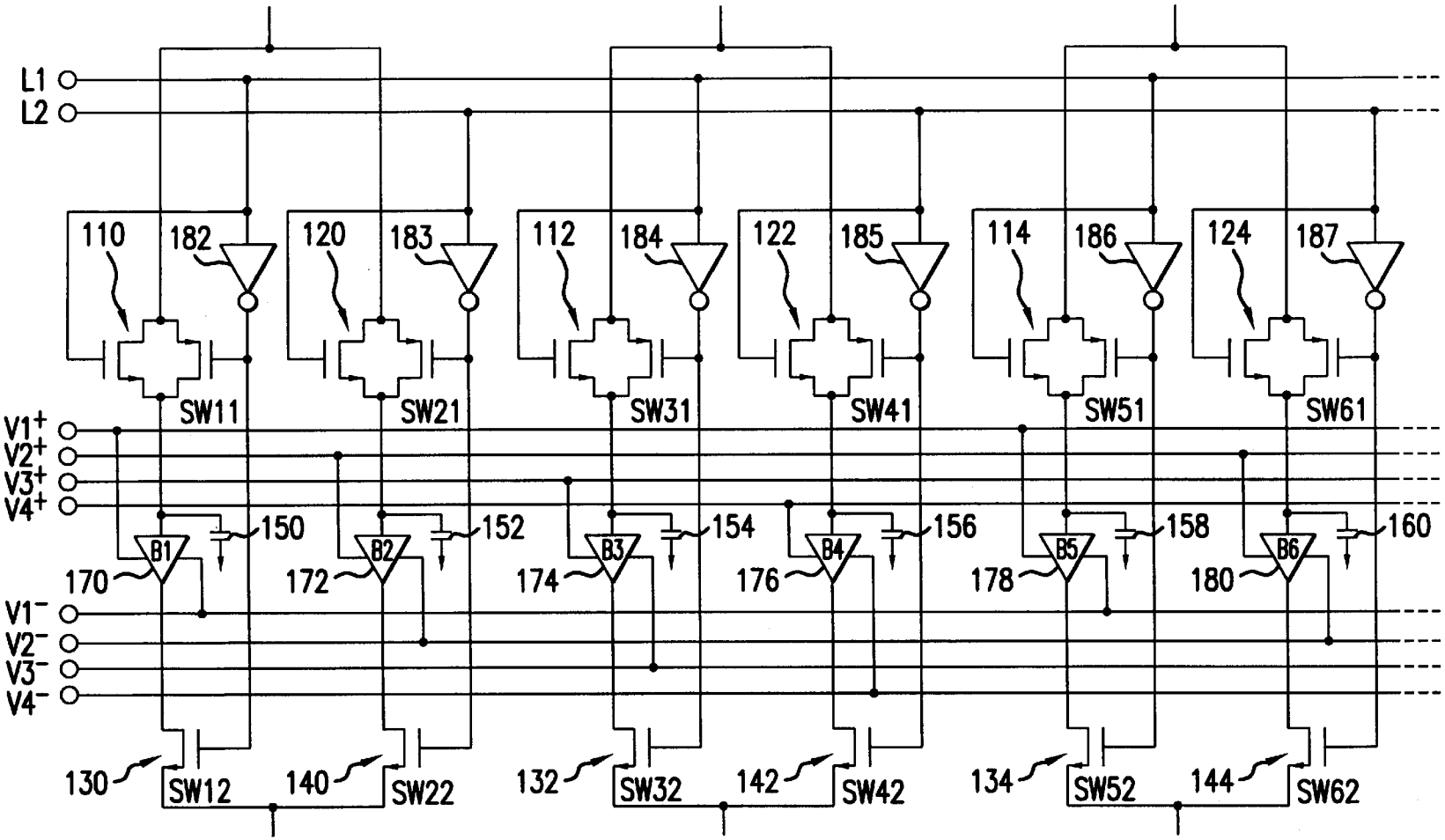
FIG. 2 is an example of a specific configuration of the liquid crystal driver shown in FIG. 1.
Figure 3:
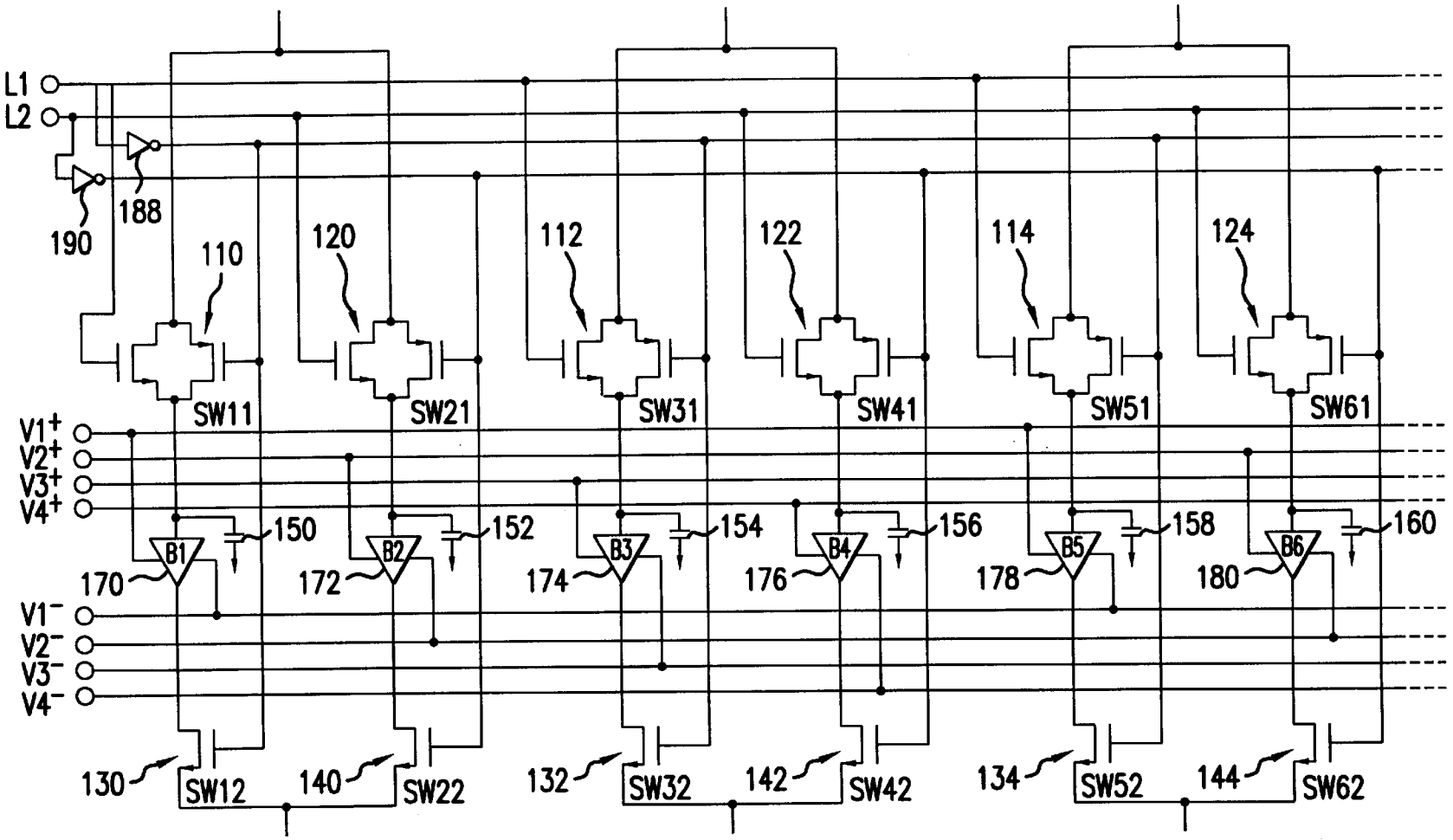
FIG. 3 is an example of a specific configuration of the liquid crystal driver shown in FIG. 1.

FIGS. 2 and 3 show examples of specific configurations of the liquid crystal driver shown in FIG. 1. In FIGS. 2 and 3, however, shift register 100, level shifter 102, and switches 104 to 108 shown in FIG. 1 are omitted. As shown in FIGS. 2 and 3, switches 110 to 124 are composed of transmission-type transistors while switches 130 to 144 are composed of n-type transistors. Through the establishment of inverter circuits 182 to 187 in FIG. 2 and the establishment of inverter circuits 188 and 190 in FIG. 3, the configuration of the drivers guarantees that the first switch 110 and the third switch 130 (or the second switch 120 and the fourth switch 140) cannot be on simultaneously. The construction of FIG. 2 is advantageous in that the number of wiring connections to switch control lines L1 and L2 can be decreased, and the construction of FIG. 3 is advantageous in that the number of inverter circuits can be decreased.

Next, the control of the supply voltage to the analog buffers will be explained in detail. As shown in FIG. 1, in the present embodiment, a four-channel supply voltage can be supplied through four channels using supply lines $V1^+$ to $V4^+$ for high potentials and supply lines $V1^-$ $V4^-$ for low potentials. In other words, voltages are supplied to the first analog buffers 170 and 178 included in the odd-numbered signal driving means (the first and third signal driving means) through the first supply lines $V1^+$ and $V1^-$; voltages are supplied to the second analog buffers 172 and 180 included in the odd-numbered signal line driving means (the second signal driving means) through the second supply lines $V2^+$ and $V2^-$; voltages are supplied to the first analog buffer 174 included in the even-numbered signal driving means through the third supply lines $V3^+$ and $V3^-$; and voltages are supplied to the second analog buffer 176 included in the even-numbered signal driving means through the fourth supply lines $V4^+$ and $V4^-$. The supply voltages corresponding to these supply lines are controlled by means of the supply voltage controller 202 (see FIG. 30) connected to the supply lines. By such control of the supply voltages, analog buffers 170 to 180 can switch from use as positive polarity analog buffers to use as negative polarity analog buffers. Here, positive polarity analog buffers are buffers in which the output voltage range has been shifted to high potential using the counter voltage (common voltage) as a reference; and negative polarity analog buffers are buffers in which the output voltage range has been shifted to low potential using the counter voltage as a reference. As mentioned previously, the liquid crystal elements degrade under direct current driving so that it is necessary to invert the polarity of the voltage applied to the liquid crystal elements at regular intervals. In the present embodiment, this polarity inversion is realized by controlling the values of the supply voltages to the analog buffers through supply lines $V1^+$ to $V4^+$ and $V1^-$ to $V4^-$ and switching between positive polarity analog buffers and negative polarity analog buffers. In this embodiment, it is possible to realize 1V, 1H, 1S, and 1H+1S inversion driving from a single liquid crystal driver using control of supply voltages to supply lines $V1^+$ to $V4^+$ and $V1^-$ to $V4^-$ and the control of switch control lines L1 and L2 described above. How 1V, 1H, 1S, and 1H+1S inversion driving can be realized using liquid crystal drivers having the configuration shown in FIG. 1 will be explained below.

Figure 4:
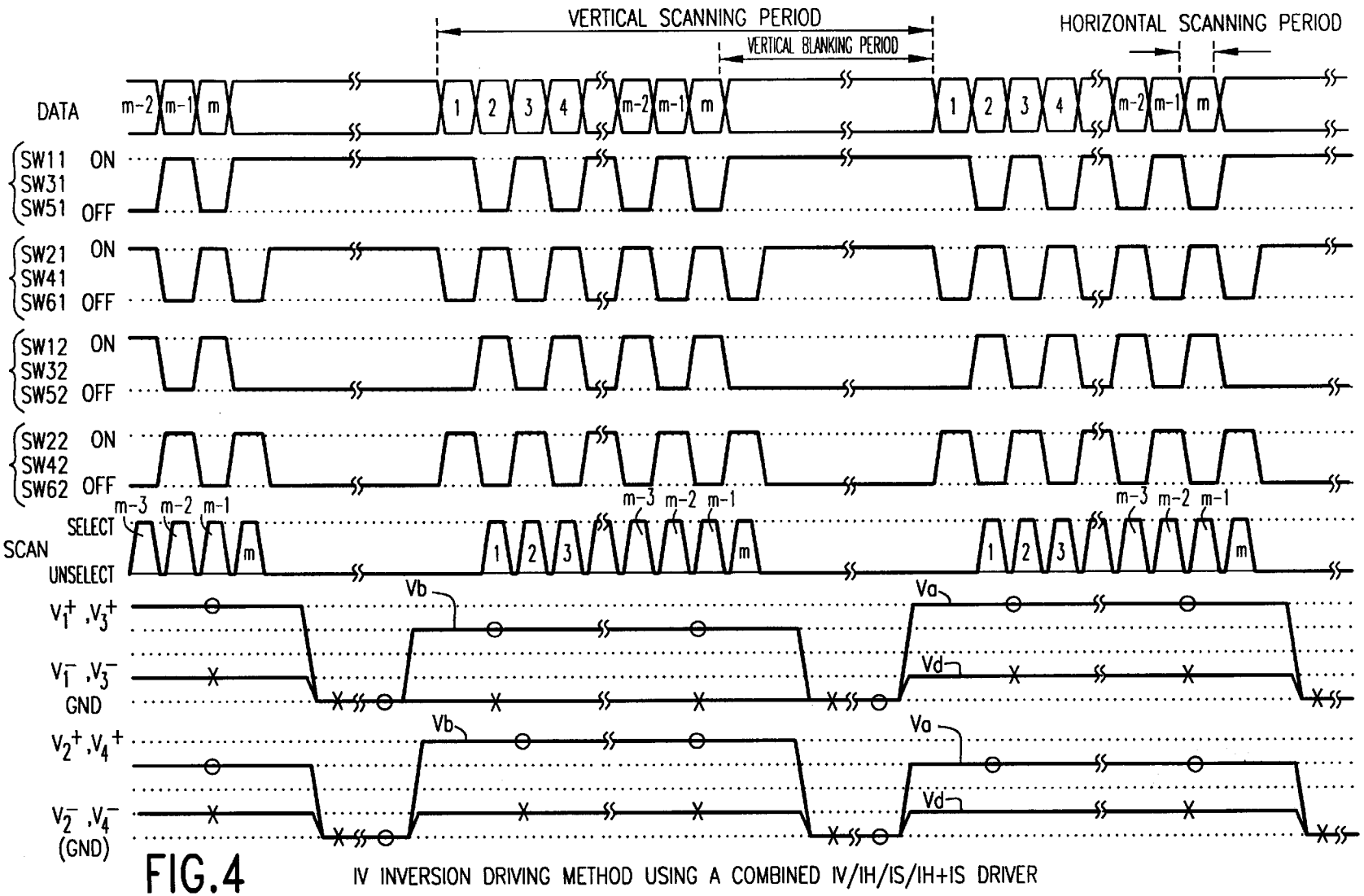
FIG. 4 is a timing chart for 1V inversion driving in Example 1.
Figure 40A:
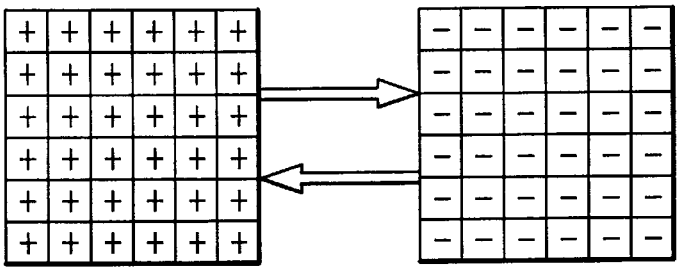
FIG. 40A, FIG. 40B, FIG. 40C, and FIG. 40D are used to explain 1V, 1H, 1S, and 1H+1S inversion driving.

I. 1V Inversion (Frame Inversion) Driving 1V inversion driving is a driving method as shown in FIG. 40A discussed previously. Using this driving method, it is possible to suppress the generation of line nonuniformity. FIG. 4 is a timing chart for achieving 1V inversion driving with the liquid crystal driver of FIG. 1, and FIG. 5 explains the liquid crystal driver operation in such a case. In FIG. 4, on and off conditions are shown for switches such as SW11 and SW31; but, for the circuit configurations in FIGS. 2 and 3, the on and off conditions shown in FIG. 4 correspond to high level and low level, respectively.

First, as shown in FIG. 4, during the vertical blanking period, switches SW11, SW31, and SW51 as well as SW21, SW41, and SW61 are all on while switches SW12, SW32, and SW52 as well as SW22, SW42, and SW62 are all off. Accordingly, the display signal voltage is not supplied to the signal lines.

Additionally, during the vertical blanking period, supply lines $V1^+$ to $V4^+$ and $V1^-$ to $V4^-$ are all fixed at ground potential (GND). As a result, the high potential supply VDD and the low potential supply VSS of analog buffers 170 to 180 are fixed at ground potential. Analog buffers 170 to 180 have integrated constant current supplies; and, when there is a potential difference between VDD and VSS, current flows via this constant current supply. As in the present example, however, the potential difference between VDD and VSS vanishes if VDD and VSS are fixed at ground potential; and, since no current flows via the constant current supply, it is possible to decrease power consumption. During the vertical blanking period, even if the analog buffers are not in operation, switches 130 to 144 are off so that there is no effect on the liquid crystal panel screen display. Meanwhile, since the analog buffers are arranged to correspond to each signal line, if the power consumption of analog buffers 170 to 180 is decreased, the power consumption of the entire liquid crystal panel can be decreased substantially. As a result, in the reverse case under normal operating conditions, it is possible to increase the amount of current flowing through the constant current supplies in analog buffers 170 to 180 with the result being that the performance of the analog buffers can be improved and improvements in the liquid crystal panel display quality are also possible. Further, in this case, the power supply which fixes VDD and VSS at ground potential can also be used when analog buffers 170 to 180 are in normal operating condition. Therefore, this embodiment also has the advantage that it is not necessary to generate a new supply voltage to set VDD and VSS to fixed values. Further, in this embodiment, the reason this type of treatment can be easily realized is that it is possible to use supply voltage controller 202 which is already present for polarity inversion in analog buffers 170 to 180. The choice of fixed potentials for VDD and VSS is not limited to ground potential, and it is possible to use various other potentials.

Next, entering the vertical scanning period, during the first horizontal scanning period, switches SW11, SW31, and SW51 as well as SW22, SW42, and SW62 are on while switches SW21, SW41, and SW61 as well as SW12, SW32, and SW52 are off. Under these conditions, switches 104, 106, and 108 sequentially turn off during one horizontal scanning period. Thus, video signal voltages sequentially sampled through switches 104, 106, and 108 are sequentially held by capacitors 150, 154, and 158 by passing through "on" switches SW11, SW31, and SW51.

At this point, since switches SW12, SW32, and SW52 are off, the transient state sample and hold voltages are not output to the signal lines through analog buffers 170, 174, and 178. Further, although switches SW22, SW42, and SW62 are on, for this case in the present embodiment, because the scan lines (SCAN in FIG. 4) are unselected during the first horizontal scanning period as shown in FIG. 4, an erroneous display does not appear on the liquid crystal panel. In other words, in the present embodiment, after the sample and hold during the first horizontal scanning period of the vertical scanning period is finished, when the third switches 130 to 134 or the fourth switches 140 to 144 become conducting, the select voltage (voltage to select whether or not the applied voltage is supplied to the liquid crystal element) is effective after a sequential delay of one horizontal scanning period. As a result, the circuit configuration as shown in FIG. 1 is able to prevent an erroneous display even when sample and holding is active.

The control of the select voltage output corresponding to the scan lines is performed by the scan line drivers (gate drivers, scan driving means) not shown in the figure.

In the present embodiment, prior to entering the vertical scanning period, the supply lines $V1^+$ and $V3^+$ as well as $V2^+$ and $V4^+$ are set to a level of Vb while $V1^-$ and $V3^-$ as well as $V2^-$ and $V4^-$ are set to ground level. As a result, all of analog buffers 170 to 180 are negative polarity analog buffers. In other words, it is possible to establish the analog buffers such that the output voltage range is shifted to lower potentials using the counter voltage (common voltage) as a reference.

Next, entering the second horizontal scanning period, this time switches SW11, SW31, and SW51 as well as SW22, SW42, and SW62 are off while switches SW21, SW41, and SW61 as well as SW12, SW32, and SW52 are on. Under these conditions, switches 104, 106, and 108 sequentially turn off during one horizontal scanning period; and the sampled video signal voltages are sequentially held by capacitors 152, 156, and 160.

At this time, since switches SW12, SW32, and SW52 are on, the voltages held in capacitors 150, 154, and 158 during the first horizontal scanning period are output to the signal lines through analog buffers 170, 174, and 178. In this case, as shown in FIG. 4, because the first scan line is effective (select), normal display operation is achieved in the first scan line. Also, because switches SW22, SW42, and SW62 are off at this time, the transient state hold voltages are not output to the signal lines.

The switching action of the switches as described above is repeated until all the scan lines are scanned; and once the last scan line is scanned, the vertical blanking period is again entered and all of $V1^+$ to $V4^+$ and $V1^-$ to $V4^-$ are set to ground potential. Following this, prior to entering the next vertical scanning period, supply lines $V1^+$ and $V3^+$ as well as $V2^+$ and $V4^+$ are set to a level of Va while $V1^-$ and $V3^-$ as well as $V2^-$ and $V4^-$ are set to a level of Vd. As a result, all of analog buffers 170 to 180 are positive polarity analog buffers. In other words, it is possible to establish the analog buffers such that the output voltage range is shifted to higher potentials using the counter voltage (common voltage) as a reference. Thus, the analog buffers which were set to negative polarity during the previous vertical scan period are set to positive polarity and 1V inversion driving is achieved.

Here, the relations between Va, Vb, and Vc are, for example, $$Va-Vd=Vb-GND$$

$$Va>Vb$$

$$Vd>GND.$$

Figure 34A:
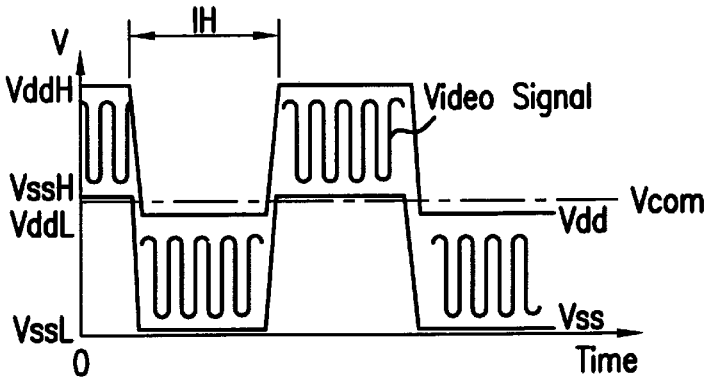
FIG. 34A, FIG. 34B, and FIG. 34C are used to explain the method for shifting supply voltage.
Figure 34B:
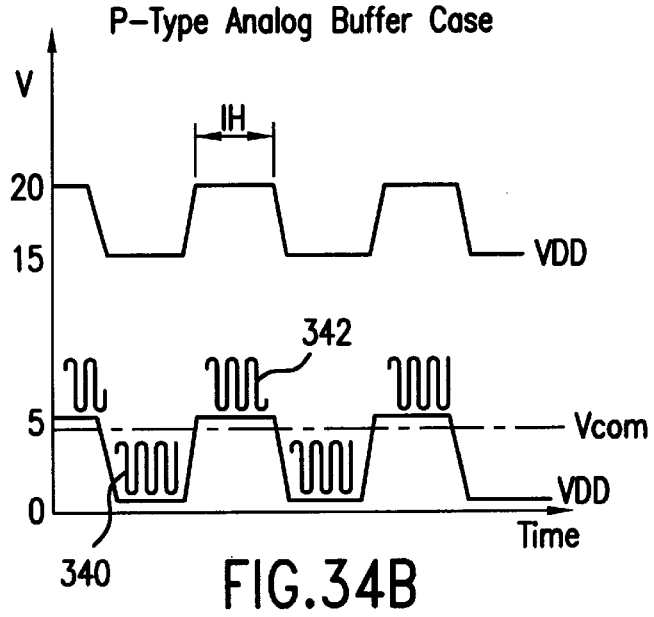

Additionally, if the analog buffers are p-type, the common voltage Vcom can be set in the neighborhood of Vd for example (see FIG. 34B). In this case, Va, Vb, and Vd, are, for example, 20 V, 15 V, and 5 V. On the other hand, if the analog buffers are n-type, the common voltage Vcom can be set in the neighborhood of Vb for example (see FIG. 34C). of course, the supply voltage shift, as shown in FIG. 34A is also possible, as long as the supply voltage is controlled such that at the least the output voltage range of the analog buffers is shifted to higher potentials or lower potentials using the counter voltage as a reference.

Figure 5:
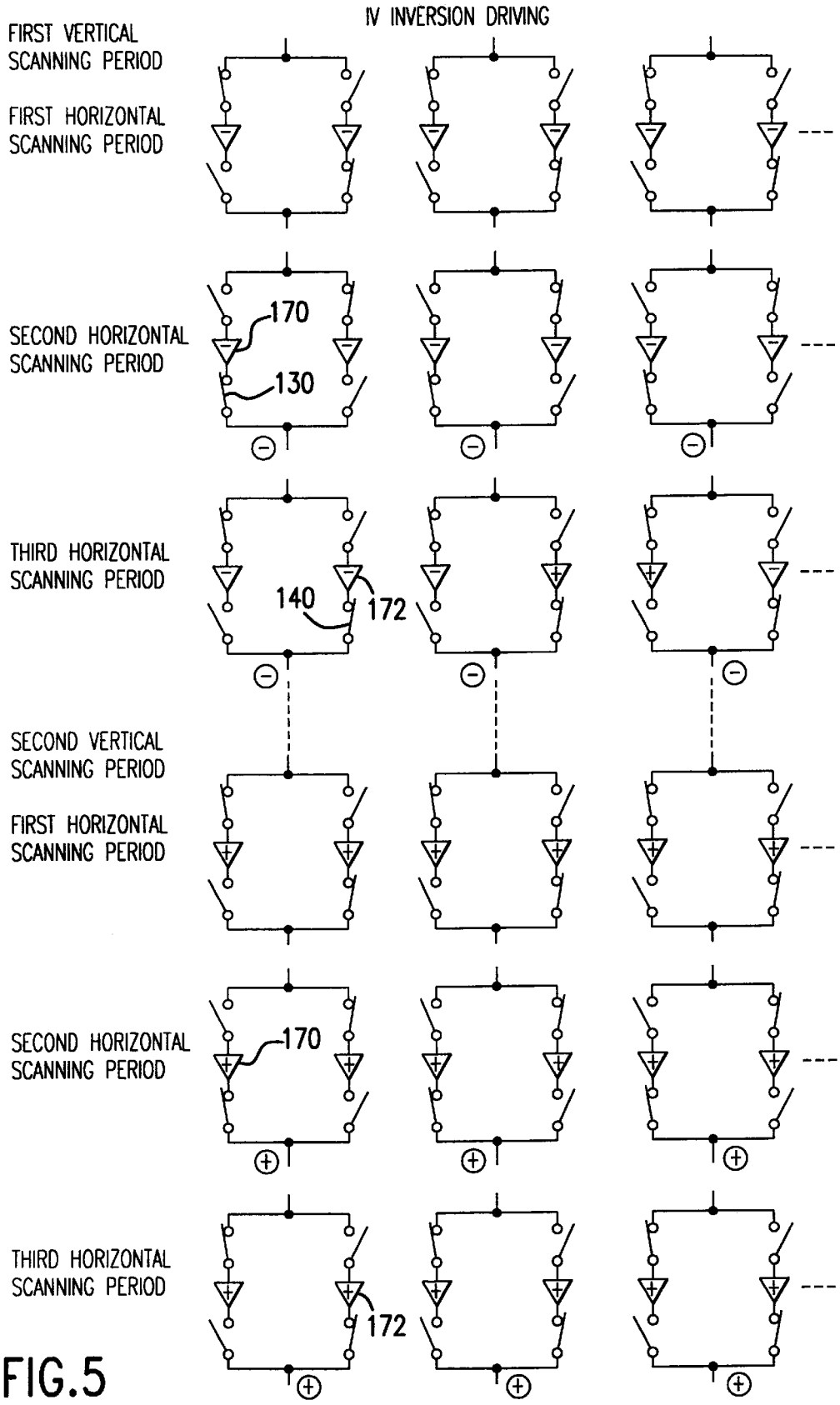
FIG. 5 is used to explain the operation of the liquid crystal driver for 1V inversion driving.

A schematic representation of the operation of 1V inversion driving for the present embodiment is shown in FIG. 5. The following occurs during the first vertical scanning period. First, the voltage held during the first horizontal scanning period is buffered in analog buffer 170 and output via switch 130 during the second horizontal scanning period. Here, because analog buffer 170 is negative polarity as a result of supply voltage control, the output voltage range of analog buffer 170 is also negative; and negative voltage with respect to the counter voltage reference level is applied to the liquid crystal element. Next, the voltage sampled and held during the second horizontal scanning period is buffered by negative polarity analog buffer 172 and output through switch 140 during the third horizontal scanning period. This negative voltage is applied to the liquid crystal element.

Upon entering the second vertical scanning period, analog buffers 170 to 180 are all positive polarity as a result of supply voltage control. Consequently, hold voltages are buffered and output by means of positive polarity analog buffer 170 during the second horizontal scanning period and positive polarity analog buffer 172 during the third horizontal scanning period. As a result of the above process, 1V inversion (frame inversion) driving can be achieved. In FIG. 5, although an effective display signal voltage is output for the first time during the second horizontal scanning period, even in such a case, as mentioned previously, the scan lines are effective after a single horizontal scanning period delay and no ill effects result.

Figure 6:
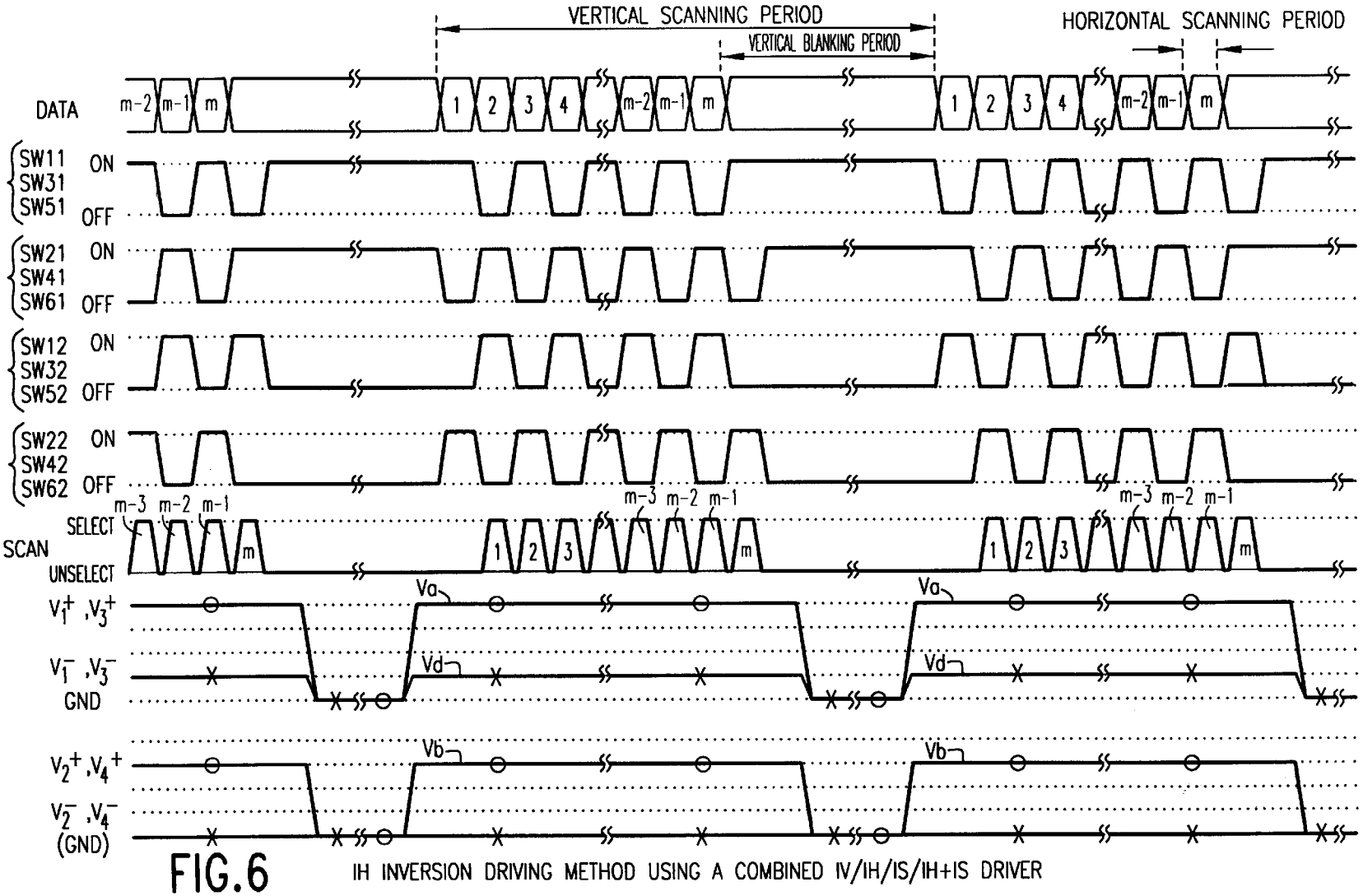
FIG. 6 is a timing chart for 1H inversion driving in Example 1.
Figure 40B:
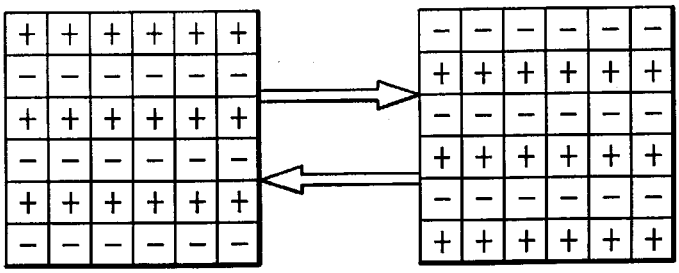

II. 1H Inversion (Scan Line Inversion) Driving 1H inversion driving is a driving method as shown in FIG. 40B discussed previously. Using this driving method, liquid crystal panel flicker and cross-talk in the vertical direction can be prevented. Additionally, the appearance of vertical stripes during the display of moving images can also be prevented. In particular, this method is effective when employing non-linear active elements (such as polycrystalline TFTs and MIMs for example) with large off leakage currents. Flicker can be suppressed to a lower level using this driving method in comparison to 1S inversion driving. FIG. 6 shows the timing chart for achieving 1H inversion driving with the liquid crystal driver of FIG. 1. The differences between 1V inversion driving of FIG. 4 and 1H inversion driving of FIG. 6 are as described below. First, in contrast to the fixed on-off sequence of switches in FIG. 4, the on-off sequence of switches in FIG. 6 differs with each vertical scanning period. In other words, in FIG. 6, during the first vertical scanning period, switches SW11, SW31, and SW51 as well as SW22, SW42, and SW62 are initially on, then switches SW21, SW41, and SW61 as well as SW12, SW32, and SW52 turn on. During the second vertical scanning period, however, switches SW21, SW41, and SW61 as well as SW12, SW32, and SW52 are initially on, then switches SW11, SW31, and SW51 as well as SW22, SW42, and SW62 turn on. The on-off sequence of switches alternates in this fashion after each vertical scanning period.

Additionally, the control of supply voltages to analog buffers 170 to 180 differs as described below. In FIG. 4, supply voltages to supply lines $V1^+$ to $V4^+$ and $V1^-$ to $V4^-$ switch after every vertical scanning period from Vb level and ground level to Va level and Vd level. In contrast, in FIG. 6, $V1^+$ and $V3^+$ are fixed at Va level, $V1^-$ and $V3^-$ are fixed at Vd level, $V2^+$ and $V4^+$ are fixed at Vb level, and $V2^-$ and $V4^-$ are fixed at ground level. Consequently, analog buffers 170, 174, and 178 are fixed at positive polarity while analog buffers 172, 176, and 180 are fixed at negative polarity.

Figure 7:
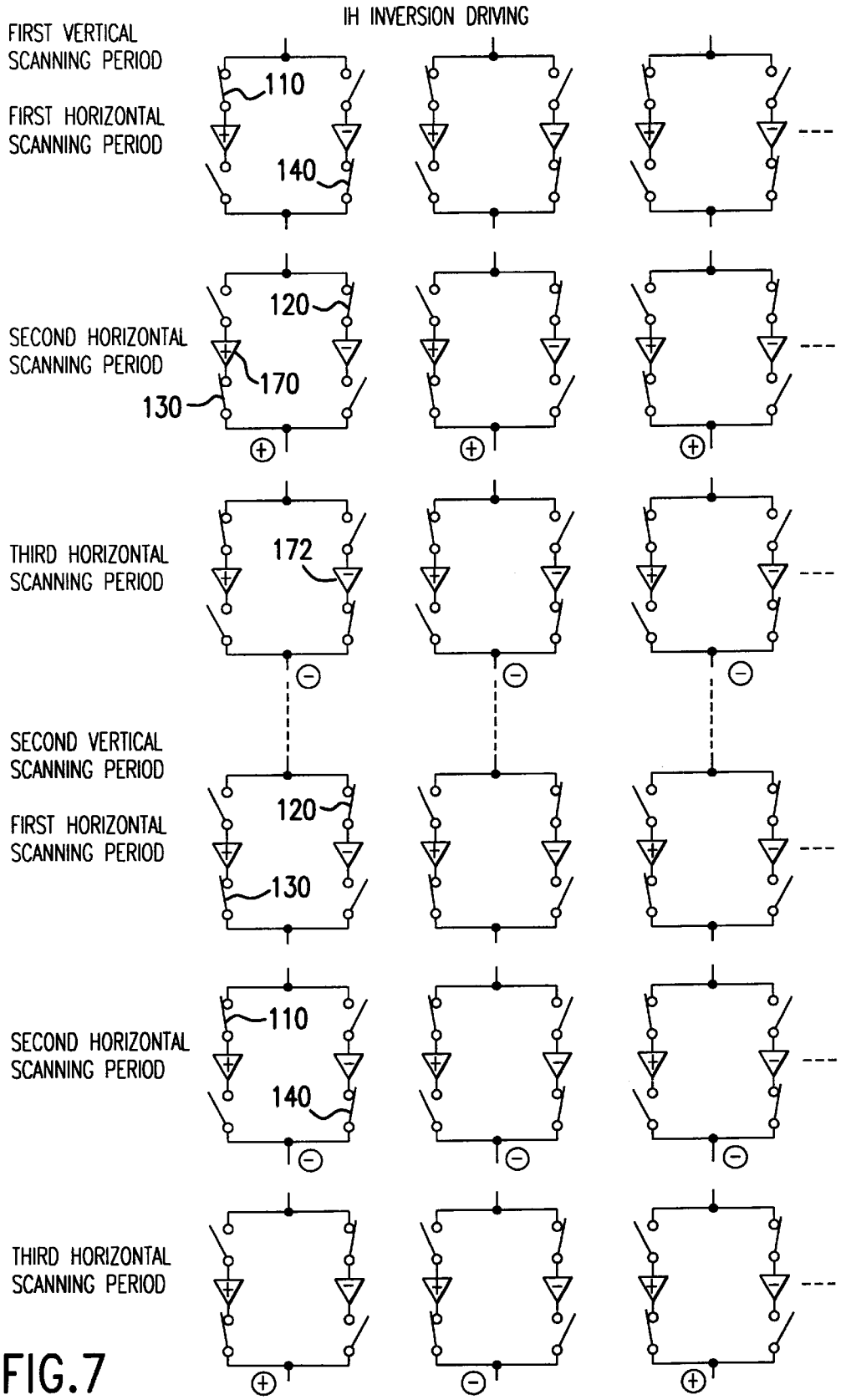
FIG. 7 is used to explain the operation of the liquid crystal driver for 1H inversion driving.

The operation described above is shown schematically in FIG. 7. As FIG. 7 shows, one of the analog buffers which forms half the pair which outputs a display signal to a single signal line is of positive polarity while the other analog buffer is of negative polarity. That is, analog buffer 170 is positive and analog buffer 172 is negative. During the second horizontal scanning period, the voltage applied to the liquid crystal is positive since the buffering is accomplished by positive polarity analog buffer 170; and, during the third horizontal scanning period, the voltage applied to the liquid crystal is negative since the buffering is accomplished by negative polarity analog buffer 172. As a result, the voltage applied to the liquid crystal changes between positive and negative polarity after each scan line.

Further, during the first vertical scanning period, the sequence of switching is such that initially switches 110 and 140 are on, then switches 120 and 130 turn on. In contrast, during the second vertical scanning period, the sequence of switching is such that initially switches 120 and 130 are on, then switches 110 and 140 turn on. Thus, the polarity of the liquid crystal applied voltage inverts between the first vertical scanning period and the second vertical scanning period.

In the manner above, 1H inversion driving can be achieved.

Figure 8:
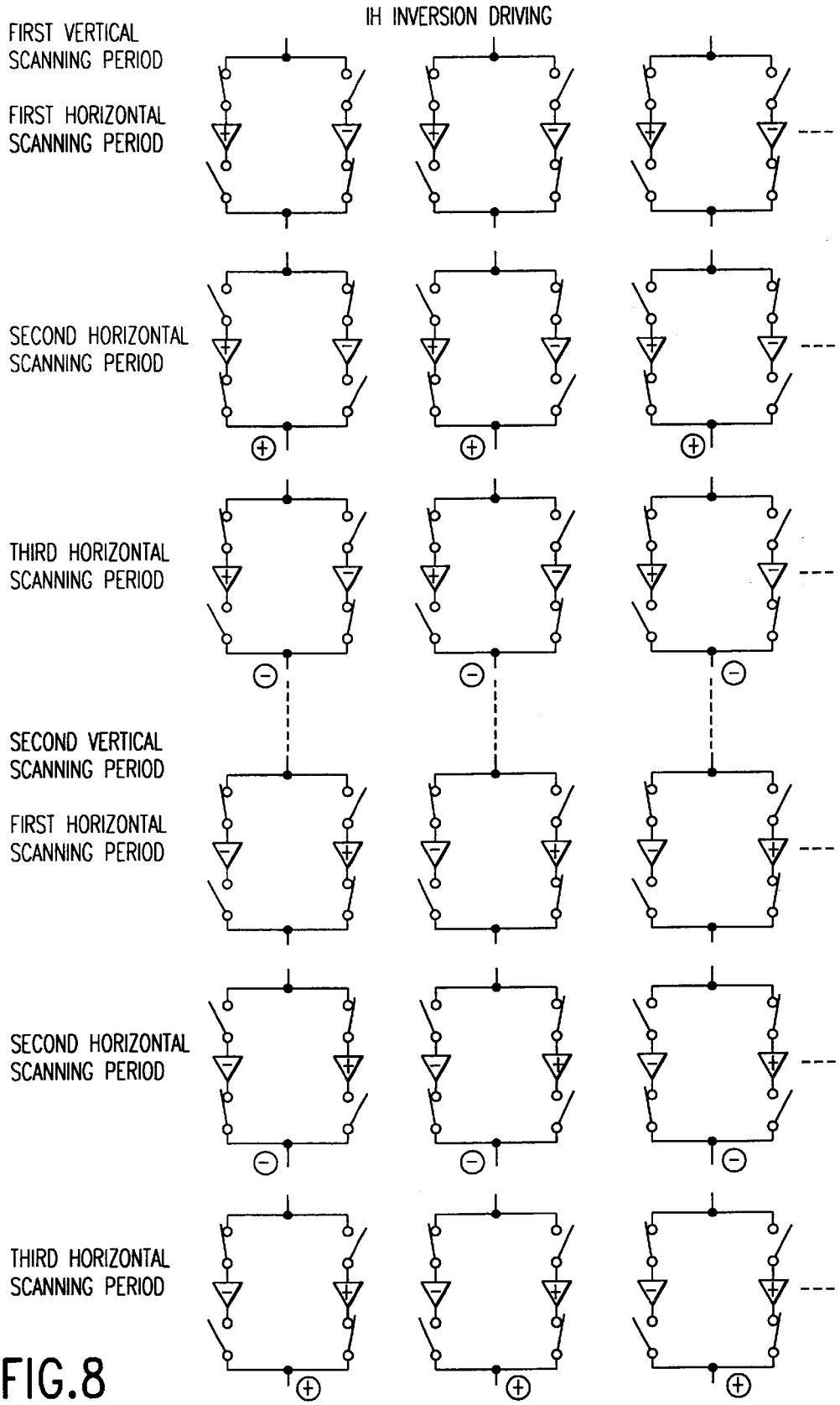
FIG. 8 is used to explain the operation of the liquid crystal driver for 1H inversion driving.

In order to invert the polarity of the voltage applied to the liquid crystal after every vertical scanning period, not only the method of alternating the on-off sequence of switches after each vertical scanning period as shown in FIG. 7, but also the method of changing the polarity of all the analog buffers 170 to 180 after each vertical scanning period as shown in FIG. 8 is acceptable. 1H inversion driving can be achieved through this second method as well.

Figure 9:
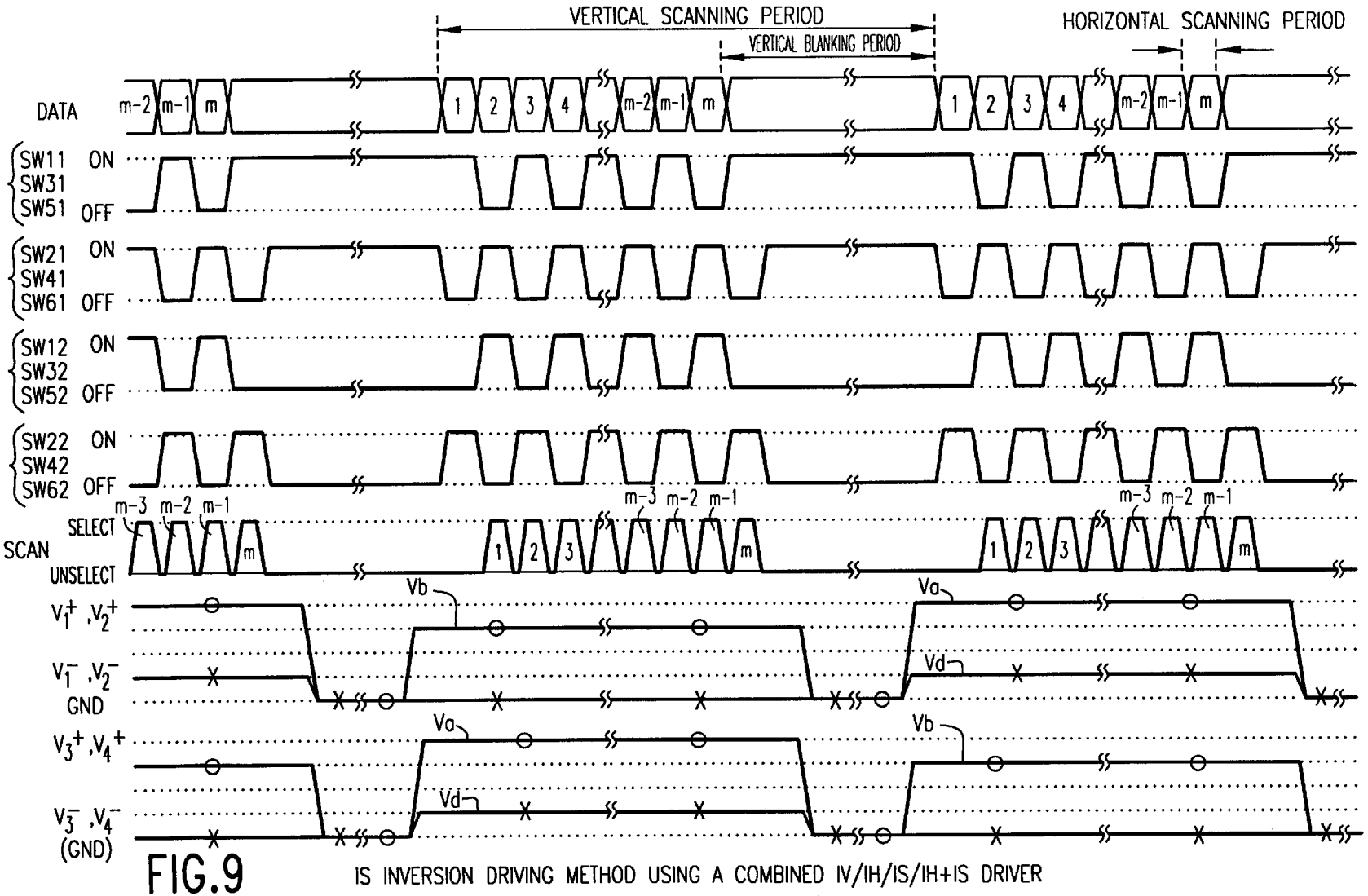
FIG. 9 is a timing chart for 1S inversion driving in Example 1.
Figure 40C:
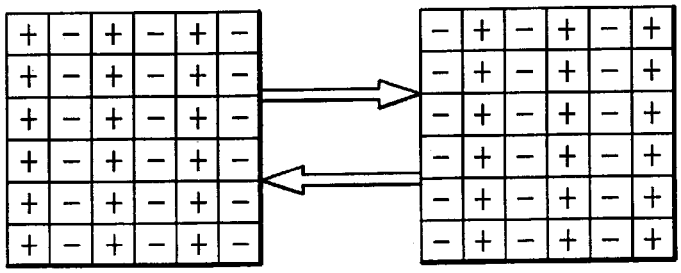

III. 1S Inversion (Signal Line Inversion) Driving 1S inversion driving is a driving method as shown in FIG. 40C discussed previously. Using this driving method, liquid crystal panel flicker and cross-talk in the horizontal direction can be prevented. Additionally, the appearance of horizontal stripes during the display of moving images can also be prevented. This method is particularly effective for remedying the brightness gradient problem caused by parasitic resistance of the interconnect electrodes, and is an appropriate driving method for large liquid crystal panels. FIG. 9 shows the timing chart for achieving 1S inversion driving with the liquid crystal driver of FIG. 1. The differences between 1V inversion driving of FIG. 4 and 1S inversion driving of FIG. 9 are as described below. Namely, the switch on-off sequence is the same in FIGS. 4 and 9, but the control of supply voltages to the analog buffers is different. In FIG. 4, the supply voltages switch after each vertical scanning period, but the same supply voltage is provided to all analog buffers within a single vertical scanning period. In contrast, in FIG. 9, the voltage supplies for $V1^+$ and $V2^+$ are both at level vb, and the voltage supplies for $V1^-$ and $V2^-$ are both at ground level. Further, the voltage supplies of $V3^+$ and $V4^+$ are both at level Va, and the voltage supplies for $V3^-$ and $V4^-$ are both at level Vd. Accordingly, analog buffers 170, 172, 178, and 180 become negative, and analog buffers 174 and 176 become positive. In other words, when considering the analog buffers in pairs which output display signals to a single signal line, both analog buffers have the same polarity, but the analog buffers of the adjacent pair are both of opposite polarity to that of the first pair. As a result, it is possible to invert the polarity of the analog buffers after every signal line. Further, as shown in FIG. 9, since the supply voltages shift after each vertical scanning period, the polarity of all the analog buffers is inverted after each vertical scanning period.

Figure 10:
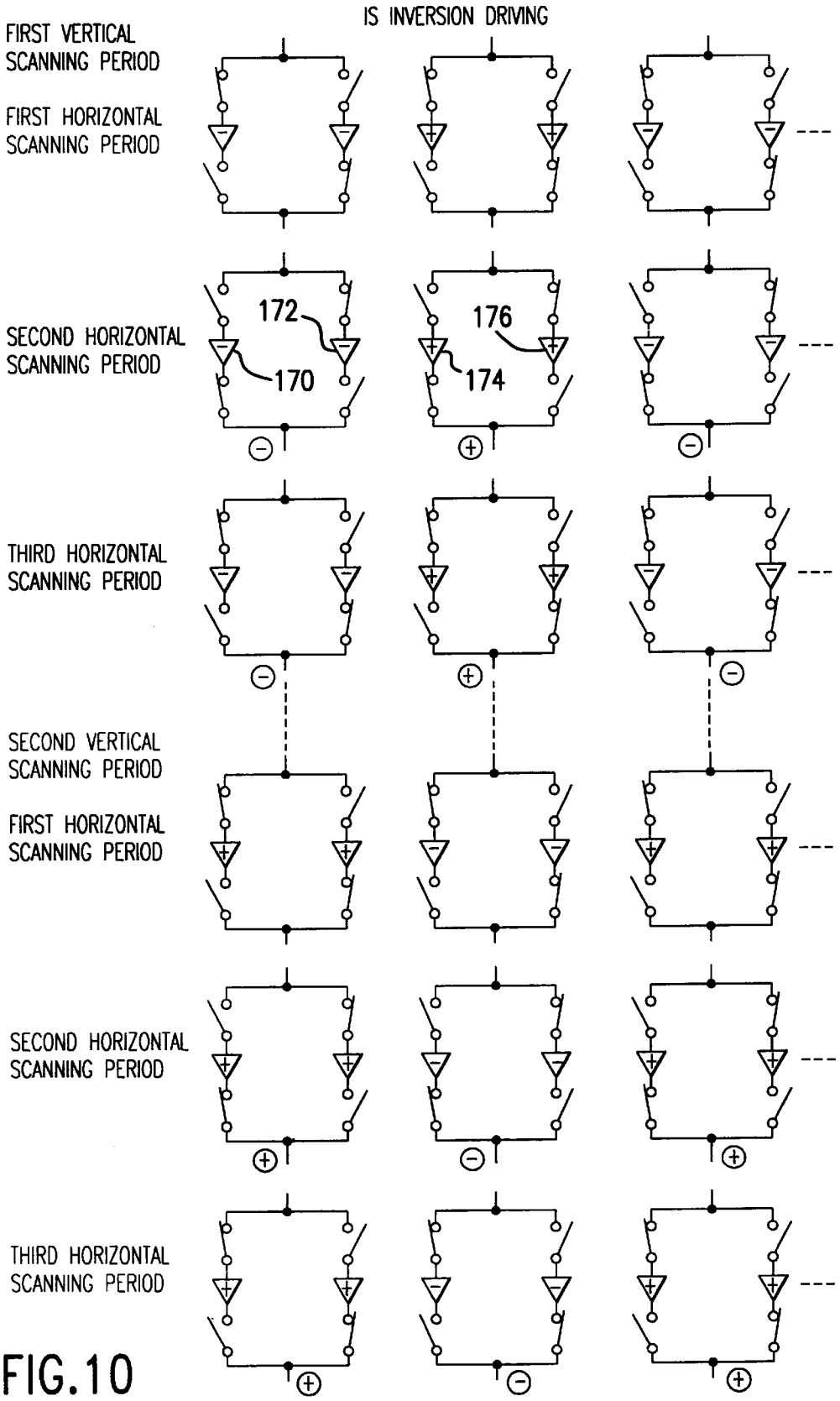
FIG. 10 is used to explain the operation of the liquid crystal driver for 1S inversion driving.

The operation described above is shown schematically in FIG. 10. As FIG. 10 shows, the pair composed of analog buffers 170 and 172 is negative; and the adjacent pair composed of analog buffers 174 and 176 is positive. Consequently, the polarity of the voltage applied to the liquid crystal is reversed after every signal line. Also, the polarity of the analog buffers is reversed between the first vertical scanning period and the second vertical scanning period. In the manner above, is inversion driving can be achieved.

IV. 1H 30 1S inversion (Dot Inversion) Driving

Figure 40D:
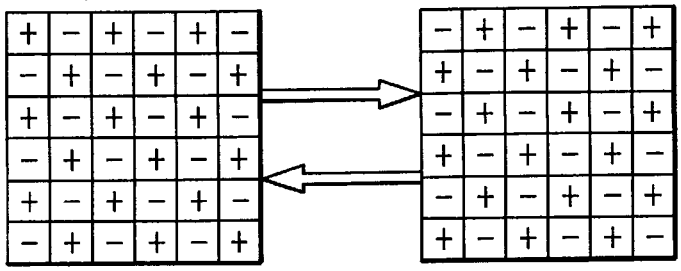

1H+1S inversion driving is a driving method as shown in FIG. 40D discussed previously. Using this driving method, liquid crystal panel flicker and cross-talk in the horizontal and vertical directions can be prevented. Additionally, the brightness gradient problem caused by parasitic resistance of the interconnect electrodes can be solved; and, since there is little current exchange with external circuits, it is possible to decrease the power consumed by the counter voltage generating circuit.

Previously, in order to achieve 1H+1S inversion driving, complicated circuits and complicated control was necessary; but, in the present invention, it can be realized by a simple circuit such as that shown in FIG. 1.

Figure 11:
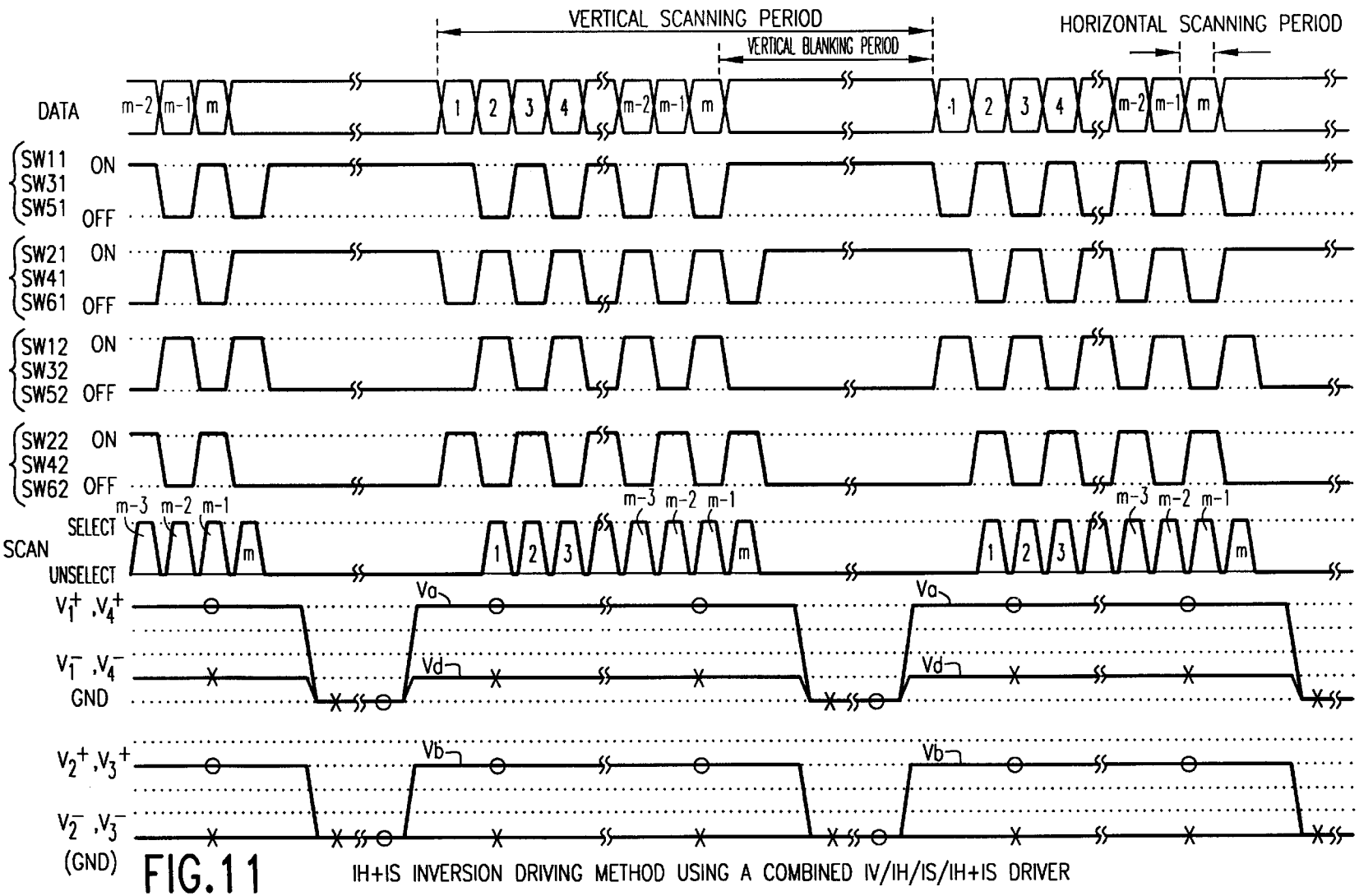
FIG. 11 is a timing chart for 1H+1S inversion driving in Example 1.

FIG. 11 shows the timing chart for achieving 1H+1S inversion driving with the liquid crystal driver of FIG. 1. The differences between 1V inversion driving of FIG. 4 and 1H+1S inversion driving of FIG. 11 are as described below. First, in FIG. 11, the switch on-off sequence changes after each vertical scanning period. For example, in FIG. 11, in contrast to the first vertical scanning period in which switches SW11, SW31, and SW51 are initially on, switches SW11, SW31, and SW51 are initially off during the second vertical scanning period.

Additionally, the control of supply voltages is also different. In contrast to the case for FIG. 1 in which the supply voltages switch after every vertical scanning period, in FIG. 11, $V1^+$ and $V4^+$ are fixed at level Va; $V1^-$ and $V4^-$ are fixed at level Vd; $V2^+$ and $V3^+$ are fixed at level Vb; and $V2^-$ and $V3^-$ are fixed at ground level. As a result, analog buffers 170, 176, and 178 are fixed at positive polarity while analog buffers 172, 174, and 180 are fixed at negative polarity.

Figure 12:
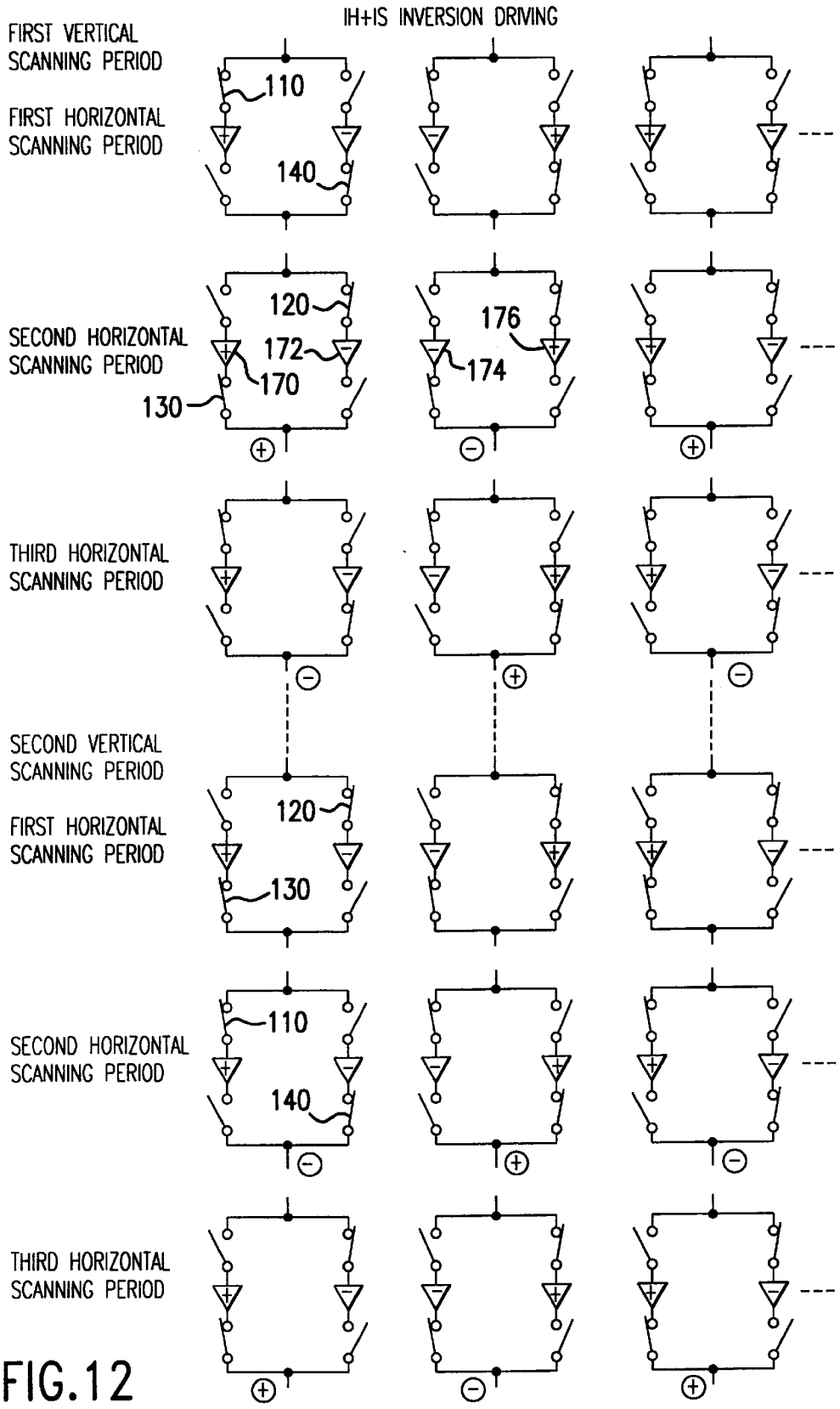
FIG. 12 is used to explain the operation of the liquid crystal driver for 1H+1S inversion driving.

The operation described above is shown schematically in FIG. 12. As FIG. 12 shows, analog buffer 170, which forms half the pair which outputs a display signal to a single signal line, is of positive polarity while the other analog buffer 172 is of negative polarity. The positive and negative polarities are transposed for each signal line. For the next signal line, analog buffer 174 is negative, and analog buffer 176 is positive.

Also, during the first vertical scanning period, the sequence is such that switches 110 and 140 are initially on, and then switches 120 and 130 turn on. In contrast, during the second vertical scanning period, the sequence is such that switches 120 and 130 are initially on, and then switches 110 and 140 turn on. In this fashion, the polarity of the voltage applied to the liquid crystal is reversed from the first vertical scanning period to the second vertical scanning period.

In the manner above, 1H+1S inversion driving can be achieved.

Figure 13:
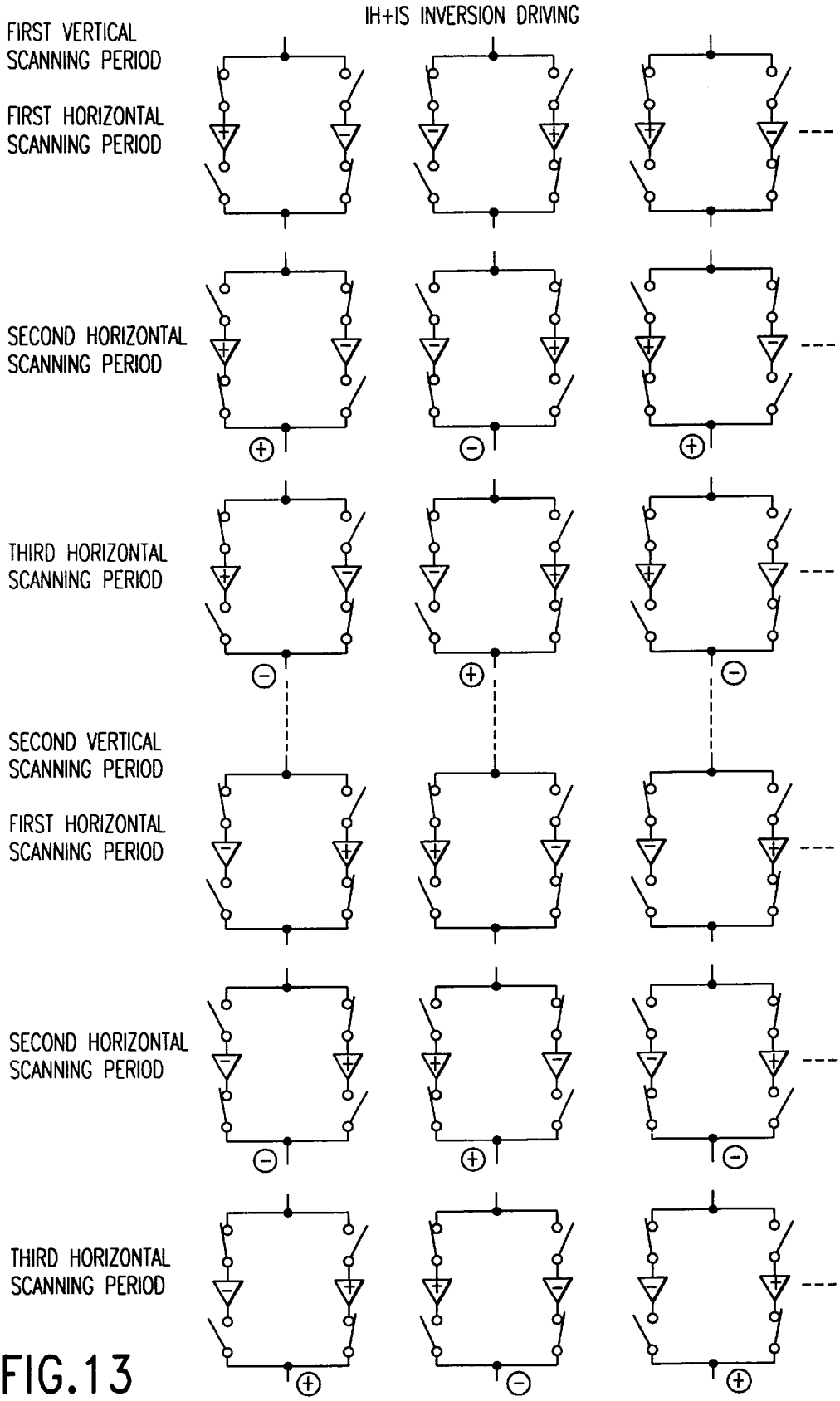
FIG. 13 is used to explain the operation of the liquid crystal driver for 1H+1S inversion driving.

In order to invert the polarity of the voltage applied to the liquid crystal after each vertical scanning period, not only the method of alternating the on-off sequence of switches after each vertical scanning period as shown in FIG. 12, but also the method of changing the polarity of all the analog buffers 170 to 180 after each vertical scanning period as shown in FIG. 13 is acceptable. 1H+1S inversion driving can be achieved through this second method as well.

As described above, by means of the present invention, it is possible to achieve all four types of driving methods with the single circuit configuration shown in FIG. 1. As a result, it is possible to easily cope with design changes; and it is possible to realize a highly conventional optimum liquid crystal driver as a standard device in which the scale of the circuits is not excessively large.

Second Embodiment

Figure 14:
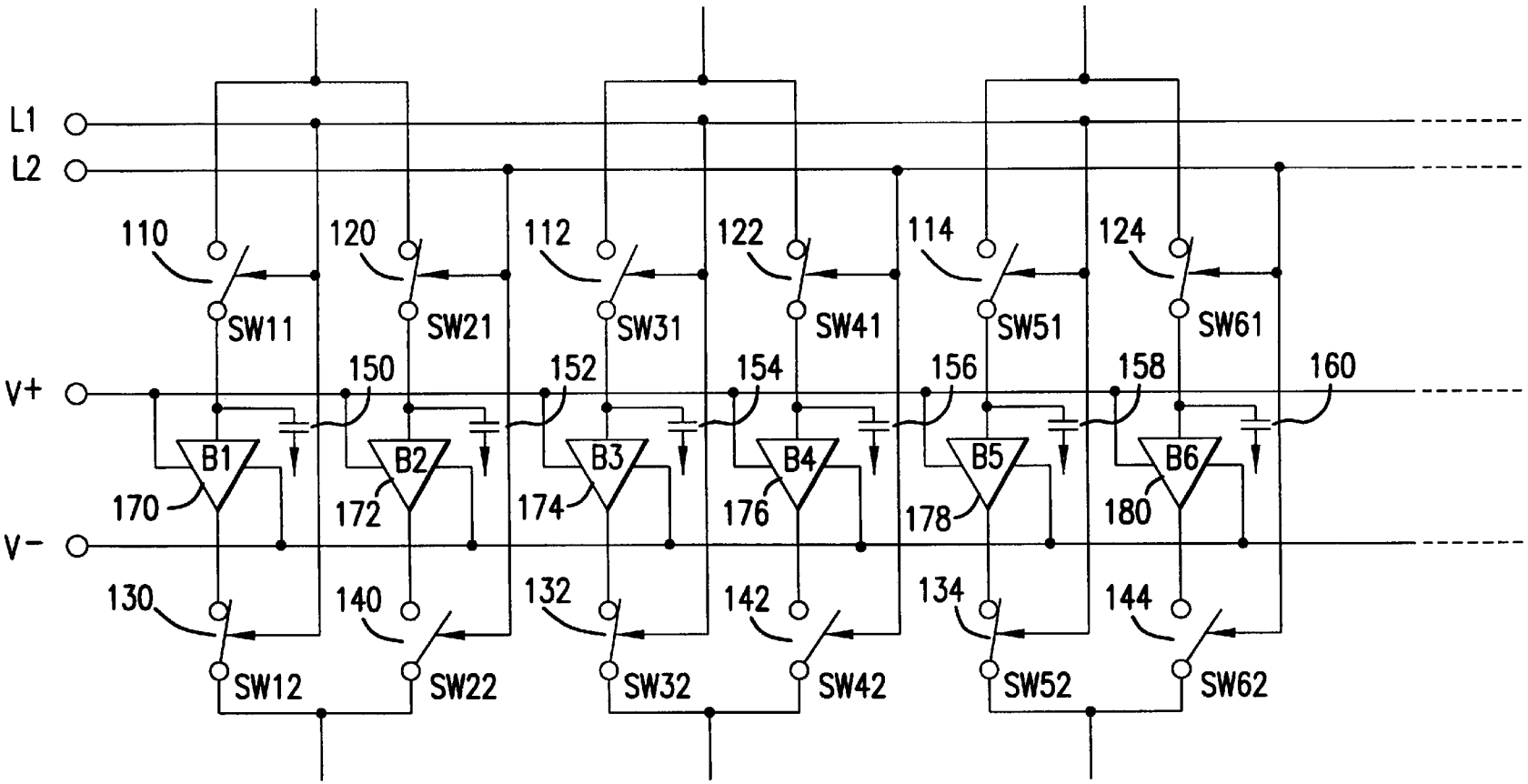
FIG. 14 is an example of the configuration of Example 2 of this invention.

The configuration of a second embodiment of this invention is shown in FIG. 14. The second embodiment relates to a liquid crystal driver for dedicated 1V driving. In this embodiment and those which follow, the shift register, level shifter, and sampling switches are omitted from the explanations. As in the first embodiment, there are two switch control lines in the second embodiment. Switching control is achieved through switch control line L1 for the first and third switches including 110, 130, 112, 132, 114, and 134 while switching control is achieved through switch control line L2 for the second and fourth switches including 120, 140, 122, 142, 124, and 144. Although there was a four-channel supply in the first embodiment, in this second embodiment there are only $V^+$ and $V^-$ supply lines forming a single channel system. In other words, all analog buffers 170 to 180 are connected to common supply lines; and the supply voltages applied to the common supply lines are controlled by supply voltage controller 202 (see FIG. 30).

Figure 15:
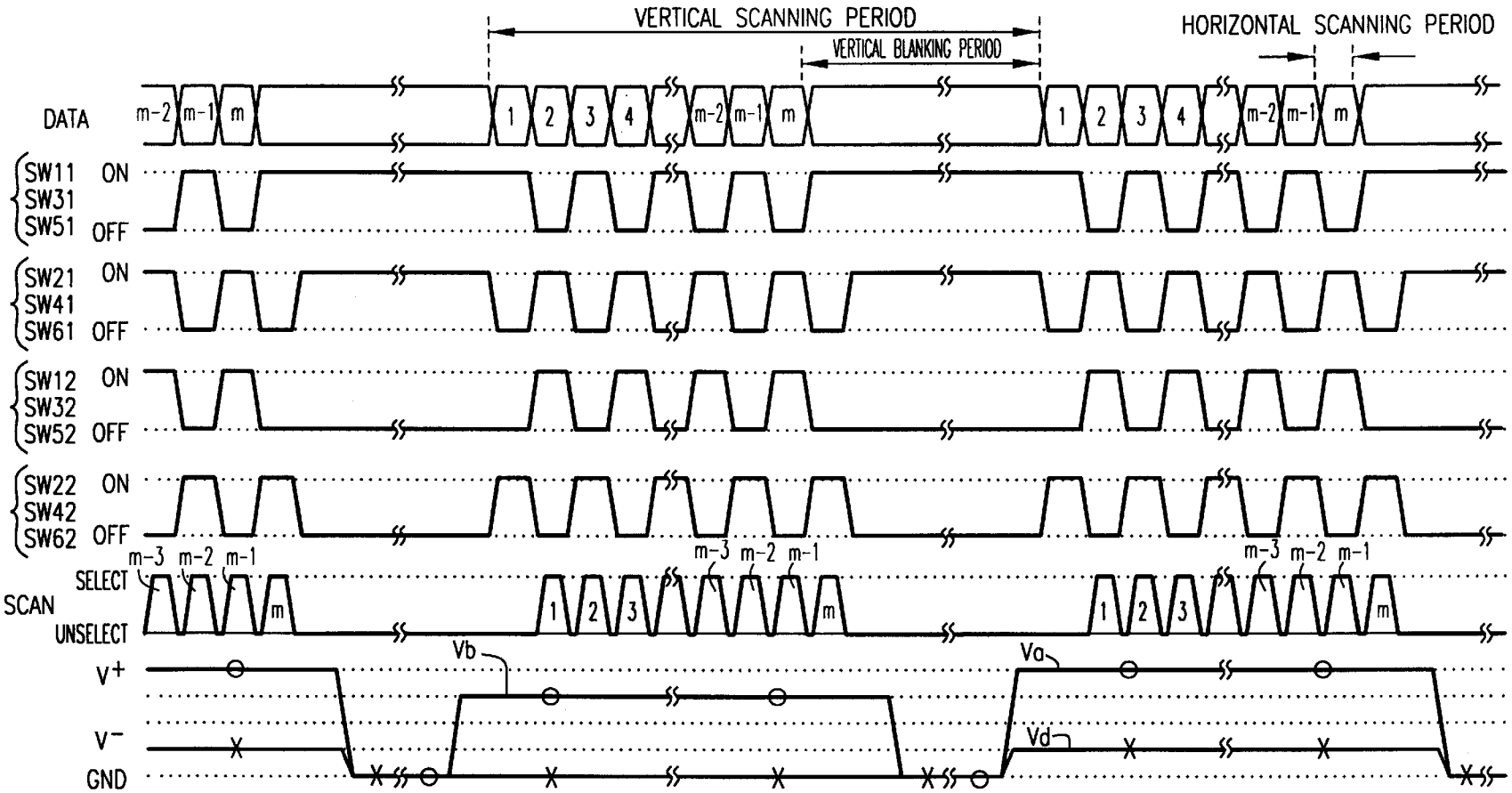
FIG. 15 is a timing chart for 1V inversion driving in Example 2.

FIG. 15 shows the timing chart for achieving 1V inversion driving with the liquid crystal driver of FIG. 14. The second embodiment operates similarly to the operations explained in FIGS. 4 and 5. That is, 1V inversion driving can be achieved in the second embodiment if the supply voltage simply changes after each vertical scanning period such that the polarity of analog buffers 170 to 180 reverses after each vertical scanning period.

Although, in contrast to the first embodiment, only 1V inversion driving is possible in the second embodiment, the number of supply lines can be decreased; the supply voltage control is simple; and the scale of the circuit can be decreased.

Third Embodiment

Figure 16:
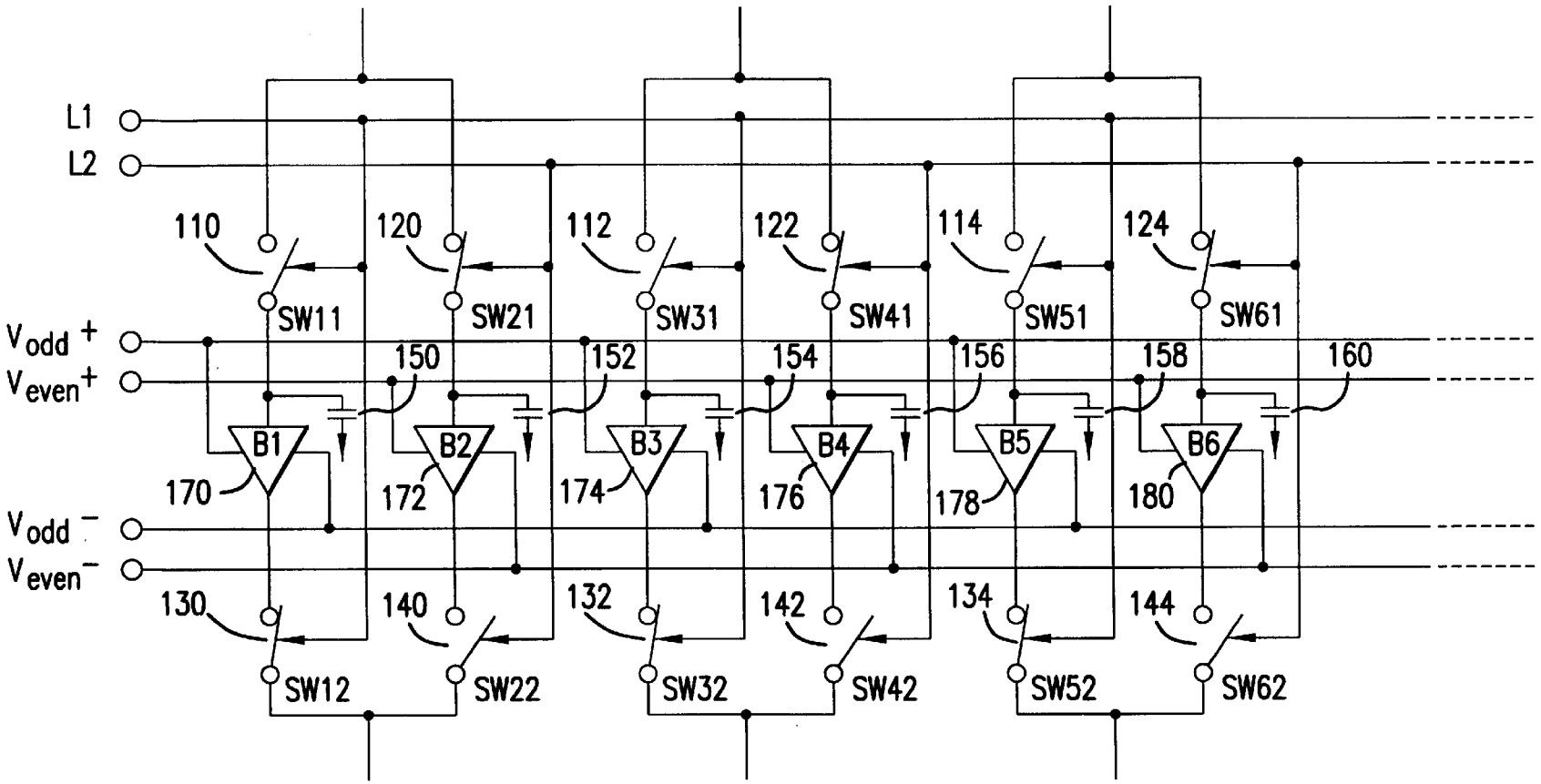
FIG. 16 is an example of the configuration of Example 3 of this invention.

The configuration of a third embodiment of this invention is shown in FIG. 16. The third embodiment relates to a liquid crystal driver for dedicated 1H driving. As in the first embodiment, there are two switch control lines in the third embodiment. Although there was a four-channel supply in the first embodiment, in this third embodiment there are $Vodd^+$, $Vodd^-$, $Veven^+$, and $Veven^-$ supply lines forming a two-channel system. The first analog buffers 170, 174, and 178 receive supply voltages from the first supply lines $Vodd^+$ and $Vodd^-$ whereas the second analog buffers 172, 176, and 180 receive supply voltages from the second supply lines $Veven^+$ and $Veven^-$. As a result, analog buffers 170, 174 and 178 can be made to differ in polarity from analog buffers 172, 176, and 180.

Figure 17:
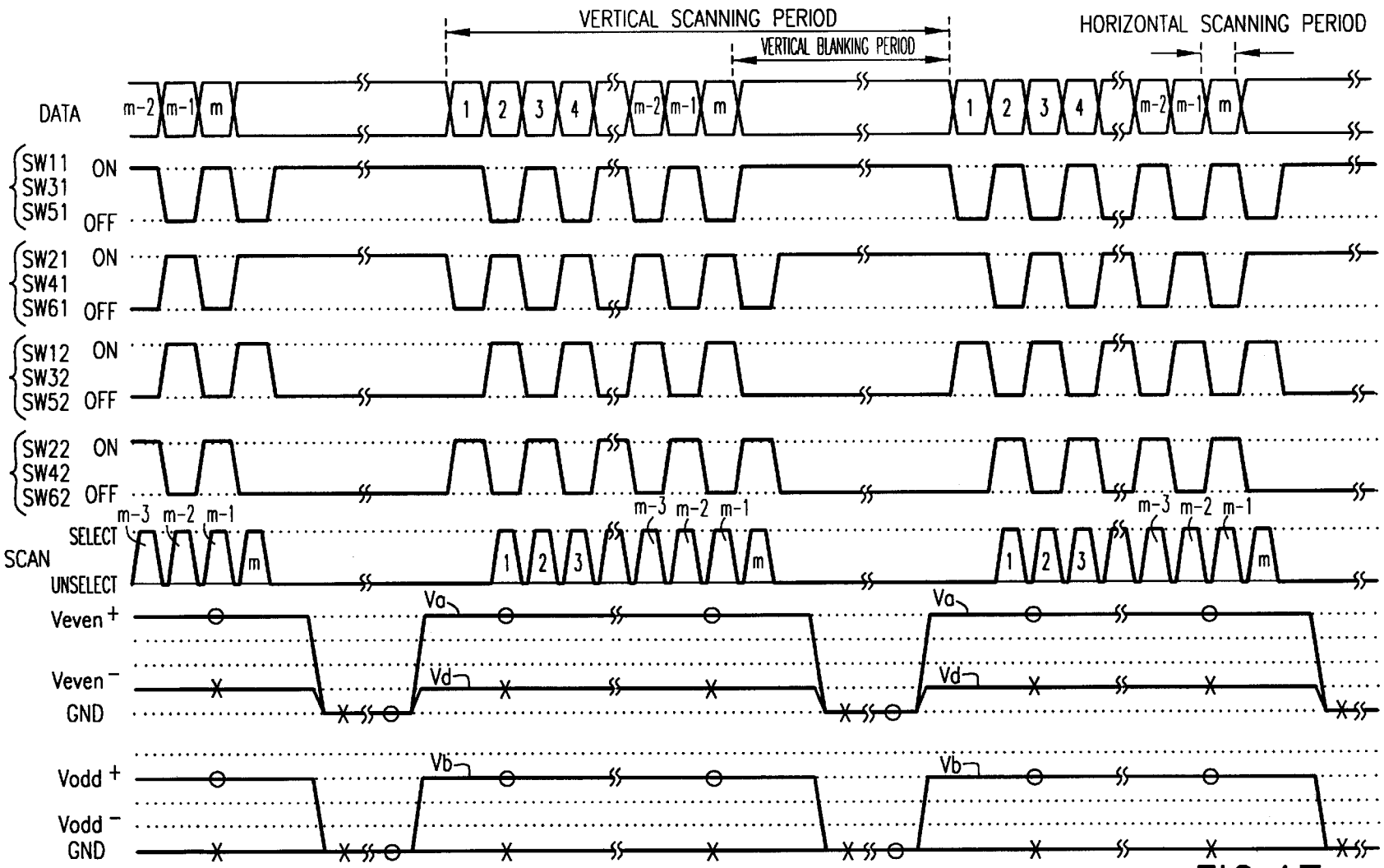
FIG. 17 is a timing chart for 1H inversion driving in Example 3.

FIG. 17 shows the timing chart for achieving 1H inversion driving with the liquid crystal driver of FIG. 16. The third embodiment operates similarly to the operations explained in FIGS. 6 and 7. In other words, in this third embodiment, by preparing a two channel supply voltage, the two analog buffers which form a pair which outputs a display signal to a single signal line can be made to be of different polarity. Further, the switch on-off sequence changes after each vertical scanning period. As a result of these mechanisms, 1H inversion driving can be realized. In comparison to the first embodiment, the number of supply lines can be decreased; the supply voltage control is simple; and the scale of the circuit can be decreased in the third embodiment. Further, using 1H inversion driving, it is possible to produce high-quality liquid crystal displays.

Fourth Embodiment

Figure 18:
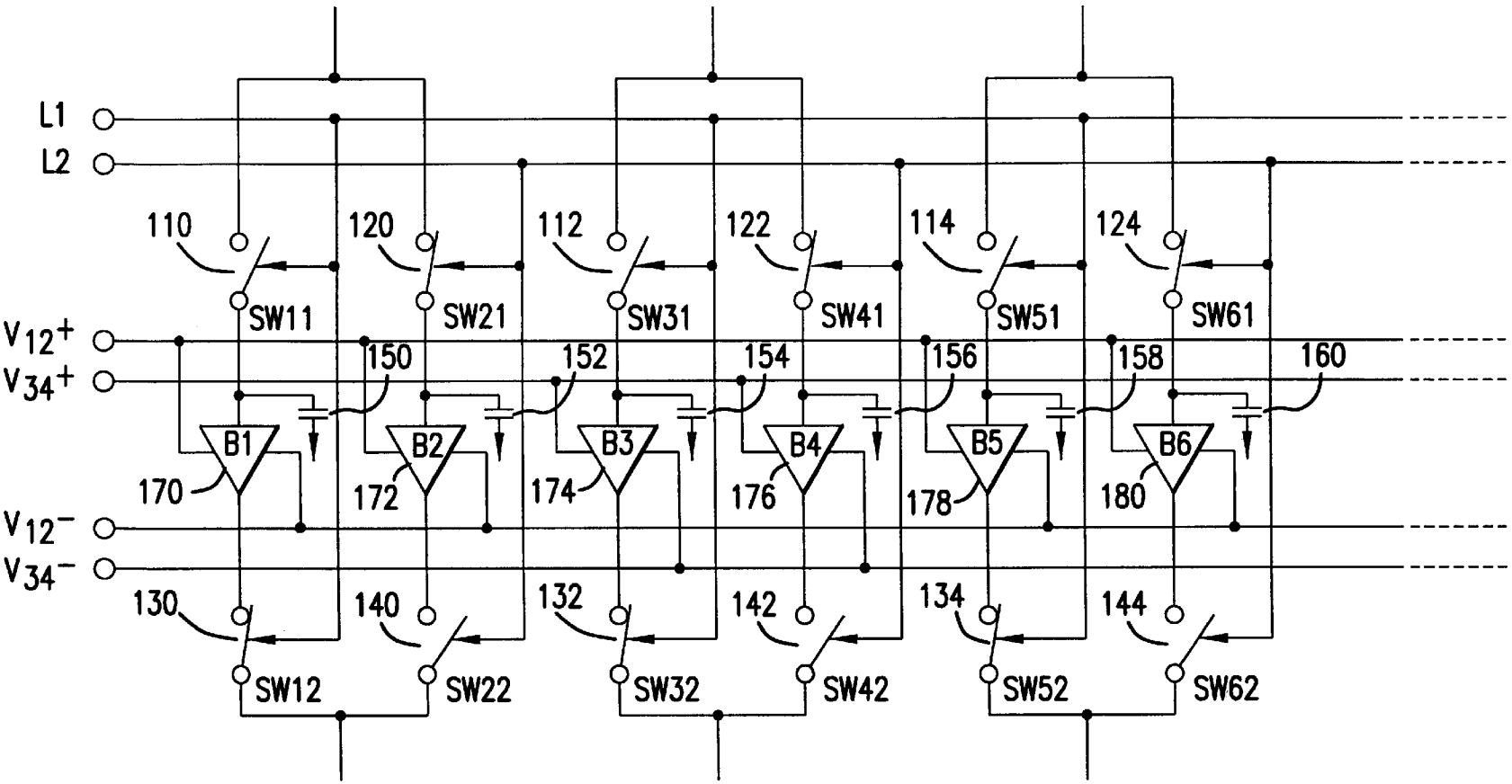
FIG. 18 is an example of the configuration of Example 4 of this invention.

The configuration of a fourth embodiment of this invention is shown in FIG. 18. The fourth embodiment relates to a liquid crystal driver for dedicated 1S driving. As in the first embodiment, there are two switch control lines in the fourth embodiment. Although there was a four-channel supply in the first embodiment, in this fourth embodiment there are $V12^+$, $V12^-$, $V34^+$, and $V34^-$ supply lines forming a two-channel system. The first and second analog buffers 170, 172, 178 and 180 included in the odd-numbered signal driving means receive supply voltages from the first supply lines $V12^+$ and $V12^-$ whereas the first and second analog buffers 174 and 176 included in the even-numbered signal driving means receive supply voltages from the second supply lines $V34^+$ and $V34^-$. As a result, analog buffers 170 and 172 as well as 178 and 180 can be made to differ in polarity from analog buffers 174 and 176.

Figure 19:
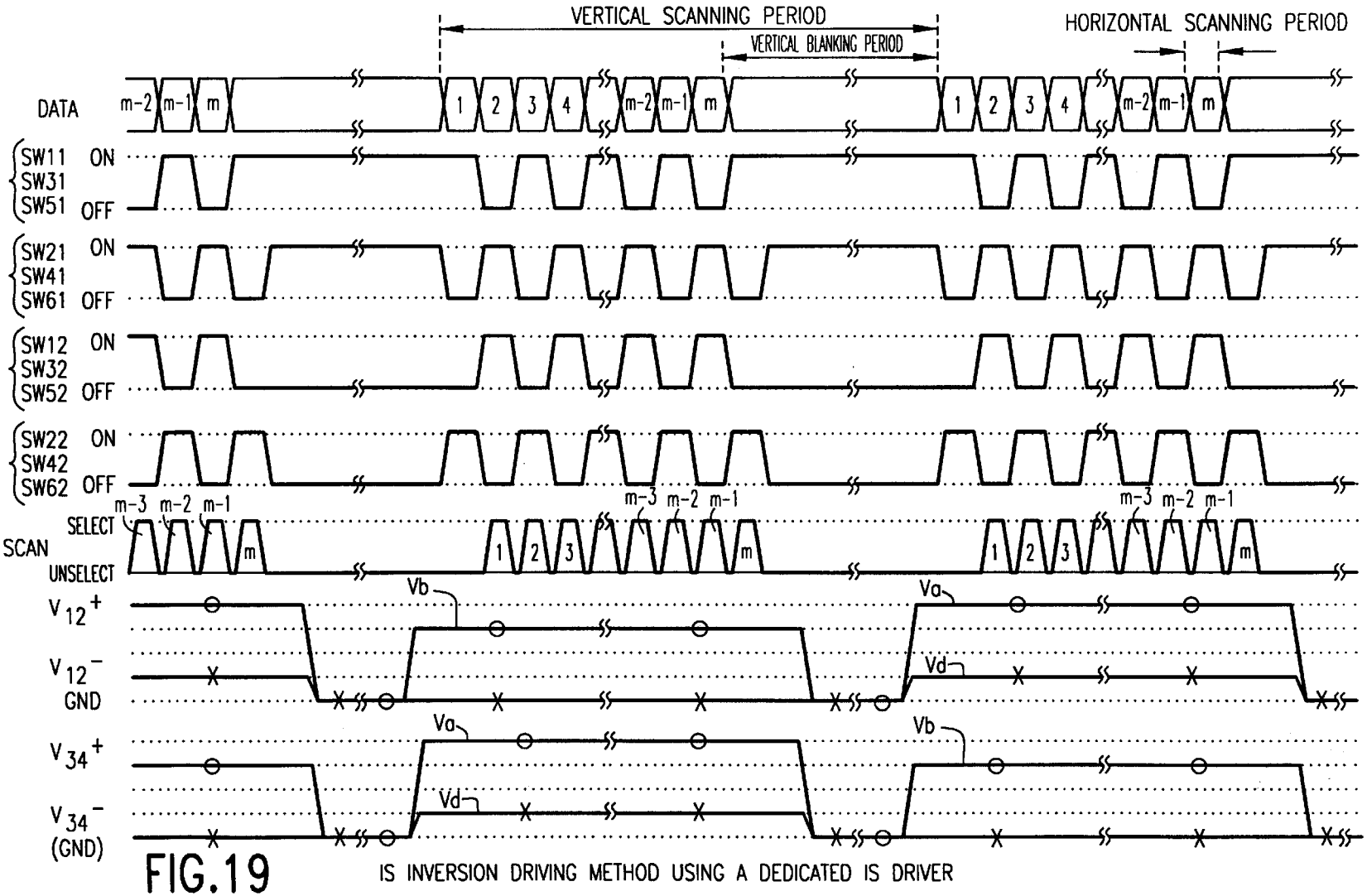
FIG. 19 is a timing chart for 1S inversion driving in Example 4.

FIG. 19 shows the timing chart for achieving 1S inversion driving with the liquid crystal driver of FIG. 18. The fourth embodiment operates similarly to the operations explained in FIGS. 9 and 10. In other words, in this fourth embodiment, first, by preparing a two-channel supply voltage, when considering the analog buffers in pairs which output display signals to a single signal line, both analog buffers in a pair have the same polarity; but the analog buffers of the adjacent pair are both of opposite polarity to that of the first pair. Additionally, the supply voltages are shifted after each vertical scanning period, and the polarities of all the analog buffers are reversed after every vertical scanning period. As a result, 1S inversion scanning can be realized. In comparison to the first embodiment, the number of supply lines can be decreased; the supply voltage control is simple; and the scale of the circuit can be decreased in the fourth embodiment. Further, using 1S inversion driving, it is possible to produce high-quality liquid crystal displays.

Fifth Embodiment

Figure 20:
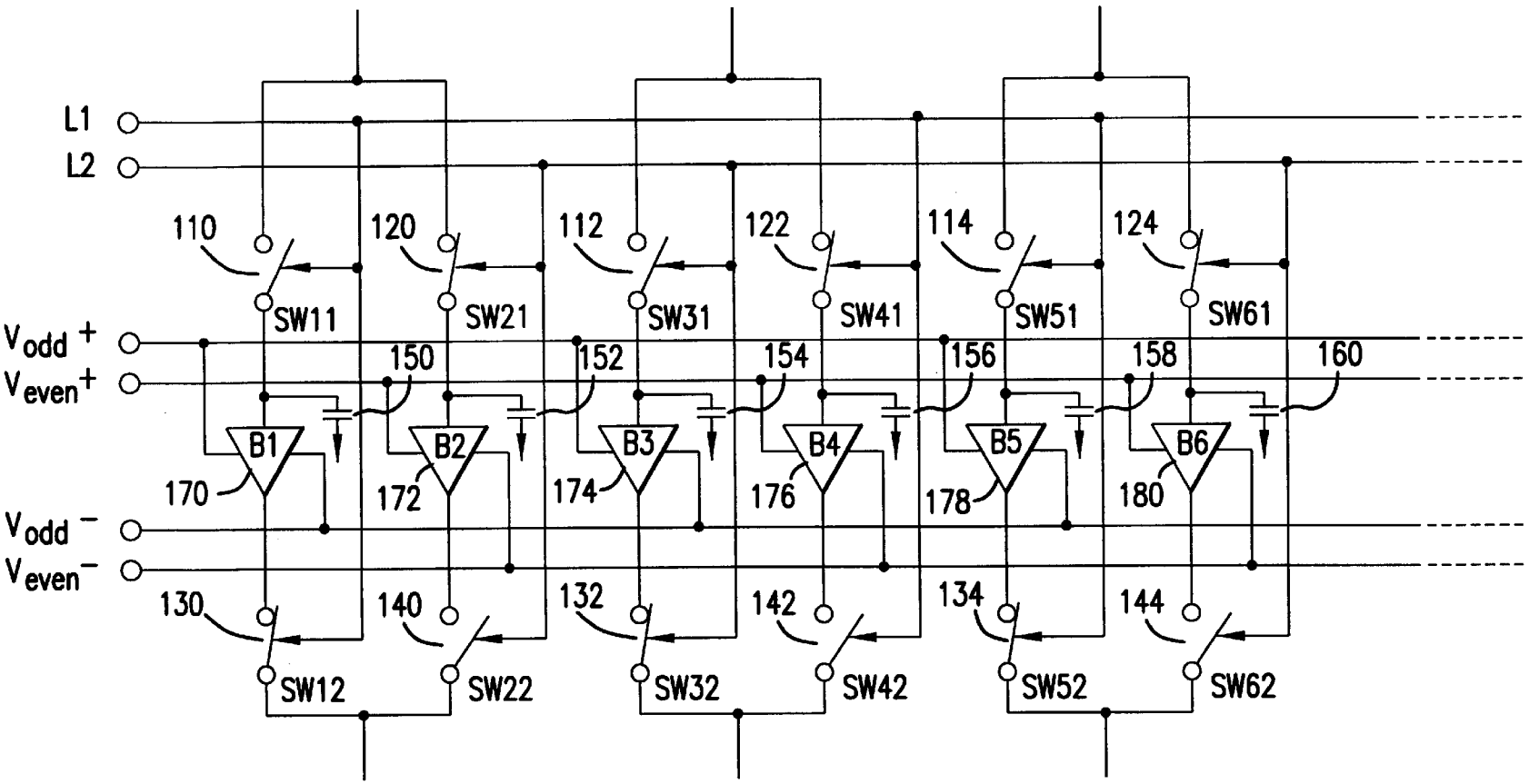
FIG. 20 is an example of the configuration of Example 5 of this invention.

The configuration of a fifth embodiment of this invention is shown in FIG. 20. The fifth embodiment relates to a liquid crystal driver for dedicated 1H+1S driving. As in the first embodiment, there are two switch control lines in the fifth embodiment although the means of connection are different from the first embodiment. The switching control of the first and third switches 110, 130, 114, and 134 included in the odd-numbered signal driving means as well as the switching control of the second and fourth switches 122 and 142 included in the even-numbered signal driving means are controlled by the first switch control line L1. The switching control of the first and third switches 112 and 132 included in the even-numbered signal driving means as well as the switching control of the second and fourth switches 120, 140, 124, and 144 included in the odd-numbered signal driving means is controlled by the second switch control line L2. Although there was a four-channel supply in the first embodiment, in this fifth embodiment there are $Vodd^+$, $Vodd^-$, $Veven^+$, and $Veven^-$ supply lines forming a two-channel system. The first analog buffers 170, 174, and 178 receive supply voltages from the first supply lines $Vodd^+$ and $Vodd^-$ whereas the second analog buffers 172, 176, and 180 receive supply voltages from the second supply lines $Veven^+$ and $Veven^-$. As a result, analog buffers 170, 174, and 178 can be made to differ in polarity from analog buffers 172, 176, and 180.

Figure 21:
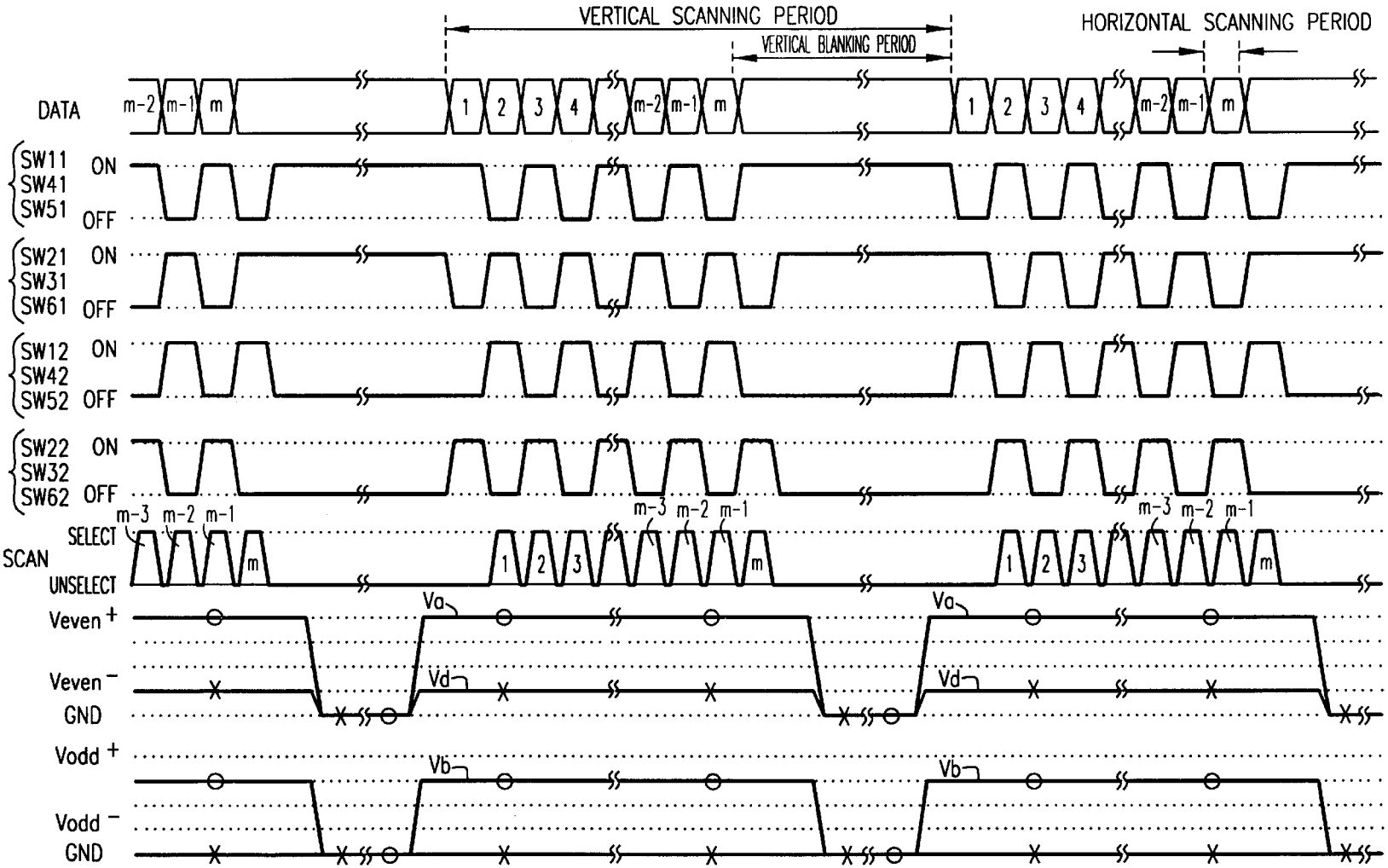
FIG. 21 is a timing chart for 1H+1S inversion driving in Example 5.
Figure 22:
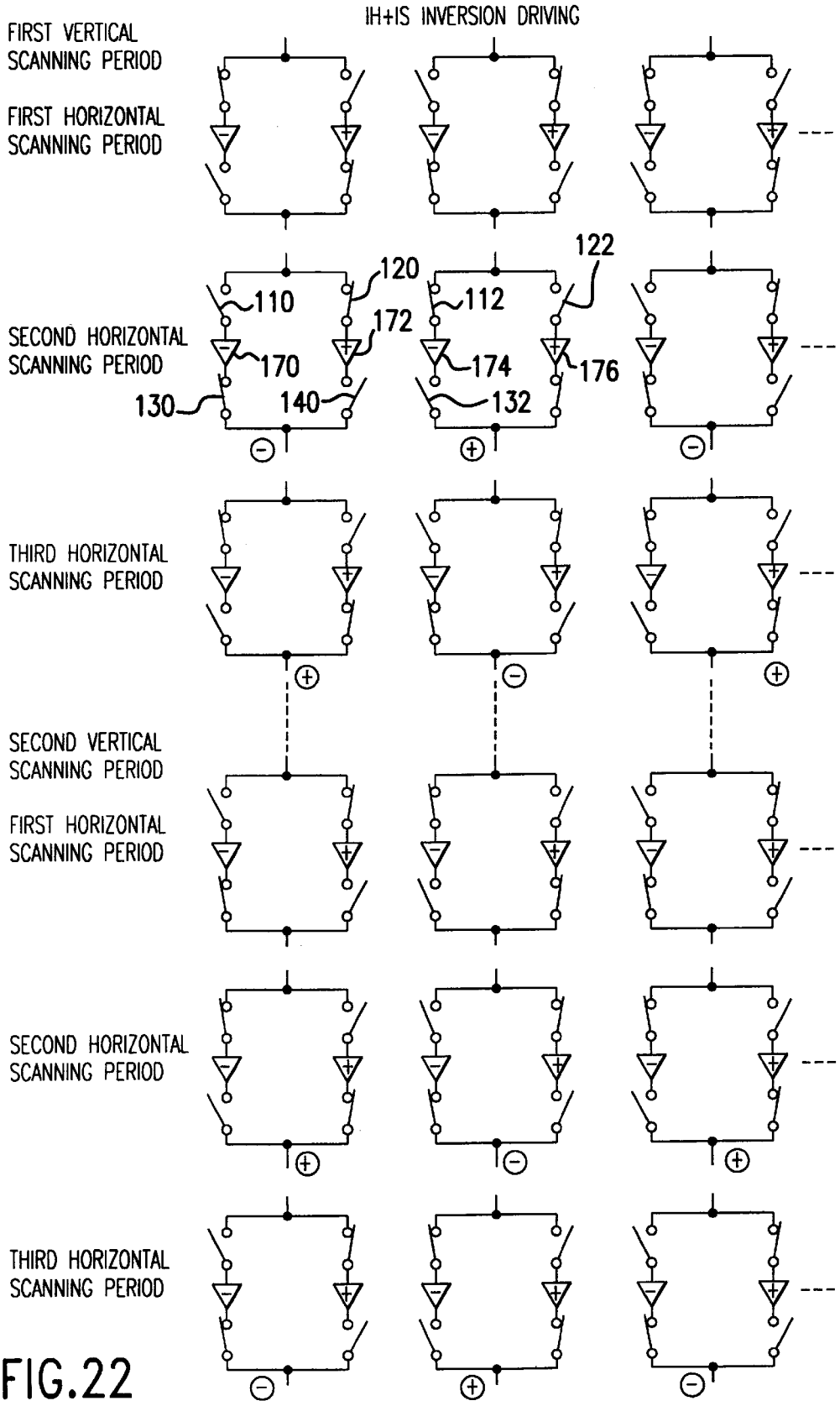
FIG. 22 is used to explain the operation of the liquid crystal driver for 1H+1S inversion driving.

FIG. 21 shows the timing chart for achieving 1H+1S inversion driving with the liquid crystal driver of FIG. 20. In addition, FIG. 22 schematically shows the operation of this embodiment. First, in this fifth embodiment, by preparing a two channel supply voltage, the two analog buffers which form a pair which outputs a display signal to a single signal line can be made to be of different polarity. For example, the polarities in pair 170 and 172 and pair 174 and 176 are different. And, grouping the four switches corresponding to a single signal line into one group, the switch on-off sequence can be made to differ for the neighboring group of switches. For example, the switch on-off sequence for switches 110, 120, 130, and 140 is different from that of switches 112, 122, 132, and 142. Additionally, the switch on-off sequence changes after each vertical scanning period. As a result, 1H+1S inversion scanning can be realized.

Figure 23:
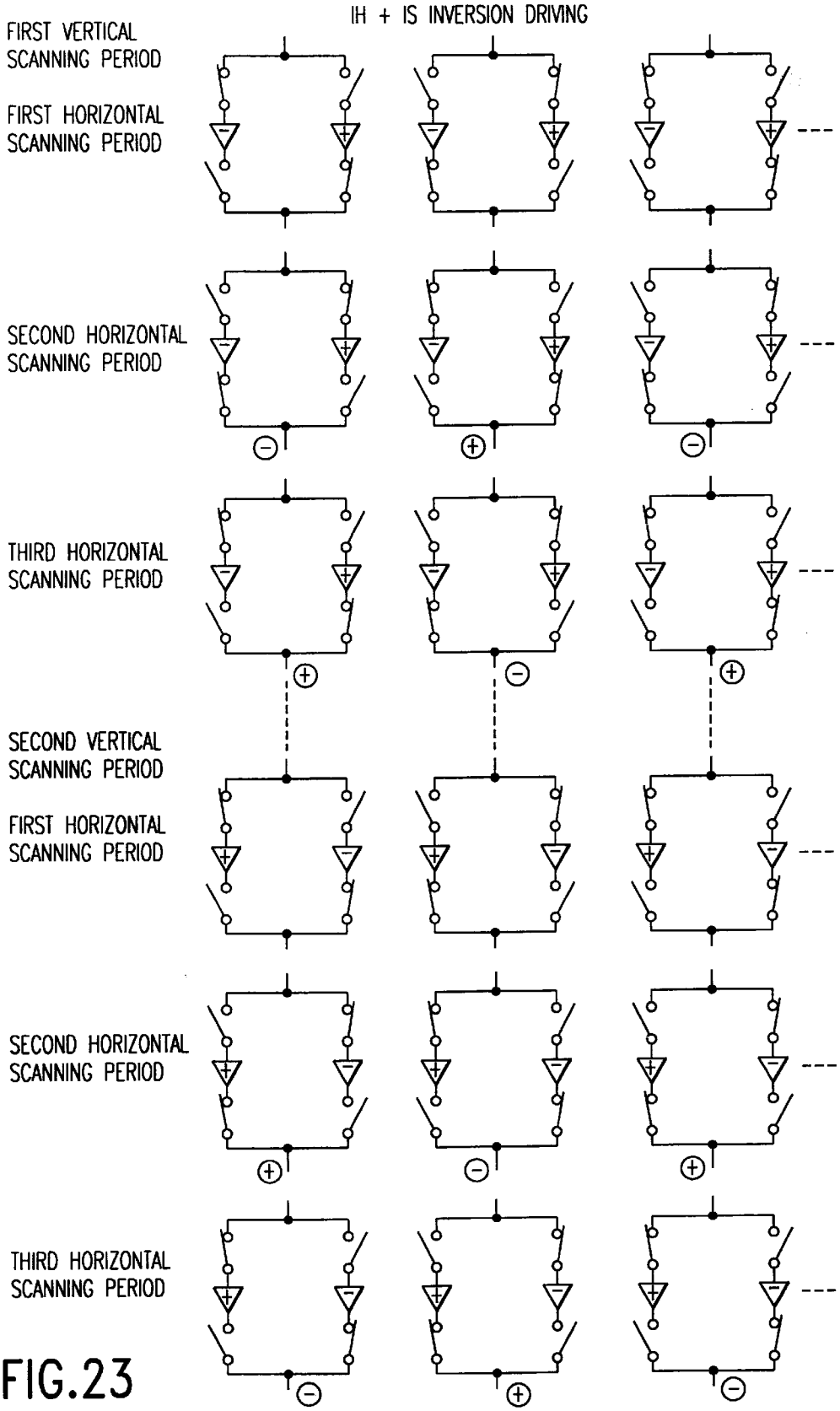
FIG. 23 is used to explain the operation of the liquid crystal driver for 1H+1S inversion driving.

In order to invert the polarity of the voltage applied to the liquid crystal after each vertical scanning period, not only the method of alternating the on-off sequence of switches after each vertical scanning period as shown in FIG. 22, but also the method of changing the polarity of all the analog buffers after each vertical scanning period as shown in FIG. 23 is acceptable. 1H+1S inversion driving can be achieved through this second method as well.

In comparison to the first embodiment, the number of supply lines can be decreased; the switch and supply line control is simple; and the scale of the circuit can be decreased in the fifth embodiment. Further, using 1H+1S inversion driving, it is possible to produce high-quality liquid crystal displays.

Sixth Embodiment

Figure 24:
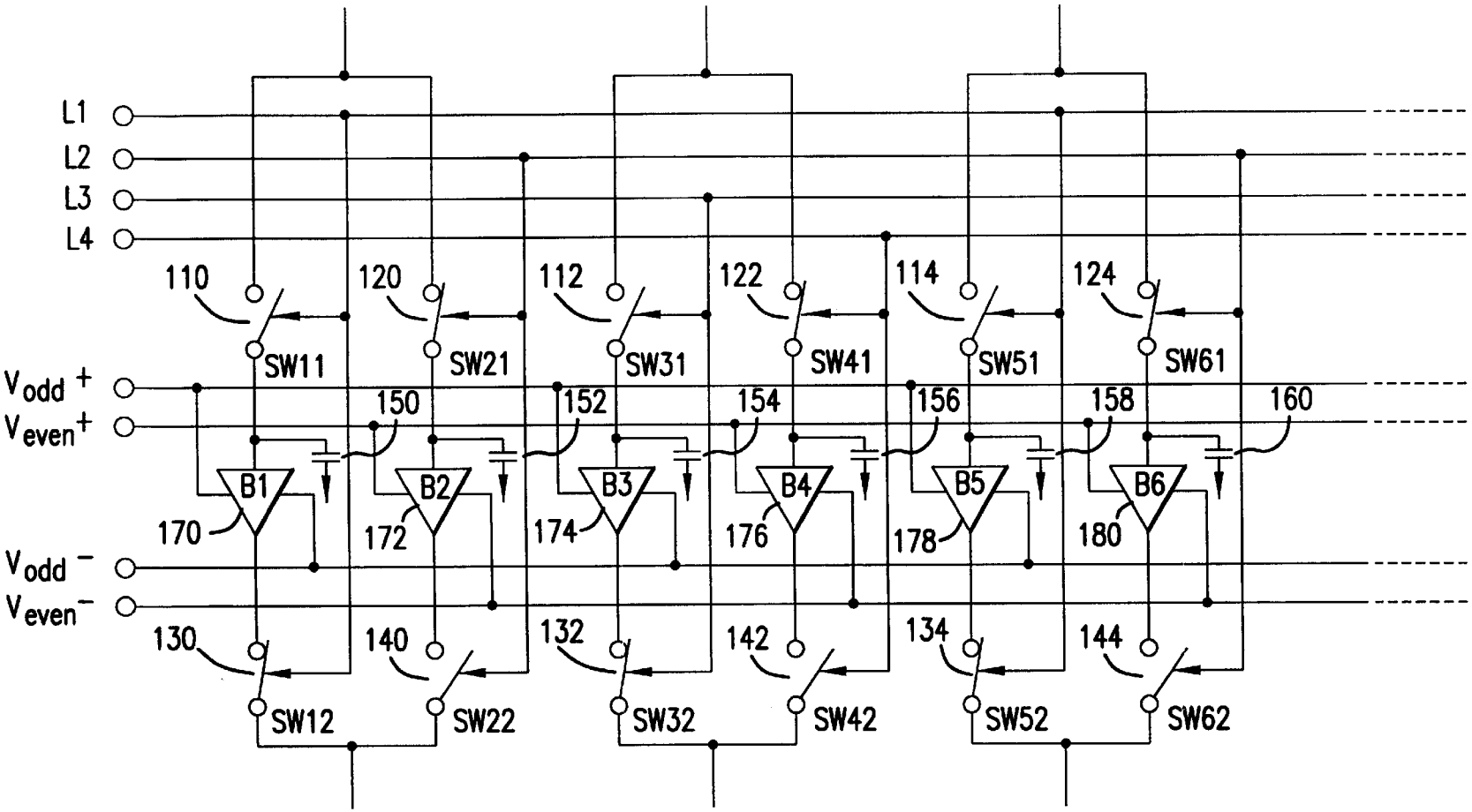
FIG. 24 is an example of the configuration of Example 6 of this invention.

The configuration of a sixth embodiment of this invention is shown in FIG. 24. The sixth embodiment relates to a liquid crystal driver for combined 1H/1H+1S driving. In contrast to the first embodiment, there are four switch control lines in the sixth embodiment. Switching control of the first and third switches 110, 130, 114, and 134 included in the odd-numbered signal driving means is achieved through the first switch control line L1; and switching control of the second and fourth switches 120, 140, and 124 included in the odd-numbered signal driving means is achieved through the second switch control line L2. Switching control of the first and third switches 112 and 132 included in the even-numbered signal driving means is achieved through the third switch control line L3; and switching control of the second and fourth switches 122 and 142 included in the even-numbered signal driving means is achieved through the fourth switch control line L4. Consequently, it is possible to change the switch on-off sequence after each vertical scanning period. When the four switches corresponding to a single signal line are grouped together, it is also possible to make the switch on-off sequences for neighboring groups of switches different. Although a four-channel supply voltage was used in the first embodiment, the sixth embodiment has two channels including supply lines $Vodd^+$, $Vodd^-$ and $Veven^+$, $Veven^-$, respectively. Supply voltages are provided to the first analog buffers 170, 174, and 178 by means of the first supply lines $Vodd^+$ and $Vodd^-$ while supply voltages are provided to the second analog buffers 172, 176, and 180 by means of the second supply lines $Veven^+$ and $Veven^-$. Consequently, it is possible for analog buffers 170, 174, and 178 to be of different polarity than analog buffers 172, 176, and 180.

Figure 25:
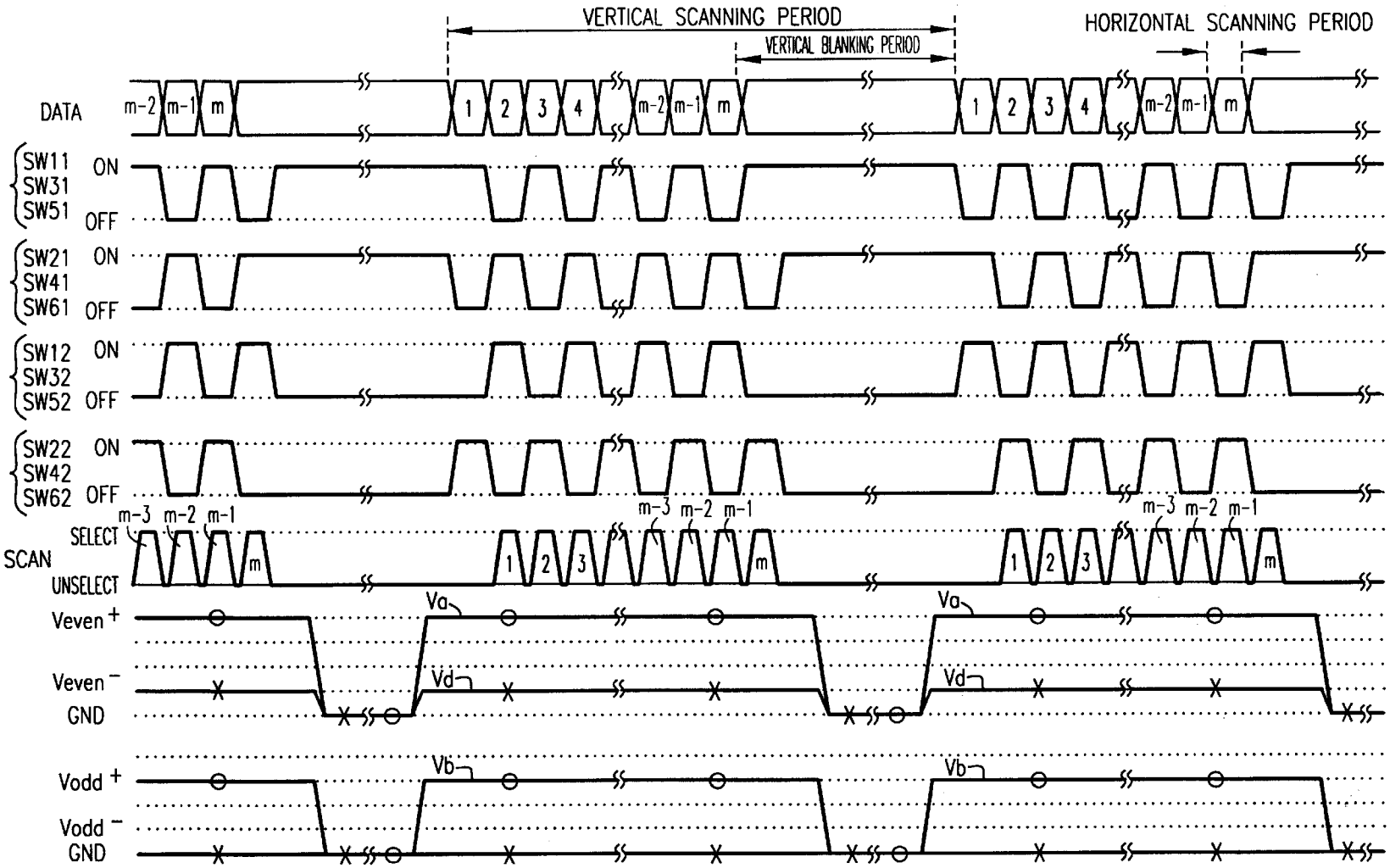
FIG. 25 is a timing chart for 1H inversion driving in Example 6.
Figure 26:
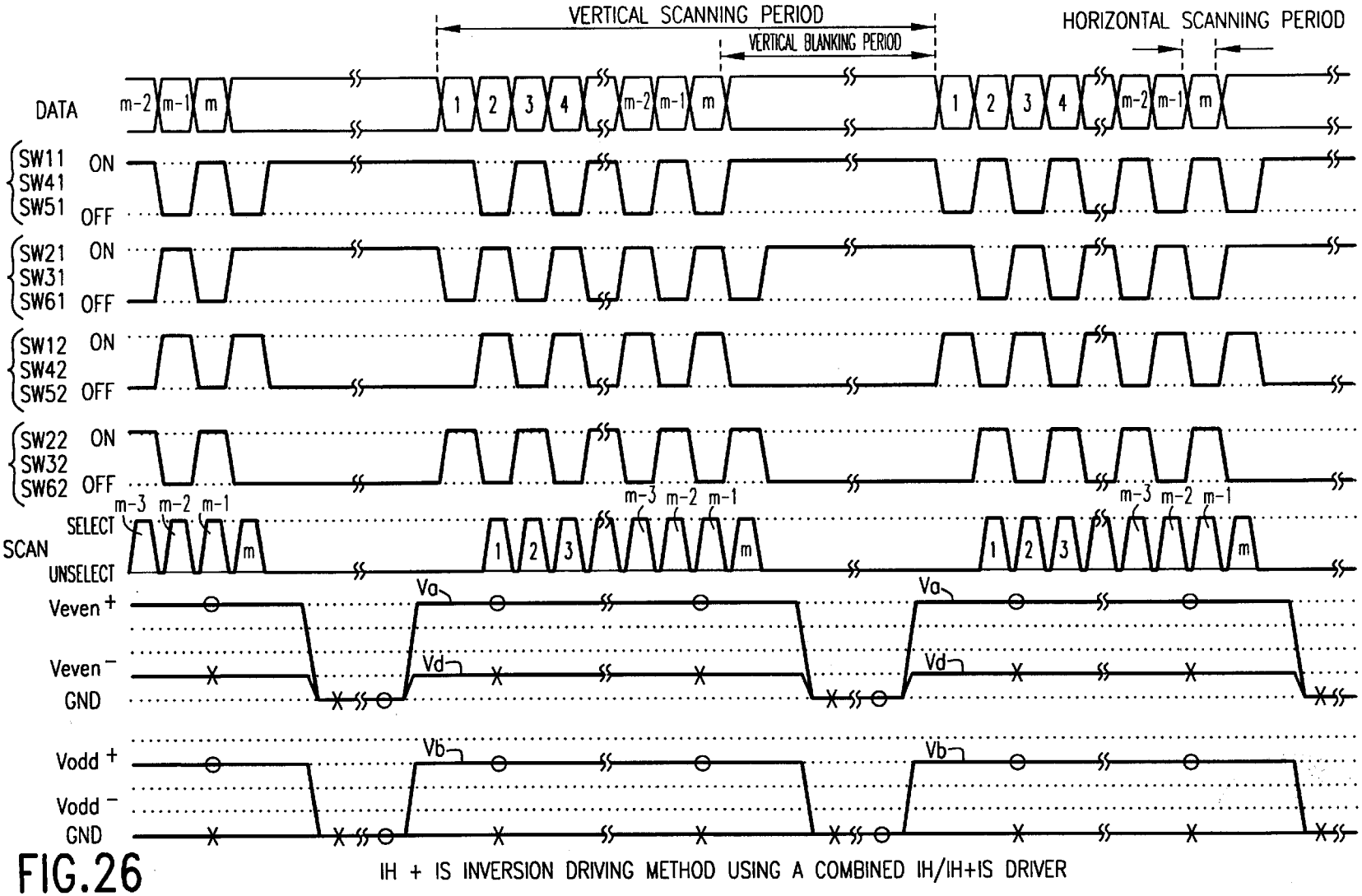
FIG. 26 is a timing chart for 1H+1S inversion driving in Example 6.

FIG. 25 shows the timing chart for achieving 1H inversion driving with the liquid crystal driver of FIG. 24. Since the timing chart in FIG. 25 is identical to the timing chart in FIG. 17 described previously, a description of the operating method will be omitted. Further, FIG. 26 shows the timing chart for achieving 1H+1S inversion driving with the liquid crystal driver of FIG. 24. Since the timing chart in FIG. 26 is identical to the timing chart in FIG. 21 described previously, a description of the operating method will be omitted.

Figure 28:
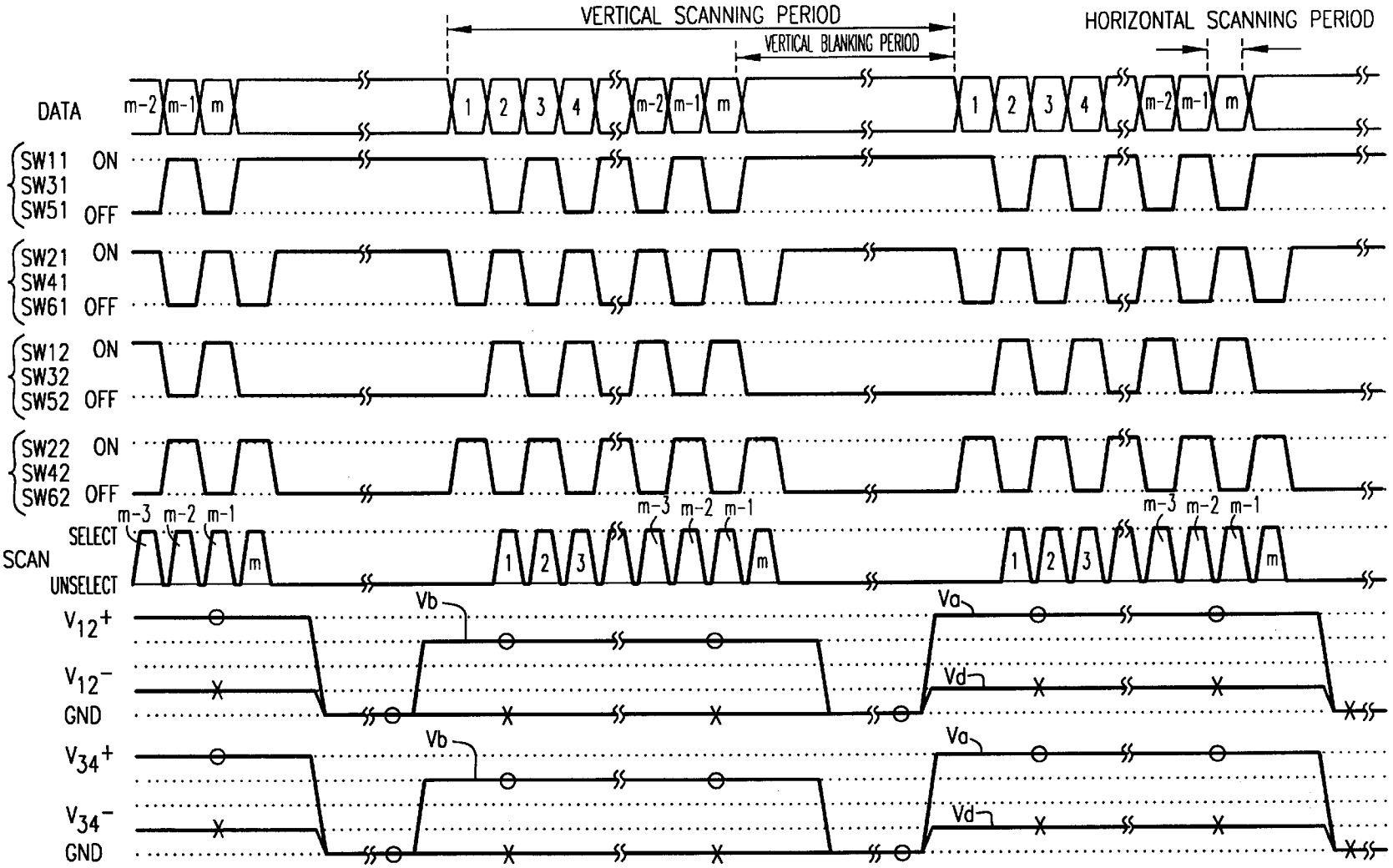
FIG. 28 is a timing chart for 1V inversion driving in a combined 1V/1S driver.

In embodiments 1 through 6 described above, explanations about the configurations of drivers for combined 1V/1H/1S/1H+1S driving, dedicated 1V driving, dedicated 1H driving, dedicated 1S driving, dedicated 1H+1S driving, and combined 1H/1H+1S driving have been presented. Liquid crystal drivers aside from these can also be achieved using the various configurations presented in embodiments 1 through 6. For example, as shown in FIG. 27, a driver for combined 1V/1S driving (#6) has the same configuration as that shown in FIG. 18 (#3). FIG. 28 shows the timing chart for achieving 1V inversion driving using a combined 1V/1S driver (which has the same configuration as a dedicated 1V driver). As shown in FIG. 28, 1V inversion driving can be achieved by simply providing the same supply voltages to all the analog buffers, shifting the supply voltages after each vertical scanning period, and reversing the polarity of the analog buffers. Similarly, a combined 1V/1H driver (#5) has the same configuration as that shown in FIG. 16 (#2); and a combined 1V/1H+1S driver (#7) has the same configuration as that shown in FIG. 20 (#2).

Figure 29:
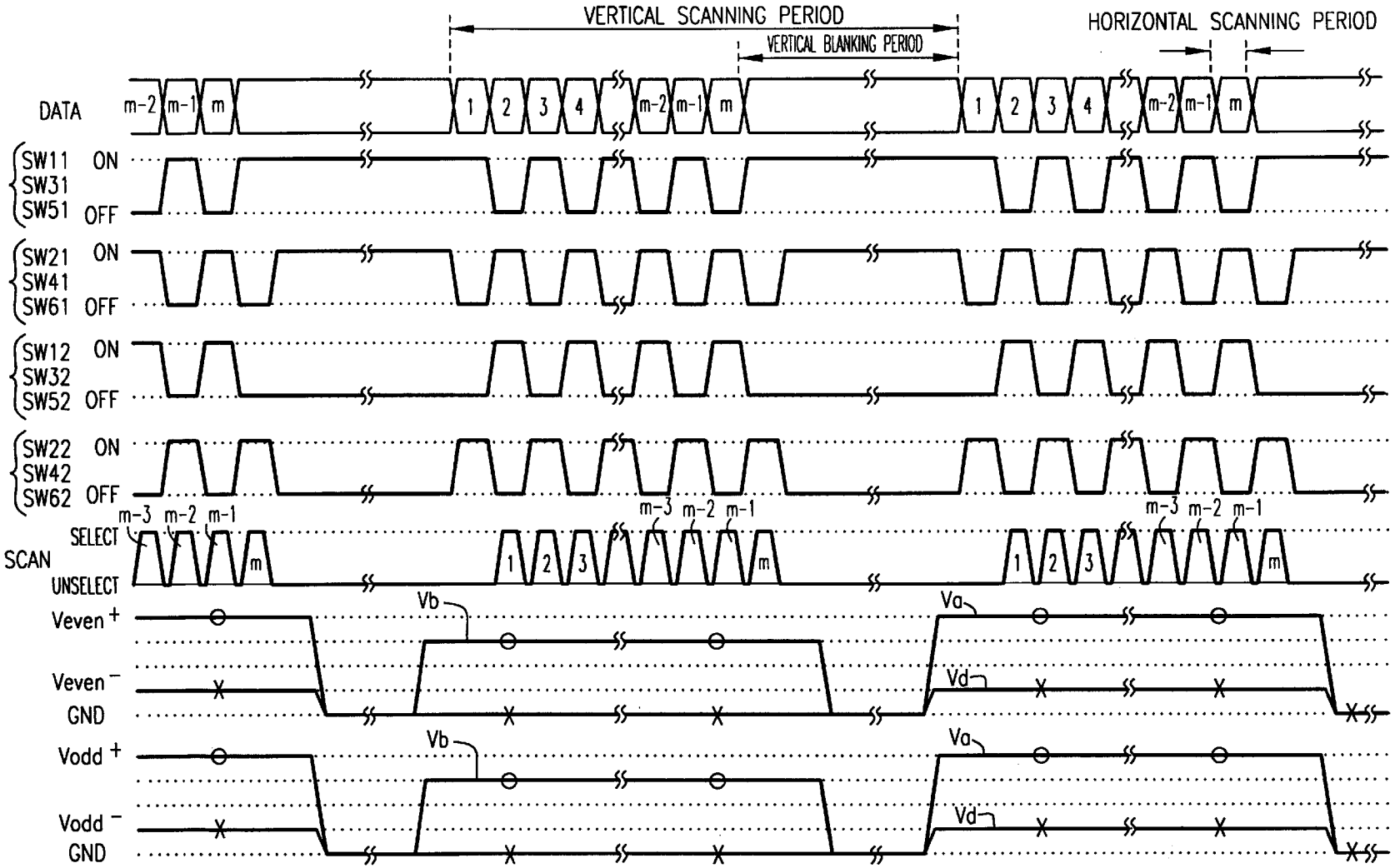
FIG. 29 is a timing chart for 1V inversion driving in a combined 1V/1H/1H+1S driver.

Further, a combined 1V/1H/1H+1S driver (#12) has the same configuration as that shown in FIG. 24 (#9). FIG. 29 shows the timing chart for achieving 1V inversion driving using a combined 1V/1H/1H+1S driver (which has the same configuration as a combined 1H/1H+1S driver). As shown in FIG. 29, 1V inversion driving can be achieved by simply providing the same supply voltages to all the analog buffers, shifting the supply voltages after each vertical scanning period, and reversing the polarity of the analog buffers.

Additionally, drivers for combined 1H/1S driving (#8), combined 1S/1H+1S driving (#10), combined 1V/1H/1S driving (#11), combined 1V/1S/1H+1S driving (#13), and combined 1H/1S/1H+1S driving (#14) have the same configuration as that shown in FIG. 1 (#15). This is because at least a four-channel supply voltage is necessary in order to achieve both 1H inversion driving and 1S inversion driving, or both 1S inversion driving and 1H+1S inversion driving.

Seventh Embodiment

Figure 30:
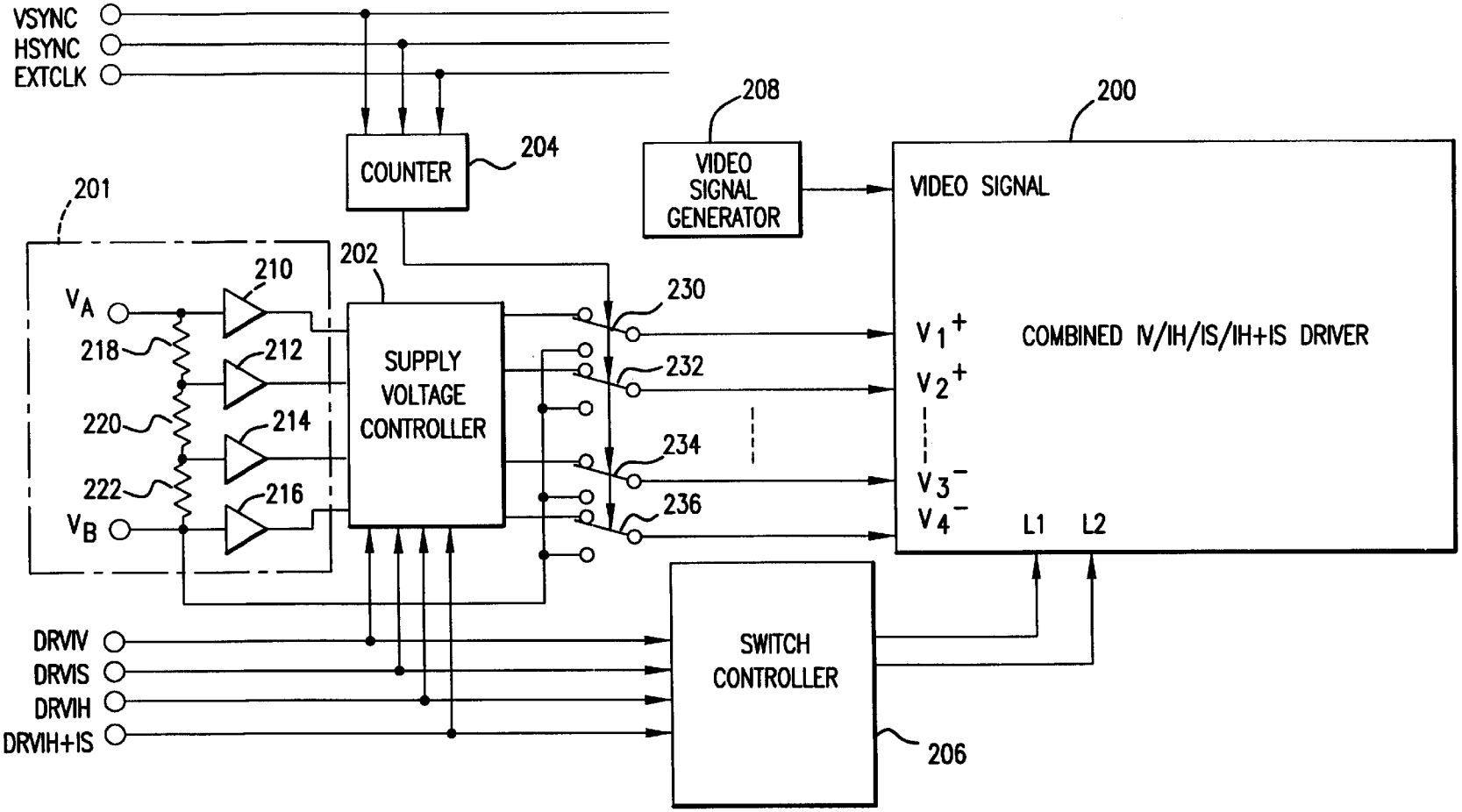
FIG. 30 is an example of the configuration of a control circuit which controls a liquid crystal driver.

The seventh embodiment relates to liquid crystal driver control circuits. FIG. 30 shows an example of the configuration of control circuits for controlling combined 1V/1H/1S/1H+1S driver 200. The control circuits in this embodiment include supply voltage generator 201, supply voltage controller 202, counter 204, switch controller 206, and video signal generator 208. Supply voltage generator 201 includes buffers 210 through 216 and resistances 218 through 222. Voltages VA and VB are voltage divided by resistances 218 to 222, the divided voltages are then buffered by means of buffers 210 to 216, and then output to supply voltage controller 202. In this manner, four-channel supply voltages are generated for supplying supply lines $V1^+$ to $V4^+$ and $V1^-$ to $V4^-$. Signals $DR_{1V}$, $DR_{1S}$, $DRV_{1H}$, and $DRV_{1H+1S}$ are provided for determining which driving methods of 1V, 1S, 1H, and 1H+1S are to be selected. Based on signals $DR_{1V}$, $DR_{1S}$, $DRV_{1H}$, and $DRV_{1H+1S}$, supply voltage controller 202 controls the values of the supply voltages provided to supply lines $V1^+$ to $V4^+$ and $V1^-$ to $V4^-$. By control of these supply voltages, the polarity of the analog buffers can be controlled. Similarly, based on signals $DR_{1V}$, $DR_{1S}$, $DRV_{1H}$, and $DRV_{1H+1S}$, switch controller 206 controls the switch on-off functions using switch control lines L1 and L2. By this type of control, it is possible to control the switch on-off sequences.

Based on signals VSYNC, HSYNC, and EXTCLK, counter 204 controls the on-off functions of switches 230 to 236.

Video signal generator 208, in addition to generating the video signals which must be input to combined 1V/1H/1S/1H+1S driver 200 also performs level shifting and other functions of the generated video signals. For example, when the analog buffer output voltage range shifts, it is also necessary to shift the video signal voltage level. Video signal generator 208 can also perform this type of level shift function.

Figure 31:
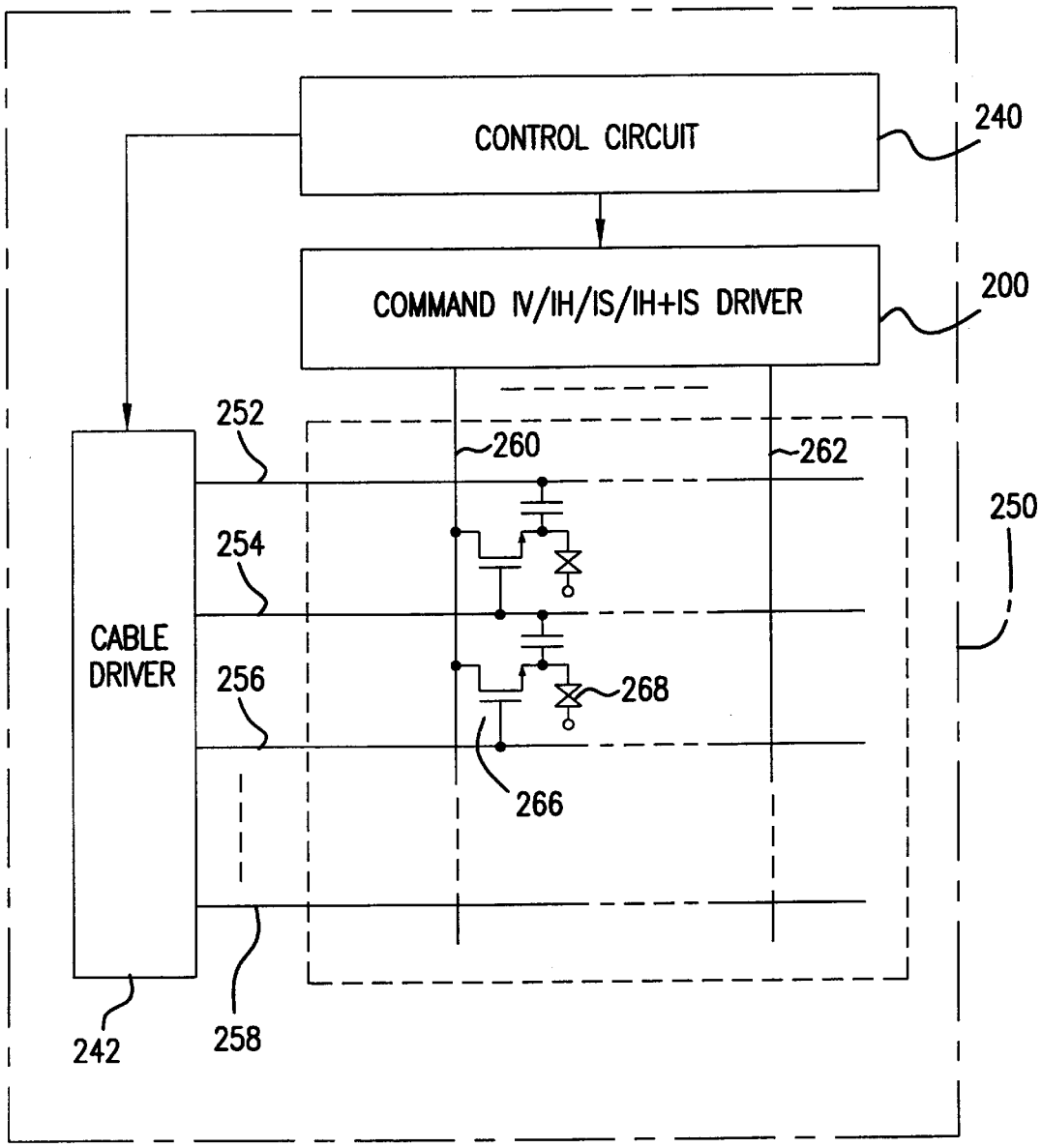
FIG. 31 is an example of the overall configuration of a liquid crystal panel containing a liquid crystal driver.

FIG. 31 shows an example of the configuration of an entire liquid crystal panel 250 including the combined 1V/1H/1S/1H+1S driver 200. Gate driver 242 drives scan lines 252 to 258 which are connected to the gate electrodes of TFT 266. Additionally, combined 1V/1H/1S/1H+1S driver 200 drives signal lines 260 and 262 which are connected to the source regions of TFT 266. These drivers are controlled by control circuits 240, and this control makes possible a liquid crystal display using liquid crystal 268. In this case in the present embodiment, combined 1V/1H/1S/1H+1S driver 200, control circuits 240, and gate driver 242 are integrated upon liquid crystal panel 250. By means of such integration, it is possible to dramatically decrease the size and cost of a liquid crystal display. In this case, it is necessary to have these liquid crystal drivers composed of TFTs as well. Therefore, in this case, particularly, it is desirable to have liquid crystal drivers composed of relatively high mobility poly (polycrystalline) silicon TFTs.

Although FIGS. 30 and 31 show the configuration of control circuits and liquid crystal panels corresponding to a combined 1V/1H/1S/1H+1S driver, the configuration of control circuits and liquid crystal panels for other combined drivers or dedicated drivers is the same. Also, although FIG. 31 shows liquid crystal drivers and control circuits all integrated on liquid crystal panel 250, it is also acceptable to have only one part integrated. It is also acceptable to have the combined 1V/1H/1S/1H+1S driver composed of single crystal CMOS transistors and provided on the periphery of the liquid crystal panel.

Eighth Embodiment

When the liquid crystal drivers are integrated on the liquid crystal panel as in FIG. 31, the analog buffers are comprised of TFTs (thin film transistors). The eighth embodiment relates to analog buffers composed of TFTs.

There are differences between TFT analog buffers and single crystal CMOS analog buffers as described below. First, for TFTs compared to single crystal CMOS, the region over which the output voltage is roughly linear with respect to the input voltage is extremely narrow. In comparison to the case for single crystal CMOS in which the linear range with respect to supply voltage is about 70%, the range is only about 40% for TFTs. The reasons for this include the fact that for TFTs, the AIDS/AVDS value (IDS is the current between the drain and source, and VDS is the voltage between drain and source) in the saturation region of the transistor characteristics is large, and the performance of the constant current supplies integrated in the buffers are worse than for single crystal CMOS. Additionally, the threshold voltage for TFTs is higher than for single crystal CMOS leading to the need for a high voltage of 12 V or higher for the driving voltage. Finally, the offset values for TFT buffers are larger than for single crystal CMOS buffers and can be around 500 mV in the worst case (the offset is about 20 mV for single crystal CMOS).

Figure 32:
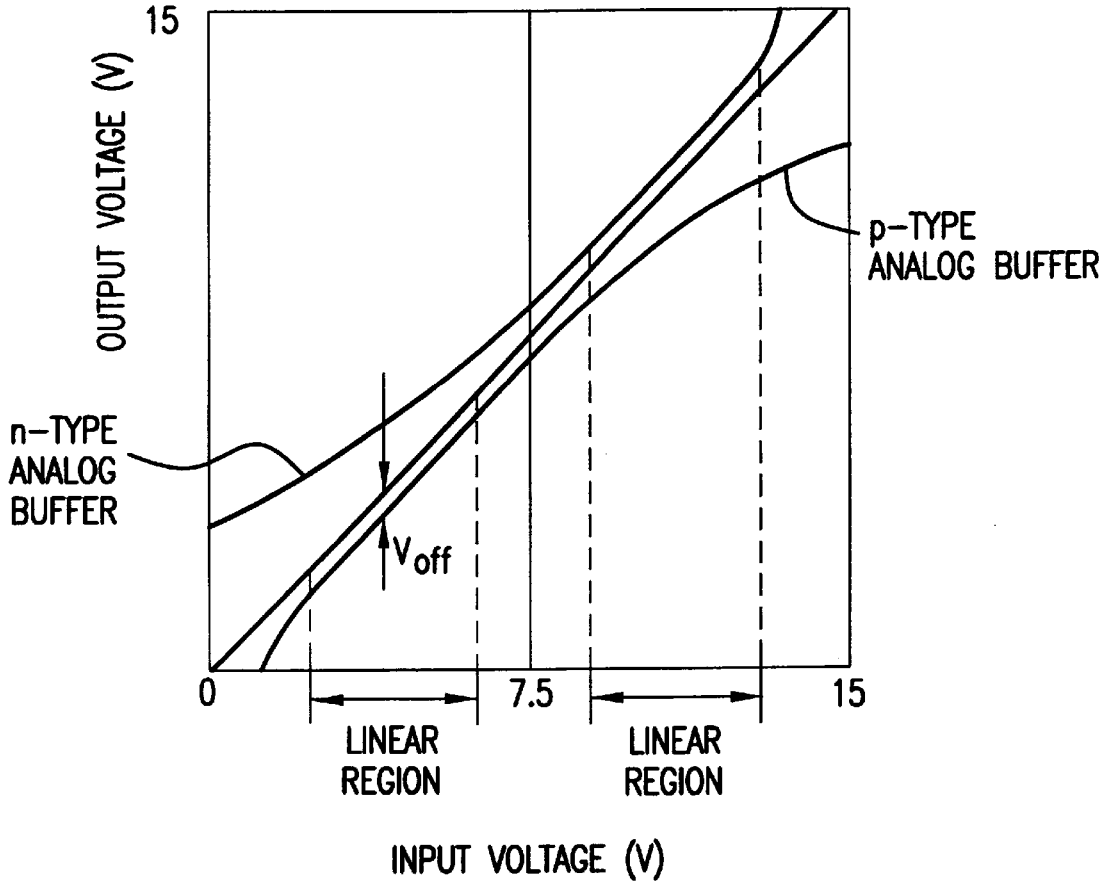
FIG. 32 is an example of the input-output characteristics of an analog buffer.
Figure 33A:
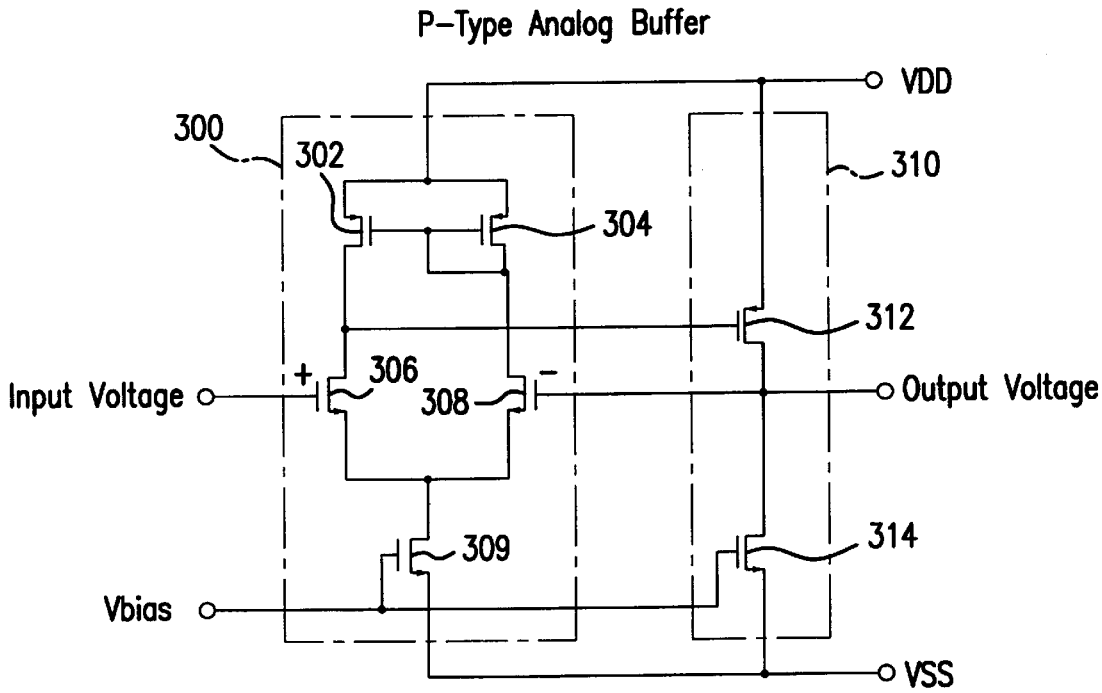
FIG. 33A and FIG. 33B are examples of the configuration of a p-type analog buffer and an n-type analog buffer, respectively.
Figure 33B:
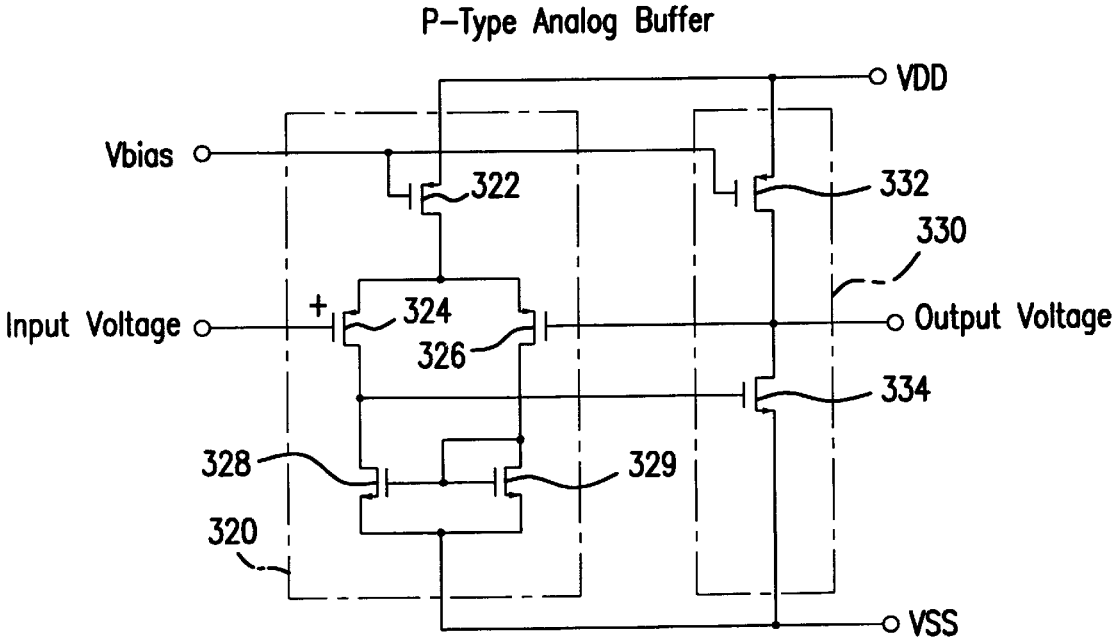

FIG. 32 shows examples of the input and output characteristics for p-type and n-type analog buffers comprised of TFTs. FIGS. 33A and 33B show examples of the configuration of p-type and n-type analog buffers, respectively. As shown in FIG. 33A, the p-type analog buffer consists of the differentiator 300 (differential stage) and the driver 310 (driving means), and the driver 310 includes p-channel driving transistor 312. In differentiator 300, the voltage difference between the input voltage and the output voltage is amplified. The output of the differentiator 300 is connected to the gate electrode of the p-channel driving transistor 312, and the output voltage of the p-type analog buffer is output from the drain region. The output of the p-type analog buffer is input into the minus terminal of differentiator 300 (gate electrode of transistor 308). In other words, this analog buffer is composed of a source follower connected to an operational amplifier. Transistors 309 and 314 are constant current sources (or resistances).

As shown in FIG. 33B, the n-type analog buffer consists of the differentiator 320 and the driver 330, and the driving region 330 includes n-channel driving transistor 334. In this fashion, in the p-type analog buffer the output voltage is driven by p-channel transistor 312; and, in the n-type analog buffer, the output voltage is driven by n-channel transistor 334.

As can be understood from the input-output characteristics in FIG. 32, the linear region of TFT analog buffers is extremely narrow. This linear region occurs at low voltages for p-type analog buffers and at high voltages for n-type analog buffers. Also, again as shown in FIG. 32, the value of the offset voltage Voff is very high for TFT analog buffers.

As mentioned previously, when driving a liquid crystal using analog buffers, it is necessary to invert the voltage applied to the liquid crystal with respect to the counter voltage (common voltage). When using a single buffer to cover the entire voltage range, however, it is necessary to fabricate the analog buffers with a high break-down voltage thereby leading to an increase in scale and price. On the other hand, it is also possible to consider a method in which a p-type analog buffer is used for negative polarities as shown in FIG. 33A, and an n-type analog buffer is used for positive polarities as shown in FIG. 33B. Using this method, it is possible to fabricate analog buffers with a low breakdown process. In this method, however, because of differences in the characteristics of p-type and n-type analog buffers, the problem of display quality degradation arises. This is a result of the difference between the offset values for p-type and n-type analog buffers which gives rise to display signal distortion. Additionally, in such a method which mixes p-type and n-type analog buffers, the realization of liquid crystal drivers which can combine multiple driving means as in embodiments 1 to 6 is difficult.

In order to solve the problems mentioned above, a method which shifts the supply voltage from VDDH and VSSH to VDDL and VSSL, or, conversely from VDDL and VSSL to VDDH and VSSH as shown in FIG. 34A can be considered. In this case, the video signal also is level shifted to match these shifts in supply voltage. Consequently, by shifting the supply voltage to VDDH or VSSH and VDDL or VSSL, it is possible to make the analog buffers positive or negative, respectively. As a result, it is possible to apply a voltage whose polarity switches between positive and negative with respect to the counter voltage to the liquid crystal element. This method is similar to the prior art described in Japanese Unexamined Patent Application Heisei 6-222741. In this method, VDDH, VDDL, VSSH, and VSSL are symmetric about Vcom.

This method, however, is good when the analog buffers consist of single crystal CMOS transistors, but not so good when the analog buffers consist of TFTs. This is because TFT analog buffers have narrow linear regions as shown in FIG. 32 with the result being that it is necessary to carry out buffering in the method shown in FIG. 34A using the nonlinear regions. Buffering with nonlinear regions leads to extreme decreases in display quality.

Figure 34C:
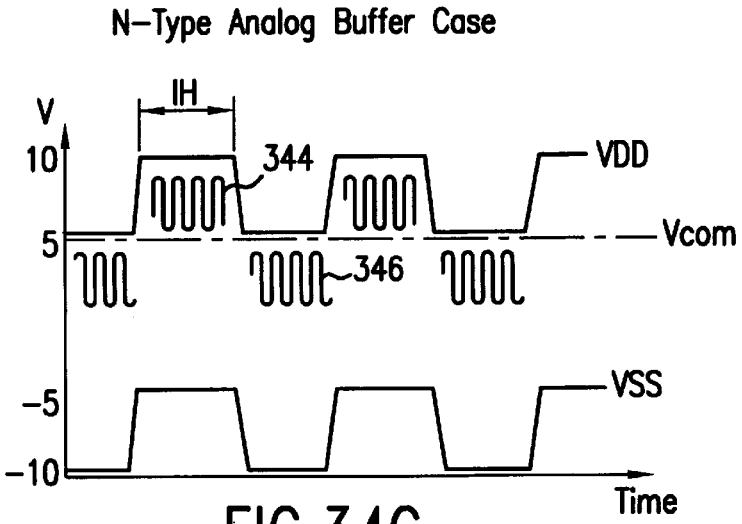

Consequently, in this embodiment, keeping in mind the input and output characteristics of TFT analog buffers as shown in FIG. 32, a method which shifts the supply voltage as shown in FIG. 34B when using p-type analog buffers and which shifts the supply voltage as shown in FIG. 34C when using n-type analog buffers is employed. In other words, in this embodiment, the supply voltages provided to analog buffers, composed of TFTs, and having linear regions in which the relationship between the input and output voltages is approximately linear, are controlled. When the input voltage amplitude has been shifted, this supply voltage control can be realized by controlling the high potential and low potential supply voltage so that the voltage amplitude is included in the linear region.

Figure 35A:
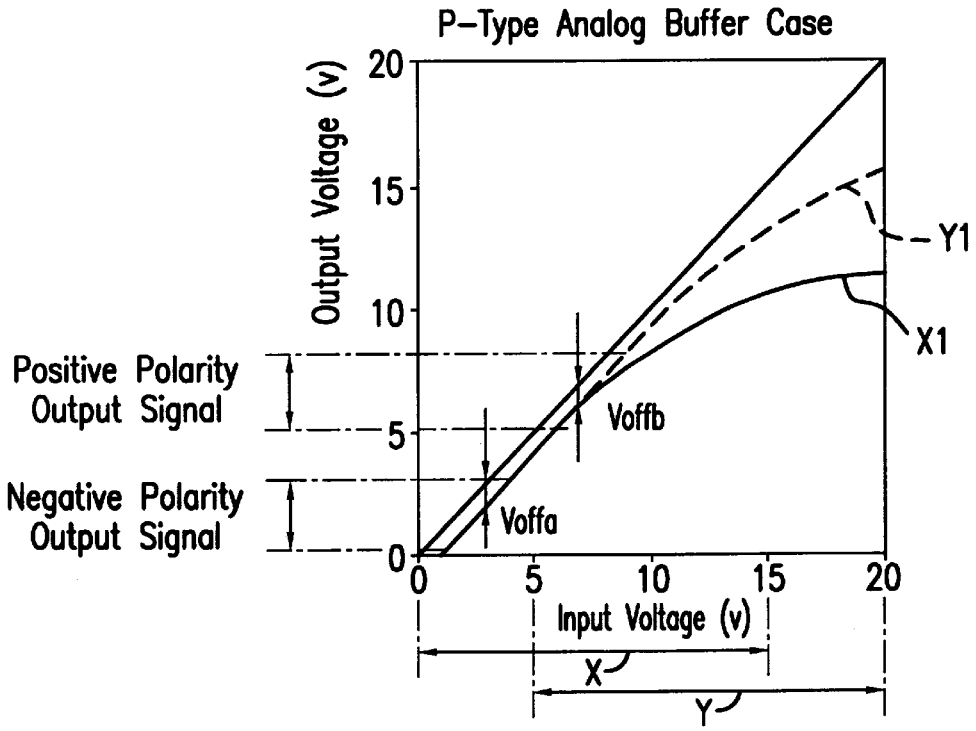
FIG. 35A and FIG. 35B are an example of the input-output characteristics of a p-type analog buffer and an n-type analog buffer when the supply voltage is shifted.

More specifically, in FIG. 34B, let the supply voltages provided to the analog buffers shift between, for example, VDD=15 V, VSS=0 V and VDD=20 V, VSS=5 V. The counter voltage Vcom is about 5 V. Therefore, when VDD=15 V and VSS=0 V, the analog buffer output voltage range is negative with respect to Vcom as a reference and the p-type analog buffer becomes a negative polarity analog buffer. Conversely, when VDD=20 V and VSS=5 V, the analog buffer output voltage range is positive with respect to Vcom as a reference and the p-type analog buffer becomes a positive polarity analog buffer. By alternately switching the analog buffer polarity between positive and negative, alternating current driving with respect to the liquid crystal is possible. In FIG. 35A, the p-type analog buffer input/output characteristics are shown when the supply voltage shifts as described above. When the p-type analog buffer is used with negative polarity, the supply voltage range is as shown by X in FIG. 35A. As can be clearly seen from the figure, because the input voltage range from 1 V to 4 V is linear, it is possible to buffer video signal 340 in FIG. 34B using a linear region and a precise gray-scale display is possible. Further, when the p-type analog buffer is used with positive polarity, the supply voltage range is as shown by Y in FIG. 35A. Here, as can be clearly seen from the figure, because the input voltage range from 6 V to 9 V is linear, it is possible to buffer video signal 342 in FIG. 34B using a linear region and a precise gray-scale display is possible.

Additionally, in this case, the offset values Voffa and Voffb shown in FIG. 35A are the same value. This is because the curves X1 and Y1 in FIG. 35A are curves from the same p-type analog buffer with only a supply voltage shift. When the offset value Voffa when the analog buffer has negative polarity and the offset value Voffb when the analog buffer has positive polarity are identical, by adjusting the counter voltage Vcom value by only Voffa=Voffb, the effect of the offset voltage can be canceled and it is possible to prevent distortion of the video signal arising from buffering by analog buffers.

Figure 35B:
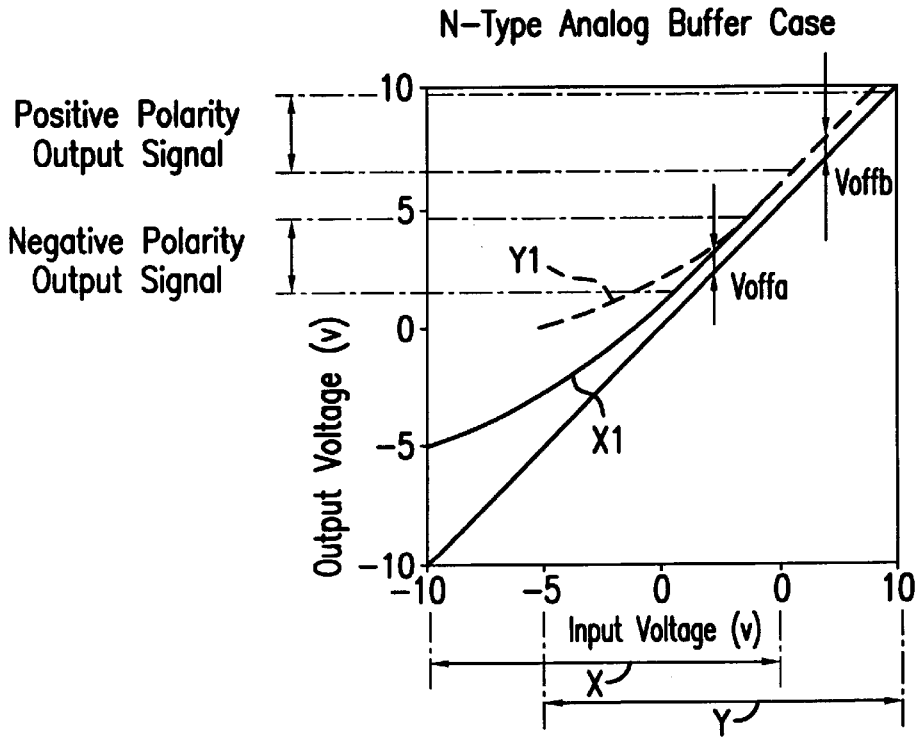

As shown in FIG. 34C in which the analog buffer is used as an n-type device, it is again possible to buffer the video signal with the linear region in exactly the same way as described above. The analog input/output characteristics for this case are shown in FIG. 35B. When using an n-type analog buffer, however, a −10 V supply voltage is necessary as can be seen clearly in FIG. 34C. Also, when the analog buffer supply voltage VDD=10 V and VSS=−5 V, video signal 344 swings between 6 V and 9 V. At this point, in order to transmit this video signal to analog buffers 170 to 180 via switches 104, 106, and 108 in FIG. 1, for example, it is necessary to increase the output of level shifter 102 to higher than 10 V—for example, a voltage of around 15 V is necessary. The reason for this is that switches 104, 106, and 108 are normally composed of n-type transistors and the threshold voltage of n-type transistors increases as a result of an effect known as the "body effect" when the video signal is in the range of 6 V to 9 V. Consequently, in this case, the liquid crystal drivers require supply voltages of −10 V to 15 V leading to a situation in which the TFTs comprising the liquid crystal drivers cannot withstand the voltages. In contrast, when p-type analog buffers are used, with VDD=20 V and VSS=5 V, since the video signal 342 swings within the range of 9 V to 6 V, a supply voltage of 20 V or more is not necessary and switches 104, 106, and 108 can turn on and off by means of the output of level shifter 102 without difficulties. Additionally, when VDD=15 V and VSS=0 V, since video signal 340 swings between 1 V and 4 V, switches 104, 106, and 108 can turn on and off by means of the output of level shifter 102 without difficulties. As a result, a supply voltage range of 0 V to 20 V is necessary for the liquid crystal driver and the problem of TFT breakdown can be prevented. Therefore, in this respect, it is advantageous to use p-type analog buffers rather than n-type analog buffers.

The present invention is not limited to embodiments 1 to 8 described above. Various modified embodiments are also possible within the range of the main points of this invention.

For example, although the configuration of this embodiment has two analog buffers and four switches for each signal line, the present invention is not limited to this; and it is possible to use various other configurations. For example, switches 110 and 120 in FIG. 1 can be substituted by a single switch or a configuration with three or more analog buffers could also be used. Additionally, the analog buffer output selection means are not limited to configurations such as those with switches 130 and 140.

Further, as for the case in which the select voltage (SCAN in FIG. 4) becomes effective (select) when the applied voltage from the signal driving means takes effect, the method in which the select voltage becomes effective after sequentially delaying by a single horizontal scanning period is not limited to liquid crystal driving devices having a configuration as described in FIG. 1 and others, but is applicable to liquid crystal driving devices with various configurations.

Figure 36:
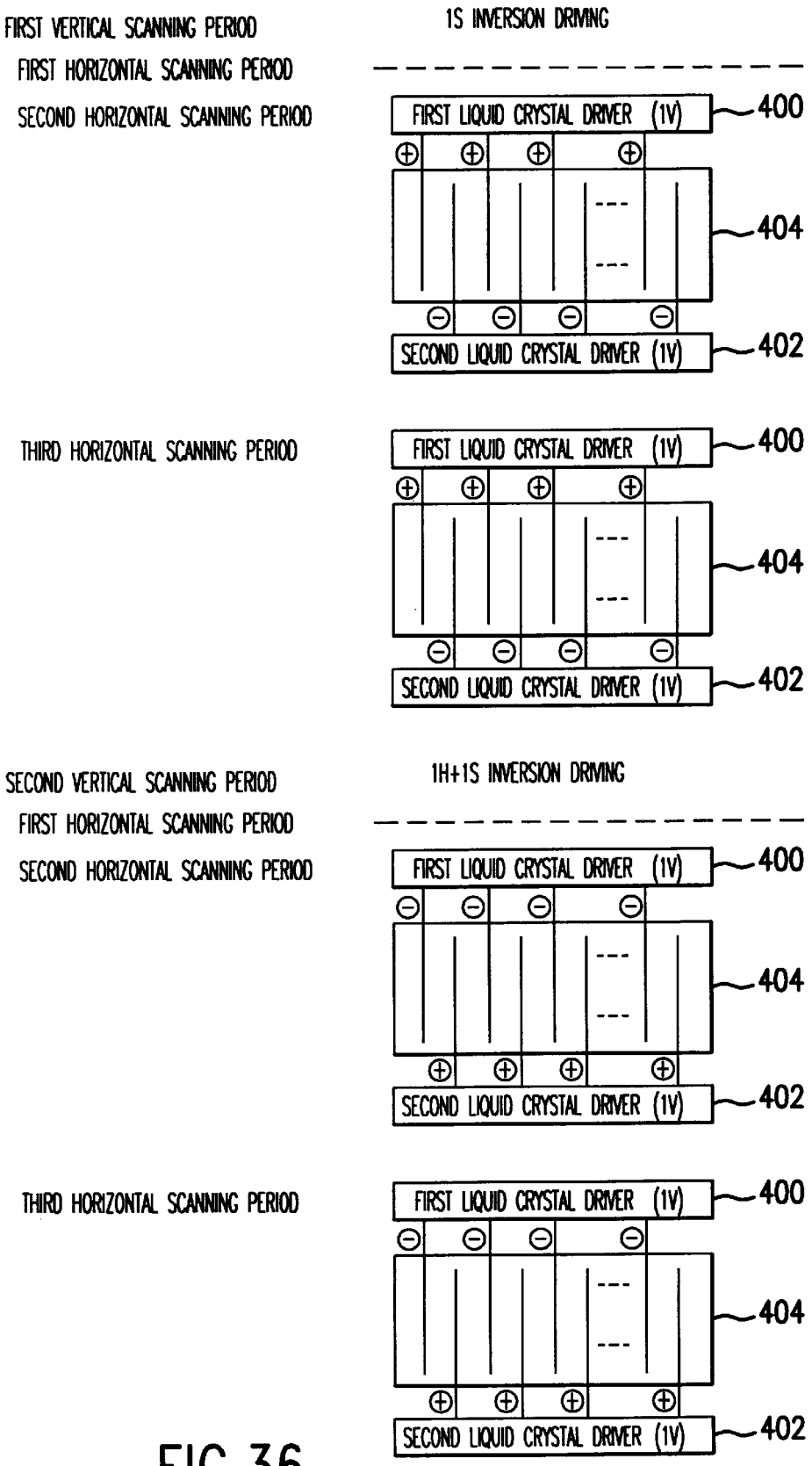
FIG. 36 is used to explain the operation of an example in which 1S inversion driving is achieved using two liquid crystal drivers.

In this invention, it is also acceptable to place the liquid crystal drivers described in the preceding embodiments at the top and bottom edges of the liquid crystal panel and alternately connect the signal lines to the top and bottom drivers. For example, in FIG. 36, the first and second drivers 400 and 402 are located at the top and bottom of liquid crystal panel 404 (it is also acceptable to have the liquid crystal drivers integrated on the liquid crystal panel). Here, combined drivers described in embodiments 1 and 6 and FIG. 27 operated in the 1V inversion driving mode, or dedicated 1V drivers described in Embodiment 2 are used as the first and second liquid crystal drivers 400 and 402. Odd-numbered signal lines are connected to the signal driving means of the first liquid crystal driver 400, and even-numbered signal lines are connected to the signal driving means of the second liquid crystal driver 402. The output voltage range of the analog buffers selected by the signal driving means of the first liquid crystal driver 400 are shifted in the opposite direction from the output voltage range of the analog buffers selected by the signal driving means of the second liquid crystal driver 402 using the counter voltage as a reference. By so doing, as shown in FIG. 36, during the first vertical scanning period, the output of the first liquid crystal driver 400 is positive; and the output of the second liquid crystal driver 402 is negative. Then, during the second vertical scanning period, the output of the first liquid crystal driver 400 is negative; and the output of the second liquid crystal driver 402 is positive. In other words, it is possible to achieve 1S inversion driving as shown in FIG. 40C using the 1V inversion driving first and second liquid crystal drivers 400 and 402.

Figure 37:
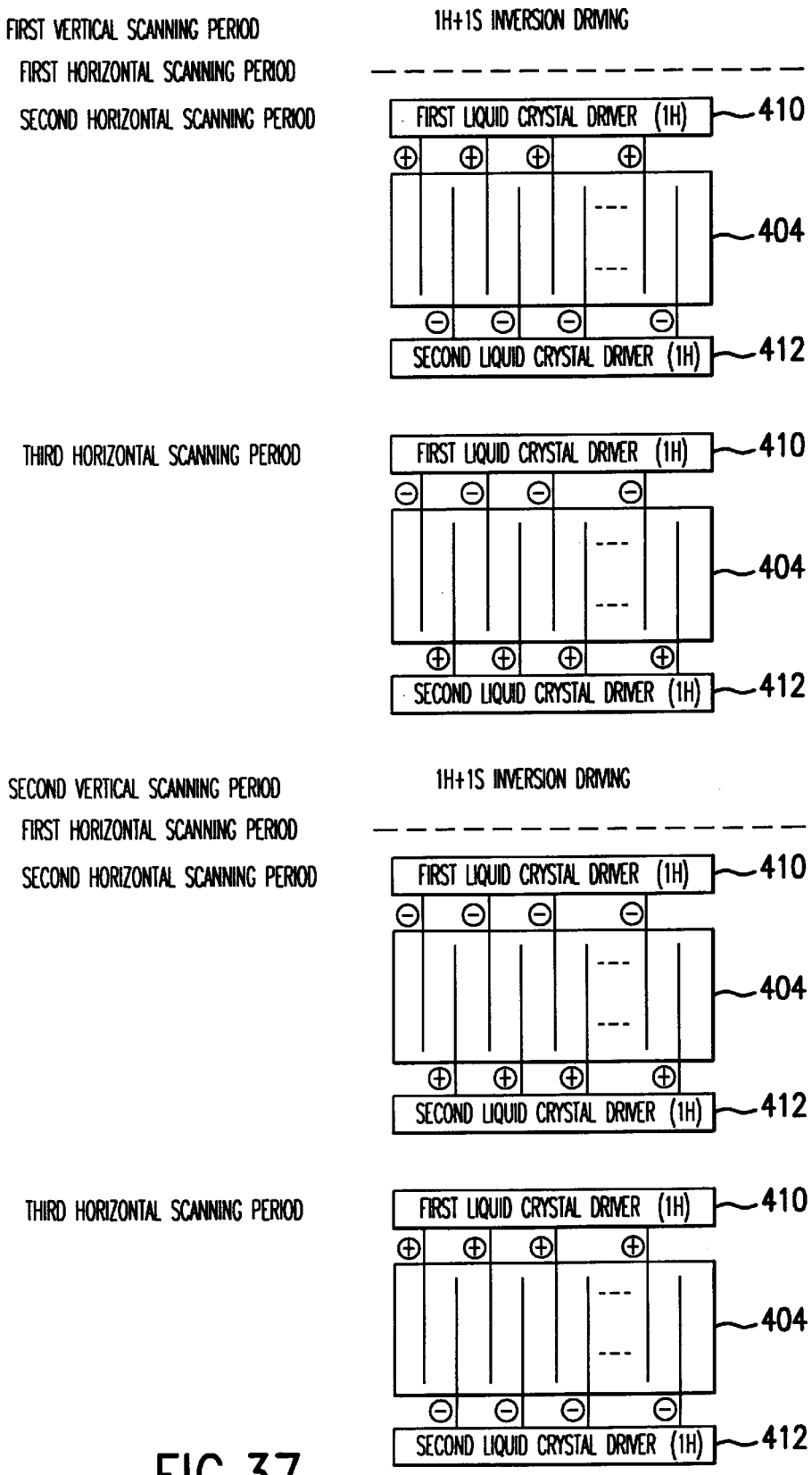
FIG. 37 is used to explain the operation of an example in which 1H+1S inversion driving is achieved using two liquid crystal drivers.

On the other hand, FIG. 37 differs from FIG. 36 in that the combined drivers described in Embodiment 1 and FIG. 27 operated in the 1H inversion driving mode, or dedicated 1H drivers described in Embodiment 3 are used as the first and second liquid crystal drivers 410 and 412. By so doing, as shown in FIG. 37, during the second horizontal scanning period of the first vertical scanning period, the outputs of the first and second liquid crystal drivers 410 and 412 are positive and negative, respectively. During the third horizontal scanning period, the outputs are negative and positive, respectively.

During the second horizontal scanning period of the second vertical scanning period, the outputs of the first and second liquid crystal drivers 410 and 412 are negative and positive, respectively; and, during the third horizontal scanning period, the outputs are positive and negative, respectively. In other words, it is possible to achieve 1H+1S inversion driving as shown in FIG. 40D using the 1H inversion driving first and second liquid crystal drivers 410 and 412.

When using analog buffers in liquid crystal drivers as explained in embodiments 1 to 6, for example, it is also not absolutely necessary to shift the supply voltage using the method shown in FIGS. 34B and 34C. For example, it is also permissible to shift the supply voltage by the method shown in FIG. 34A, and alternate the polarity of the analog buffers. Especially when the liquid crystal drivers are composed of single crystal CMOS silicon, use of the method in FIG. 34A is appropriate.

The configuration of the analog buffers, too, is not limited to those shown in FIG. 33A and FIG. 33B. For example, it is permissible to use configurations of the differentiator and driver different from those in FIGS. 33A and 33B.

The shift range of the supply voltage supplied to the analog buffers is also not restricted to that shown in FIGS. 34B and 34C, and can change depending on the TFT characteristics and the analog buffer circuit configurations.

Further, this invention is not restricted to polycrystalline silicon TFTs, but may also naturally be applied to amorphous (non-crystalline) silicon TFTs.

I claim:

1. A liquid crystal driving device for driving a plurality of liquid crystal elements arrayed in a matrix by supplying a voltage to a first side of selected ones of the liquid crystal elements and supplying a counter voltage to a second side of the selected ones of the liquid crystal elements, comprising:

at least one signal driving means, including means for sequentially sampling and holding video signals, analog buffers to which are applied high potential and low potential supply voltages for buffering sample and hold voltages, and selection means for selecting any output from said analog buffers;

supply voltage control means for controlling values of said high potential supply voltage and said low potential supply voltage which are supplied to said analog buffers, and for shifting a range of an output voltage of said analog buffers to one of high potential and low potential based on said counter voltage; and selection control means for controlling the selection by said selection means of any output of said analog buffers in which the output voltage range is shifted by said supply voltage control means.

2. A liquid crystal driving device for driving a plurality of liquid crystal elements arrayed in a matrix by supplying a voltage to a first side of selected ones of the liquid crystal elements and supplying a counter voltage to a second side of the selected ones of the liquid crystal elements, comprising:

at least one signal driving means including means for sequentially sampling and holding video signals, a first and second switching means, a first analog buffer which buffers and outputs a first voltage which is transmitted via said first switching means, a second analog buffer which buffers and outputs a second voltage which is transmitted via said second switching means, a third switching means which is connected to an output of said first analog buffer and which turns on and off in conjunction with said second switching means, and a fourth switching means which is connected to an output of said second analog buffer and which turns on and off in conjunction with said first switching means;

supply voltage control means which controls values of a high potential supply voltage and a low potential supply voltage which are supplied to inputs of said first and second analog buffers and which shifts a range of the output voltage of said first and second analog buffers to one of high potential and low potential based on said counter voltage; and switch control means which controls the on and off operations of said first through fourth switching means.

3. The liquid crystal driving device of claim 2, further comprising frame inversion driving means for switching the shift directions of said output voltage range of said first and second analog buffers each vertical scanning period via control of said supply voltage control means.

4. The liquid crystal driving device of claim 2, further comprising first scan line inversion driving means for switching shift directions of the output voltage range of said first and second analog buffers, which are included in a single said signal driving means, so that the shift directions differ from one another via control of said supply voltage control means and second scan line inversion driving means for switching the on-off sequence of said first through fourth switching means each vertical scanning period via control of said switch control means.

5. The liquid crystal driving device of claim 2, further comprising:

scan line inversion driving means for shifting directions of the output voltage range of said first and second analog buffers, which are included in a single said signal driving means, so that the shift directions differ from one another; and scan line inversion driving means for switching the shift directions of the output voltage range of said first and second analog buffers each vertical scanning period via control of said supply voltage control means.

6. The liquid crystal driving device of claim 2, further comprising:

first signal line inversion driving means for shifting directions of the output voltage range of said first and second analog buffers, which are included in a single said signal driving means, so that the shift directions remain constant;

second signal line inversion driving means for shifting directions of the output voltage range of said first and second analog buffers, which are included in the adjacent said signal driving means, so that the shift directions differ; and means for switching the shift directions of the output voltage range of said first and second analog buffers each vertical scanning period via control of said switch control means.

7. The liquid crystal driving device of claim 2, further comprising:

first dot inversion driving means for shifting directions of the output voltage range of said first and second analog buffers, which are included in a single said signal driving means, so that the shift directions differ from one another via control of said supply voltage control means;

second dot inversion driving means for shifting directions of the output voltage range of said first and second analog buffers, which are included in the adjacent said signal driving means, so that the shift directions also differ from one another; and means for switching the on-off sequence of said first through fourth switching means each vertical scanning period via control of said switch control means.

8. The liquid crystal driving device of claim 2, further comprising:

first dot inversion driving means for shifting directions of the output voltage range of said first and second analog buffers, which are included in a single said signal driving means, so that the shift directions differ from one another;

second dot inversion driving means for shifting directions of the output voltage range of said first and second analog buffers, which are included in the adjacent said signal driving means, so that the shift directions also differ from one another; and means for switching the shift directions of the output voltage range of said first and second analog buffers each vertical scanning period via control of said supply voltage control means.

9. The liquid crystal driving device of claim 2, further comprising:

dot inversion driving means for shifting directions of the output voltage range of said first and second analog buffers, which are included in a single said signal driving means, so that the shift directions differ from one another via control of said supply voltage control means; and means for making the on-off sequence of said first through fourth switching means, which are included in the adjacent said signal driving means different from one another via control of said switch control means; and means for switching the on-off sequence of said first through fourth switching means each vertical scanning period via control of said switch control means.

10. The liquid crystal driving device of claim 2, further comprising:

dot inversion driving means for making the shift directions of the output voltage range of said first and second analog buffers, which are included in a single said signal driving means, differ from one another;

means for switching the shift directions of the output voltage range of said first and second analog buffers each vertical scanning period via control of said supply voltage control means; and means for making the on-off sequences of said first through fourth switching means, which are included in the adjacent said signal driving means, different from one another via the control of said switch control means.

11. The liquid crystal driving device of claim 2, wherein said supply voltage control means includes a means for controlling:

a first supply line, which supplies a high potential supply voltage and a low potential supply voltage to said first analog buffer, and is included in the at least one signal driving means;

a second supply line, which supplies a high potential supply voltage and a low potential supply voltage to said second analog buffer, and is included in the at least one signal driving means;

a third supply line, which supplies a high potential supply voltage and a low potential supply voltage to said first analog buffer, and is included in the at least one signal driving means;

a fourth supply line, which supplies a high potential supply voltage and a low potential supply voltage to said second analog buffer, and is included in the at least one signal driving means; and values of the high potential supply voltage and the low potential supply voltage supplied to said first through fourth supply lines; and said switch control means includes a means for controlling:

a switch control line 1, which controls the switching of said first and third switching means;

a switch control line 2, which controls the switching of said second and fourth switching means; and switch signals supplied to said switch control lines 1 and 2.

12. The liquid crystal driving device of claim 2, wherein said supply voltage control means includes a means for controlling:

a supply line which supplies a high potential supply voltage and a low potential supply voltage to the first and second analog buffers; and a value of the high potential supply voltage and the low potential supply voltage supplied to said supply line; and said switch control means includes a means for controlling:

a switch control line 1, which controls the switching of said first and third switching means;

a switch control line 2, which controls the switching of said second and fourth switching means; and a switch signal supplied to said switch control lines 1 and 2.

13. The liquid crystal driving device of claim 2, wherein said supply voltage control means includes a means for controlling:

a first supply line, which supplies a high potential supply voltage and a low potential supply voltage to said first analog buffer;

a second supply line, which supplies a high potential supply voltage and a low potential supply voltage to said second analog buffer; and a value of the high potential supply voltage and the low potential supply voltage supplied to said first and second supply lines; and said switch control means includes a means for controlling:

a switch control line 1, which controls the switching of said first and third switching means;

a switch control line 2, which controls the switching of said second and fourth switching means; and a switch signal supplied to said first and second switch control lines.

14. The liquid crystal driving device of claim 2, wherein said supply voltage control means includes a means for controlling:

a first supply line, which supplies a high potential supply voltage and a low potential supply voltage to said first and second analog buffers, included in the at least one signal driving means;

a second supply line, which supplies a high potential supply voltage and a low potential supply voltage to said first and second analog buffers, included in the at least one signal driving means; and a value of the high potential supply voltage and the low potential supply voltage supplied to said first and second supply lines; and said switch control means includes a means for controlling:

a switch control line 1, which controls the switching of said first and third switching means;

a switch control line 2, which controls the switching of said second and fourth switching means; and a switch signal supplied to said switch control lines 1 and 2.

15. The liquid crystal driving device of claim 2, wherein said supply voltage control means includes a means for controlling:

a first supply line, which supplies a high potential supply voltage and a low potential supply voltage to said first analog buffer;

a second supply line, which supplies a high potential supply voltage and a low potential supply voltage to said second analog buffer; and a value of the high potential supply voltage and the low potential supply voltage supplied to said first and second supply lines; and said switch control means includes a means for controlling:

a switch control line 1, which controls the switching of the first and third switching means included in the at least one signal driving means; and the second and fourth switching means included in the at least one signal driving means;

a switch control line 2, which controls the switching of the first and third switching means included in the at least one signal driving means, and the second and fourth switching means included in the at least one signal driving means; and a switch signal supplied to said switch control lines 1 and 2.

16. The liquid crystal driving device of claim 2, wherein said supply voltage control means includes a means for controlling:

a first supply line, which applies a high potential supply voltage and a low potential supply voltage to said first analog buffer;

a second supply line, which applies a high potential supply voltage and a low potential supply voltage to said second analog buffer; and a value of the high potential supply voltage and the low potential supply voltage supplied to said first and second supply lines; and said switch control means includes a means for controlling:

a switch control line 1, which controls the switching of the first and third switching means included in the at least one signal driving means;

a switch control line 2, which controls the switching of the second and fourth switching means included in the at least one signal driving means;

a switch control line 3, which controls the switching of the first and third switching means included in the at least one signal driving means;

a switch control line 4, which controls the switching of the second and fourth switching means included in the at least one signal driving means; and a switch signal supplied to said switch control lines 1 through 4.

17. The liquid crystal driving device of claim 2, further comprising a scan driving means which outputs a selection voltage to the scan lines in order to select whether to apply said voltage to said selected ones of said liquid crystal elements; and said scan driving means enables said selection voltage by sequentially delaying the select voltage by one horizontal scanning period so that said selection voltage becomes effective when one of said third switching means and said fourth switching means becomes conductive after completion of the sample-and-hold in the first horizontal scanning period of the vertical scanning period.

18. The liquid crystal driving device of claim 1, wherein said supply voltage control means includes means for fixing at a prescribed value said high potential supply voltage and said low potential supply voltage at a time of a vertical blanking period.

19. The liquid crystal driving device of claim 2, wherein said supply voltage control means includes means for fixing at a prescribed value said high potential supply voltage and said low potential supply voltage at a time of a vertical blanking period.

20. The liquid crystal driving device of claim 1, wherein the analog buffers comprise:

thin film transistors having a linear region in which a relationship of said output voltage to an input voltage is approximately linear and wherein said supply voltage control means controls the value of said high potential supply voltage and said low potential supply voltage so that an amplitude of said input voltage is included in said linear region when the amplitude of said input voltage shifts.

21. The liquid crystal driving device of claim 2, wherein the first and second analog buffer comprise:

thin film transistors having a linear region in which a relationship of said output voltage to an input voltage is approximately linear and wherein said supply voltage control means controls the value of said high potential supply voltage and said low potential supply voltage so that an amplitude of said input voltage is included in said linear region when the amplitude of said input voltage shifts.

22. The liquid crystal driving device of claim 20, wherein the analog buffers include:

a differential stage in which said input voltage and said output voltage are input and in which a voltage difference between the input voltage and the output voltage is amplified and output;

driving means in which the output of said differential stage is input to the gate electrode, said driving means including an n-channel driving transistor which outputs said output voltage from the drain region; and wherein said supply voltage control means shifts a value of said high potential supply voltage and said low potential supply voltage to the low potential side so that when an amplitude of said input voltage shifts to the low potential side said amplitude is included in said linear region which is located on the high potential side.

23. The liquid crystal driving device of claim 21, wherein the first and second analog buffers include:

a differential stage in which said input voltage and said output voltage are input and in which a voltage difference between the input voltage and the output voltage is amplified and output;

driving means in which the output of said differential stage is input to the gate electrode, said driving means including an n-channel driving transistor which outputs said output voltage from the drain region; and said supply voltage control means shifts a value of said high potential supply voltage and said low potential supply voltage to the low potential side so that when an amplitude of said input voltage shifts to the low potential side, said amplitude is included in said linear region which is located on the high potential side.

24. The liquid crystal driving device of claim 20, wherein the analog buffers include:

a differential stage in which said input voltage and said output voltage are input and in which a voltage difference between the input voltage and the output voltage is amplified and output;

driving means in which the output of said differential stage is input to the gate electrode, said driving means including a p-channel driving transistor which outputs said output voltage from the drain region; and wherein said supply voltage control means shifts a value of said high potential supply voltage and said low potential supply voltage to the high potential side so that when an amplitude of said input voltage shifts to the high potential side, said amplitude is included in said linear region which is located on the low potential side.

25. The liquid crystal driving device of claim 21, wherein the first and second analog buffer include:

a differential stage in which said input voltage and said output voltage are input and in which a voltage difference between the input voltage and the output voltage is amplified and output;

driving means in which the output of said differential stage is input to the gate electrode, said driving means including a p-channel driving transistor which outputs said output voltage from the drain region; and wherein said supply voltage control means shifts a value of said high potential supply voltage and said low potential supply voltage to the high potential side so that when an amplitude of said input voltage shifts to the high potential side, said amplitude is included in said linear region which is located on the low potential side.

26. The liquid crystal driving device of claim 20 further comprising means for canceling an offset value of said analog buffers by adjusting a value of said counter voltage.

27. The liquid crystal driving device of claim 21 further comprising means for canceling an offset value of said first and second analog buffers by adjusting a value of said counter voltage.

28. A liquid crystal display device including at least one liquid crystal driving device as recited in claim 1, further comprising:

signal lines connected to a signal driving means of the at least one liquid crystal driving device;

scan lines which intersect at the signal lines;

liquid crystal elements arrayed in a matrix; and thin film transistors for transmitting applied voltage to the liquid crystal elements.

29. A liquid crystal display device including first and second liquid crystal driving devices as recited in claim 1, further comprising:

signal lines connected to one of the signal driving means of the first liquid crystal driving devices and the signal driving means of the second liquid crystal driving devices;

scan lines which intersect at the signal lines;

liquid crystal elements arrayed in a matrix; and thin film transistors for transmitting applied voltage to the liquid crystal elements;

means for connecting at least one signal line to the signal driving means of said first liquid crystal driving devices;

means for connecting another signal line to the signal driving means of said second liquid crystal driving device; and means for shifting in an opposite direction, with reference to the counter voltage, an output voltage range of the analog buffer selected in the signal driving means connected to the at least one signal line with respect to the output voltage range of the analog buffer selected in the signal driving means connected to another signal line.

30. The liquid crystal display device of claim 28, wherein said liquid crystal driving device is integrated on a liquid crystal panel, which comprises said thin film transistors.

31. The liquid crystal display device of claim 29, wherein said liquid crystal driving device is integrated on a liquid crystal panel, which comprises said thin film transistors.

32. An analog buffer, comprising:

thin film transistors, to which a high potential supply voltage and a low potential supply voltage are supplied and which buffers an input voltage and outputs an output voltage, said thin film transistors having a linear region in which a relationship of said output voltage to said input voltage is approximately linear; and supply voltage control means for controlling the value of said high potential supply voltage and said low potential supply voltage so that an amplitude is included in said linear region when a fluctuation range of said input voltage shifts.

33. The analog buffer of claim 32, including:

a differential stage in which said input voltage and said output voltage are input, wherein a voltage difference between the input voltage and the output voltage is amplified and output;

driving means in which the output of said differential stage is input to a gate electrode, said driving means further including an n-channel driving transistor which outputs said output voltage from a drain region; and said supply voltage control means shifts to a low potential side the value of said high potential supply voltage and said low potential supply voltage so that when an amplitude of said input voltage shifts to the low potential side said amplitude is included in said linear region which is located on a high potential side.

34. The analog buffer of claim 32, including:

a differential stage in which said input voltage and said output voltage are input and a voltage difference between the input voltage and the output voltage is amplified and output;

driving means in which the output of said differential stage is input to a gate electrode, said driving means further including a p-channel driving transistor which outputs said output voltage from a drain region; and said supply voltage control means shifts to a high potential side the value of said high potential supply voltage and said low potential supply voltage so that when an amplitude of said input voltage shifts to the high potential side, said amplitude is included in said linear region which is located on a low potential side.

35. The analog buffer of claim 32, including means for canceling an offset value of said analog buffer by adjusting the value of a counter voltage.

36. A liquid crystal display device including the analog buffer as recited in claim 32, further comprising:

at least one liquid crystal driving device containing said analog buffer;

signal lines which are connected to a signal driving means of the at least one liquid crystal driving device;

scan lines which intersect at the signal lines;

liquid crystal elements arrayed in a matrix; and thin film transistors for transmitting applied voltage to the liquid crystal elements.

37. The liquid crystal display device of claim 36, wherein said at least one liquid crystal driving device is integrated on a liquid crystal panel comprised of said thin film transistors.

38. A liquid crystal driving method for driving a plurality of liquid crystal elements arrayed in a matrix by supplying a voltage to a first side of selected ones of the liquid crystal elements and supplying a counter voltage to a second side of the selected ones of the liquid crystal elements, the method comprising:

sequentially sampling and holding video signals, buffering the sampled and held video signals by means of analog buffers which are supplied a high potential supply voltage and a low potential supply voltage, and selecting an output of the analog buffers;

controlling a value of said high potential supply voltage and said low potential supply voltage supplied to said analog buffers to shift a range of the output voltage of said analog buffers to one of the high potential side and the low potential side based on said counter voltage; and controlling the selection of the output of said analog buffers in which the output voltage range shifted.

39. A liquid crystal driving method for driving a plurality of liquid crystal elements arrayed in a matrix by supplying a voltage to a first side of selected ones of the liquid crystal elements and supplying a counter voltage to a second side of the selected ones of the liquid crystal elements, the method comprising:

sequentially sampling and holding video signals, transmitting the sampled and held video signals by a first and second switching means, buffering voltages transmitted via said first switching means with a first analog buffer, buffering a voltage transmitted via said second switching means with a second analog buffer, transmitting an output from said first analog buffer by a third switching means, which turns on and off in conjunction with said second switching means, transmitting an output from said second analog buffer with a fourth switching means, which turns on and off in conjunction with said first switching means;

controlling a value of said high potential supply voltage and said low potential supply voltage supplied to said first and second analog buffers to shift a range of the output voltage of said first and second analog buffers to one of the high potential side and the low potential side based on said counter voltage; and controlling the on and off operation of said first through fourth switching means.

40. A liquid crystal driving method for driving a plurality of liquid crystal elements arrayed in a matrix by supplying a voltage to a first side of selected ones of the liquid crystal elements and supplying a counter voltage to a second side of the selected ones of the liquid crystal elements, the method comprising:

outputting an applied voltage to a signal line with signal driving means, outputting to a scan line the select voltage for selecting whether or not to supply the applied voltage to said selected ones of the liquid crystal elements when the applied voltage from said signal driving means becomes valid, and sequentially delaying the applied voltage by one horizontal scanning period so that said selection voltage becomes effective once the applied voltage from said signal driving means becomes valid.

* * * * *